US005839606A

United States Patent [19]

Kuroyanagi

[11] Patent Number: 5,839,606

[45] Date of Patent: Nov. 24, 1998

[54] METHOD/APPARATUS FOR SEPARATING WIRE HEALDS

[75] Inventor: Kazunori Kuroyanagi, Inasa-gun, Japan

[73] Assignee: Hamamatsu Photonics K.K., Hamamatsu, Japan

[21] Appl. No.: 796,577

[22] Filed: Feb. 7, 1997

[30] Foreign Application Priority Data

| | | | |
|---|---|---|---|
| Feb. 9, 1996 | [JP] | Japan | 8-024176 |
| May 8, 1996 | [JP] | Japan | 8-113787 |
| May 8, 1996 | [JP] | Japan | 8-113799 |
| May 9, 1996 | [JP] | Japan | 8-114894 |

[51] Int. Cl.[6] ..... B23Q 7/04; D03J 1/14

[52] U.S. Cl. ..... 221/212; 221/276; 221/268; 28/205

[58] Field of Search ..... 221/67, 268, 276, 221/212; 28/205, 206

[56] References Cited

U.S. PATENT DOCUMENTS

| | | | |
|---|---|---|---|
| 500,965 | 7/1893 | Sherman | 28/205 |
| 1,379,099 | 5/1921 | Hathaway et al. | 28/205 |
| 1,399,854 | 12/1921 | Field | 28/205 |
| 1,707,626 | 4/1929 | Cummings | 28/205 |
| 1,756,814 | 4/1930 | Colman | 28/206 |
| 2,512,165 | 6/1950 | Meier | 28/206 |
| 2,899,736 | 8/1959 | Fleischer | 28/206 |
| 3,100,932 | 8/1963 | Pipkin | 221/276 |
| 3,235,950 | 2/1966 | Smotzer, Jr. | 221/276 |
| 3,412,895 | 11/1968 | Hilton | 221/268 |
| 3,777,339 | 12/1973 | Fleischer et al. | 28/206 |
| 4,520,539 | 6/1985 | John | 28/206 |

FOREIGN PATENT DOCUMENTS

| | | |
|---|---|---|
| 0 539 062 | 4/1993 | European Pat. Off. . |
| 93/18215 | 9/1993 | WIPO . |

*Primary Examiner*—William E. Terrell
*Assistant Examiner*—Patrick Mackey
*Attorney, Agent, or Firm*—Pillsbury Madison & Sutro LLP

[57] ABSTRACT

An arrangement (apparatus and method) for drawing a wire heald from a group of such wire healds of juxtaposed magnetic material. The method includes the steps of a) inserting a drawing pin located on a notch portion of a magnetic head into a guide hole formed on one side ring portion of the wire heald, b) moving the magnetic head in a longitudinal direction of the wire heald after magnetically attracting the ring portion of the wire heald, and c) drawing the lowermost wire heald as hooked on the drawing pin.

12 Claims, 71 Drawing Sheets

METHOD/APPARATUS FOR SEPARATING WIRE HEALDS

BACKGROUND OF THE INVENTION

1. Field of the Invention

The present invention relates to a drawing/separating method and drawing/separating apparatus of wire heald for drawing a wire heald located at the lowermost position out of a heald group composed of a lot of wire healdes juxtaposed.

2. Related Background Art

An example of conventionally existing heald drawing apparatus is the one described in the bulletin of Japanese Patent Publication No. 60-22097. The heald drawing apparatus disclosed in this bulletin shows the technology for pushing a suction nozzle equipped with a magnet to a rod portion of the outermost heald out of a heald group held by upper and lower guide rails extending horizontally and for carrying the outermost wire heald to a predetermined place as separating the rod portion from the heald group by magnetic force and suction force of the suction nozzle.

The above-stated technology, however, is for the drawing apparatus used for flat healdes having the flat plate-shaped rod portion, but not for drawing apparatus for wire healdes. Namely, a flat heald A is integrally made of SUS 420 or the like having a spring property and, as shown in FIG. 47, has a flat, slender rod portion 1 of a rectangular cross section, a mail 2 is formed at the center of this rod portion 1, ring portions 3 are provided at the both ends of this rod portion 1, and a guide hole 4 of an elongate hole shape is formed in each ring portion 3. Further, this flat heald A bends easily in the direction of an arrow, has characteristics of being strong against torsion and being resistant to deformation, and is always arranged regularly without becoming tangled with each other. It is thus possible to urge the suction nozzle with the magnet against the flat plate-shaped rod portion and properly draw the healdes in order from the outermost of the heald group by the magnetic force and suction force of the suction nozzle with the magnet.

In contrast with it, the wire healdes B are made of hard drawn steel wire (60 carbon) and, as shown in FIG. 48, a wire heald has a slender rod portion 5, a mail 6 is formed at the center of this rod portion 5, ring portions 7 are provided at the both ends of this rod portion 5, and a guide hole 8 is formed in an elongate hole shape in each ring portion 7. Further, this wire heald B has characteristics of being very light in weight, easy to handle, and cheap. However, the wire healdes B are very easy to bend, this ease to bend causes the wire healdes to become tangled with each other, and they have a drawback of ease to deform.

Therefore, if the drawing apparatus for flat healdes disclosed in the aforementioned bulletin of Japanese Patent Publication No. 60-22097 were applied to the wire healdes B, their rod portions would be too slender to draw the rod portion of wire heald B using the suction force and magnetic force of the suction nozzle with the magnet, so as to fail to draw the wire healdes efficiently.

Japanese Laid-open Patent Application No. 64-77653 also discloses a drawing apparatus of wire heald, but this drawing apparatus is arranged to put a separating projection into a predetermined position of the wire heald group and move the separating projection while making a bundle of plural wire healdes, thereby carrying the wire heald B to a predetermined place. However, the drawing apparatus of this type also included a possibility of failure in properly drawing an arbitrary wire heald B as influenced by the easily tangled property of wire healdes B.

SUMMARY OF THE INVENTION

The present invention has been accomplished to solve the above problems and a specific object of the invention is to provide a drawing method of wire heald and a drawing apparatus of wire heald capable of surely drawing the lowermost wire heald out of a group of wire healdes.

It is one object of the present invention to provide a drawing method of wire heald for drawing an arbitrary wire heald out of a lot of wire healds of magnetic material juxtaposed, compring steps of:

inserting a drawing pin located on a notch portion of a magnetic head into a guide hole formed on one side ring portion of said wire heald;

moving said magnetic head in a longitudinal direction of the wire heald after magnetic sucking said ring portion of said wire heald; and drawing the lowermost wire heald as hooked on said drawing pin.

It is further object of the present invention to provide a drawing apparatus for drawing an arbitrary wire heald out of a lot of wire healds of magnetic material juxtaposed, comprising:

a magnetic facing to a guide hole formed in one side of the ring portions of the nearest wire heald and comprising an electromagnetic core;

a drawing pin fixed on a notch portion of said magnetic head and to be inserted into the guide hole of the ring portion;

a first driving means extending in a drawing direction of the wire heald for holding the magnetic head through a movable base; and a second driving means fixed to the movable base for moving the magnetic head to the ring portion and for inserting the drawing pin into the guide hole of the ring portion.

It is more further object of the present invention to provide a wire heald separating method for separating an arbitrary wire healds from the plurality of the wire heald which are juxtaposed, comprising the steps of:

drawing the lowermost wire heald and shifting s ring portion of the drawn wire heald relative to a ring portion of a next wire heald;

thereafter, moving a pair of push claws in a wire heald stacking direction from the outside to exposed one of the ring portions of the next wire heald; and pushing the ring portion of said one ring portion of next wire heald in the wire heald stacking direction with passing a beam portion of the lowermost wire heald between said pair of the push claws to separate the one ring portion of the lowermost wire heald from the one ring portion of the next wire.

It is more further object to provide a wire heald separating mechanism for separating an arbitrary wire healds from the plurality of the wire heald which are juxtaposed, comprising:

a push claw faced to one of ring portions of the lowermost wire heald for drawing the lowermost wire heald and shifting the ring portion of the drawn wire heald relative to a ring portion of a next wire heald and thereafter, moving the exposed one ring portion of next wire heald in a wire heald stacking direction to push the one ring portin of the next wire heald; and a driving means for moving said push claw in a wire heald stacking direction, said claw portion of said push claw pusing the one ring portion of the next wire heald after passing the beam portion of the lowermost wire heald in the moving.

The present invention will be more fully understood from the detailed description given hereinbelow and the accompanying drawings, which are given by way of illustration only and are not to be considered as limiting the present invention.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will be apparent to those skilled in the art from this detailed description.

DESCRIPTION OF THE PREFERRED EMBODIMENTS

Figure 1:
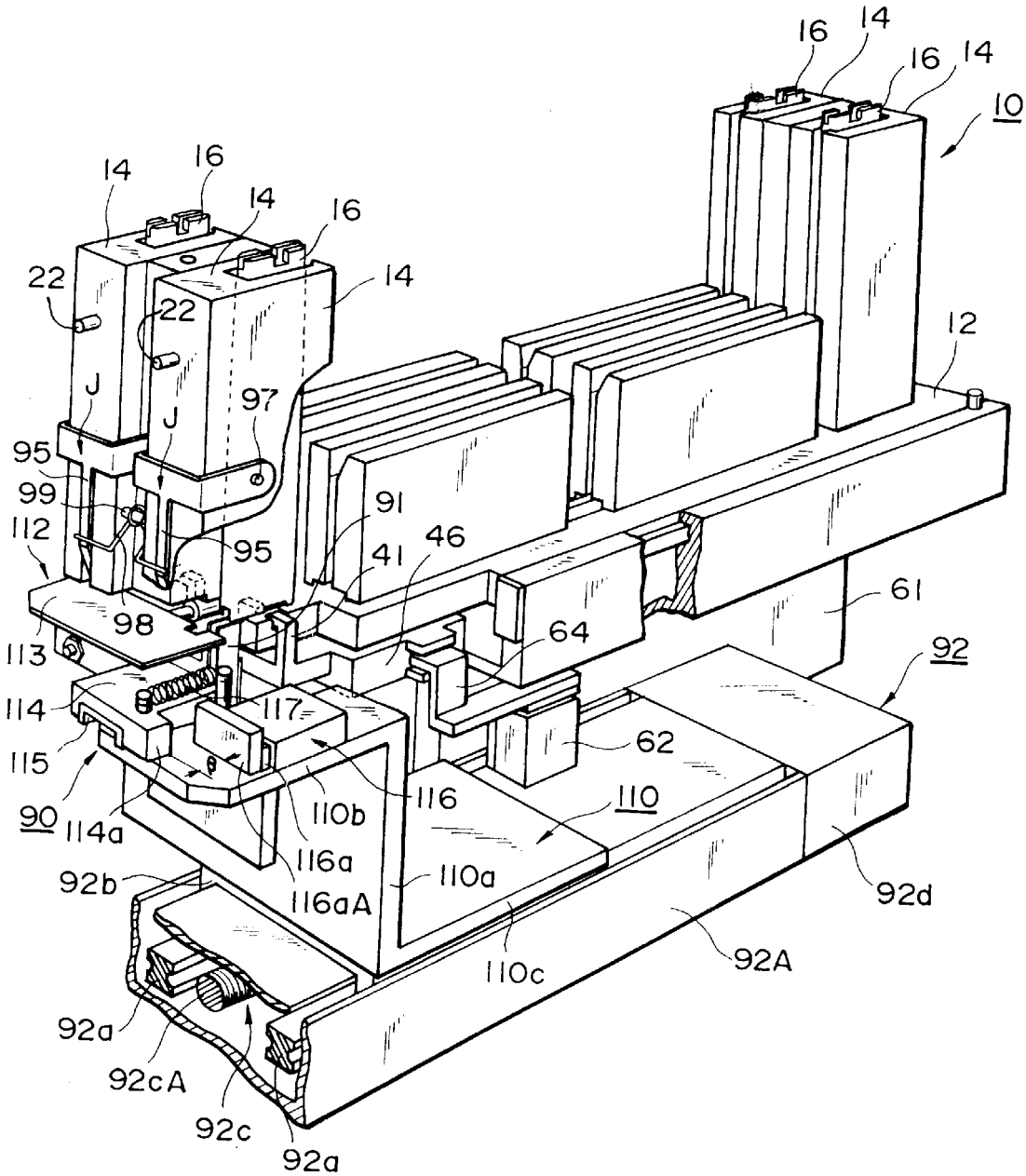
FIG. 1 is a perspective view to show an embodiment of the wire heald stocker to which the drawing apparatus of wire heald according to the present invention is applied.

The preferred embodiments of the drawing method and drawing apparatus of wire heald according to the present invention will be described in detail with reference to the drawings.

Figure 2:
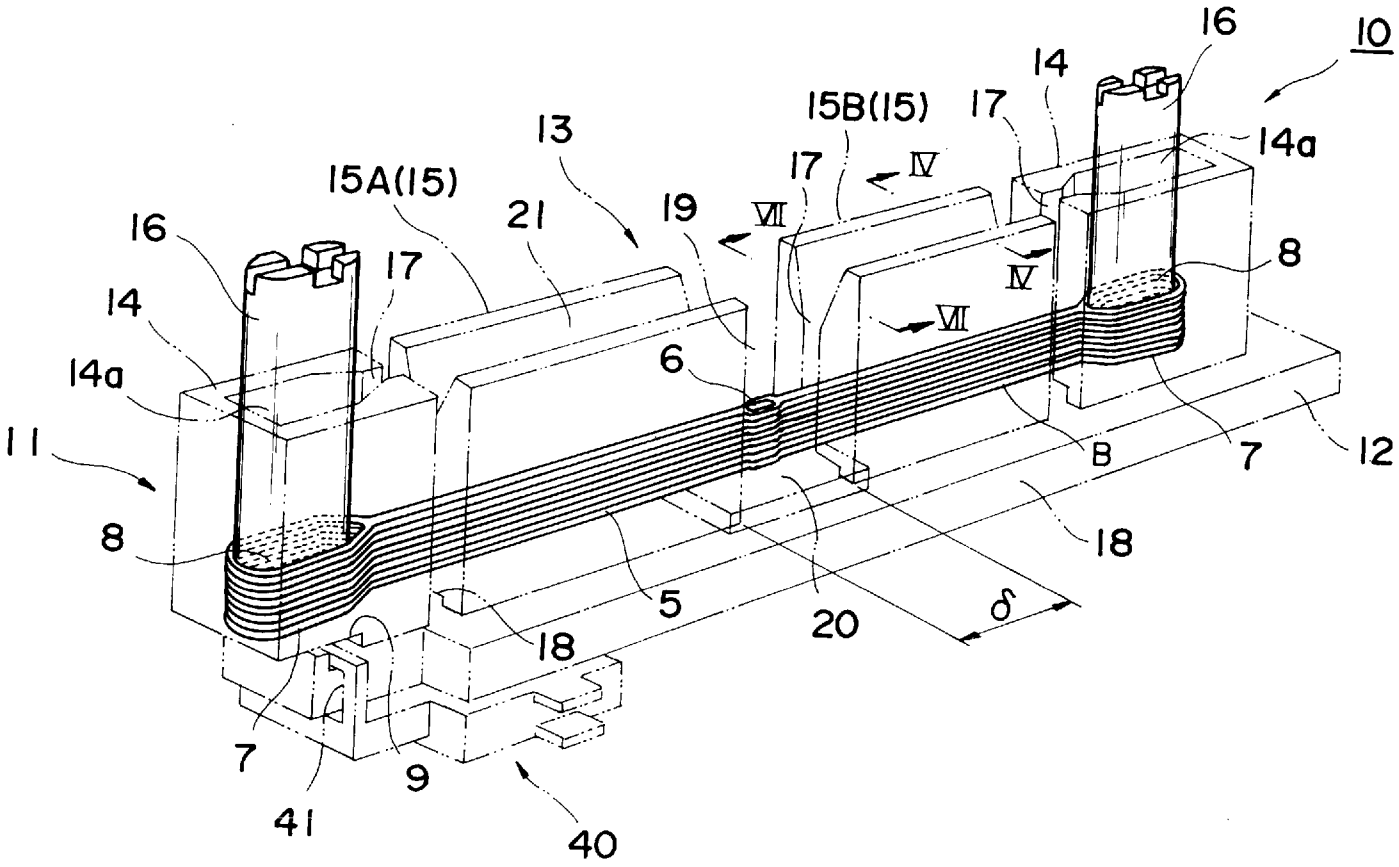
FIG. 2 is a perspective view to representatively show one stocker out of the twin stockers shown in FIG. 1.

FIG. 1 is a perspective view to show a drawing apparatus of wire heald applied to flat placement type twin stockers for wire healdes, and FIG. 2 is a perspective view to representatively show one stocker out of the twin stockers shown in FIG. 1. As shown in FIG. 1 and FIG. 2, a stocker 10 for wire healdes has a housing 11 for keeping wire healdes B of a magnetic material of hard drawn steel wire (60 carbon) or the like horizontal in a vertical stack. This housing 11 is made in a slender shape matching with the slender shape of wire healdes B and is provided with a flat base 12, a frame 13 standing and fixed on this base 12, and a heald drawing aperture 9 cut at the lower front end in a horizontally elongate shape. This frame 13 has ring receiving portions 14 located at the both ends of the frame and arranged to receive the ring portions 7 of wire healdes B, and a rod receiving portion 15 located between these ring receiving portions 14, 14 and arranged to receive the rod portions 5 of wire healdes B.

A bar-shaped floating rod 16 extending vertically is inserted in each ring receiving portion 14 and the outer shape of each floating rod 16 nearly matches with the inner shape of ring portion 7. Therefore, every time the lowermost wire heald B is drawn out, the ring portions 7 of wire healdes B can drop naturally along the floating rods 16, thus permitting a stable stack of wire healdes B. The floating rods 16 are lightweight, and the surfaces thereof are mirror-finished so as to facilitate sliding of wire heald B and are subjected to an abrasion-resistive surface treatment so as to be unharmed by the wire heald B. An example is a floating rod 16 obtained by covering a surface of a metal or another material (stainless steel, aluminum, plastics, or the like) machined in a predetermined shape by hard chromium plating. This floating rod 16 is made preferably of a substance unlikely to be magnetized. The reason is as follows. If the floating rod 16 were magnetized by influence of magnetic head 91 described hereinafter, disposed near the floating rod 16, the ring portions 7 would be difficult to drop naturally along the floating rod 16 as the stacked ring portions 7 are magnetically attached to the floating rod 16.

Other examples of preferred materials for the floating rod 16 include ceramics, hard glass, aluminum with an evaporated ceramic layer, plastics with an evaporated ceramic layer, SUS 304 with an evaporated ceramic layer, and so on.

Figure 3A:
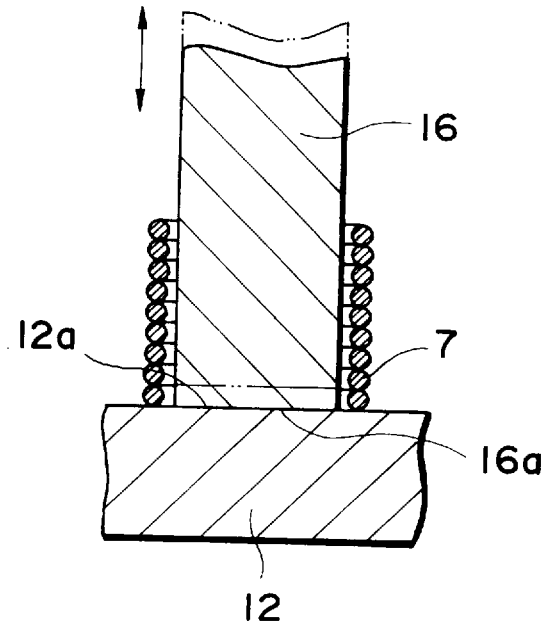
FIGS. 3A and 3B are cross-sectional views to show a state in which the floating rods are inserted in the ring portions of wire healds.

As shown in FIG. 3A lower end faces 16*a* of the front and rear floating rods 16 are in contact with a heald receiving bottom surface 12*a* formed in the surface of base 12 and are urged against the heald receiving bottom surface 12*a* by self-weight of floating rod 16. Namely, this floating rod 16 is just put into the ring receiving portion 14 from the top, and thus is free vertically relative to the base 12. Therefore, the floating rod 16 can freely travel vertically (in the directions of arrows) in the ring receiving portion 14 of housing 11.

Advantages of use of the front and rear floating rods 16 are as follows. By the self-weight of wire healdes B stacked, the wire healdes B can be arranged vertically in correct order, and at the same time, that state can be always maintained so as to prevent entanglement between ring portions of stacked wire healdes B. Further, the floating rods 16 can keep the ring portions 7 in a horizontal state, which makes horizontal drawing of wire heald B extremely easy.

The floating rod 16 is kept simply in contact with the heald receiving bottom surface 12*a* of base 12 by its self-weight. When the lowermost wire heald B is drawn out horizontally, the ring portion 7 of wire heald B cuts into a tapered ring pulling portion 16*c* (see FIG. 14) of floating rod 16 as described hereinafter, whereby it can easily push the lower end face 16*a* of floating rod 16 up. As a result, only the ring portion 7 under draw is drawn out as sandwiched between the lower end face 16*a* of floating rod 16 and the heald receiving bottom surface 12*a*. Accordingly, the ring portions 7 of wire healdes B except for the one under drawing operation are maintained as the floating rods 16 are inserted therein, and only the wire heald B under draw is drawn forward as pushing the floating rod 16 up.

As shown in FIG. 2, a ring receiving space 14*a* extending vertically is formed in each ring receiving portion 14 in order to receive the ring portions 7 in a stack state. The upper part of each ring receiving space 14*a* is so open as to permit insertion of floating rod 16 and one side part of the ring receiving space 14*a* is open, as being cut, to permit insertion of rod portions 5 of wire healdes B. Since the ring receiving space 14*a* is formed so as to surround the floating rod 16, the ring portions can be received surely in the ring receiving portion 14 while the floating rod 16 is supported by the ring receiving portion 14 through the ring portions 7 of wire healdes B.

Figure 4:
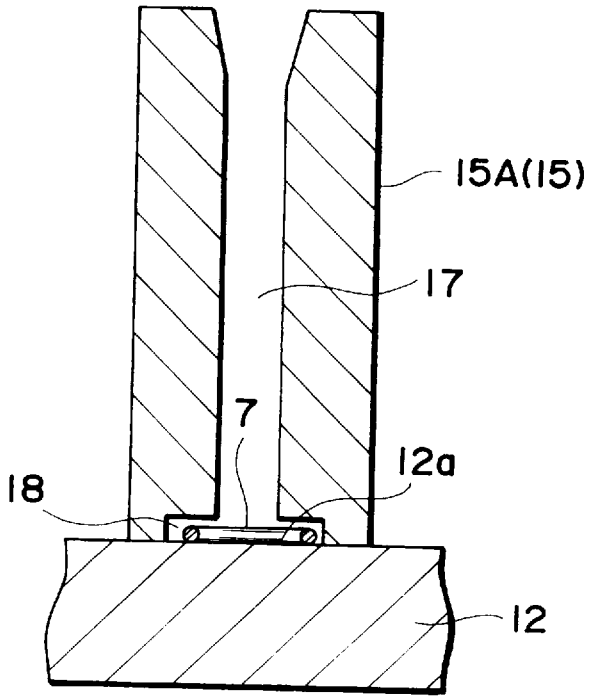
FIG. 4 is a cross-sectional view taken along line IV—IV in FIG. 2.

As shown in FIG. 2 and FIG. 4, a slender rod receiving slit 17 for receiving the rod portions 5 is formed longitudinally at the center of housing 11. This rod receiving slit 17 is provided on a straight line connecting the ring receiving spaces 14*a* at the both ends. Namely, the rod receiving slit 17 is formed throughout the entire length of the rod receiving portion 15 and in parts of the ring receiving portions 14. Formed at the lower end of the rod receiving slit 17 is a ring guide hole 18 for surely sliding and guiding the ring portion 7 of the lowermost wire heald B along the heald receiving bottom surface 12*a*.

This ring guide hole 18 is so formed that the lower end of rod receiving slit 17 is expanded horizontally immediately above the heald receiving bottom surface 12*a*. Further, the ring guide hole 18 has a width slightly larger than that of ring portion 7 and a height enough for only the lowermost ring portion 7 to pass. The ring guide hole 18 is formed throughout the entire length of the rod receiving slit 17 and thus, the wide ring portion 7 will be prevented from being caught in the housing 11. In addition, even when an old wire heald B with the ring portion 7 being somewhat twisted relative to the rod portion 5 is drawn out horizontally, the wire heald B can be drawn horizontally stably, regardless of twist of ring portion 7. Further, the ring guide hole 18 prevents the rear ring portion 7 of the lowermost wire heald B from intruding into the rod portions 5 stacked in the rod receiving slit 17 during drawing of the lowermost wire heald B.

Figure 6:
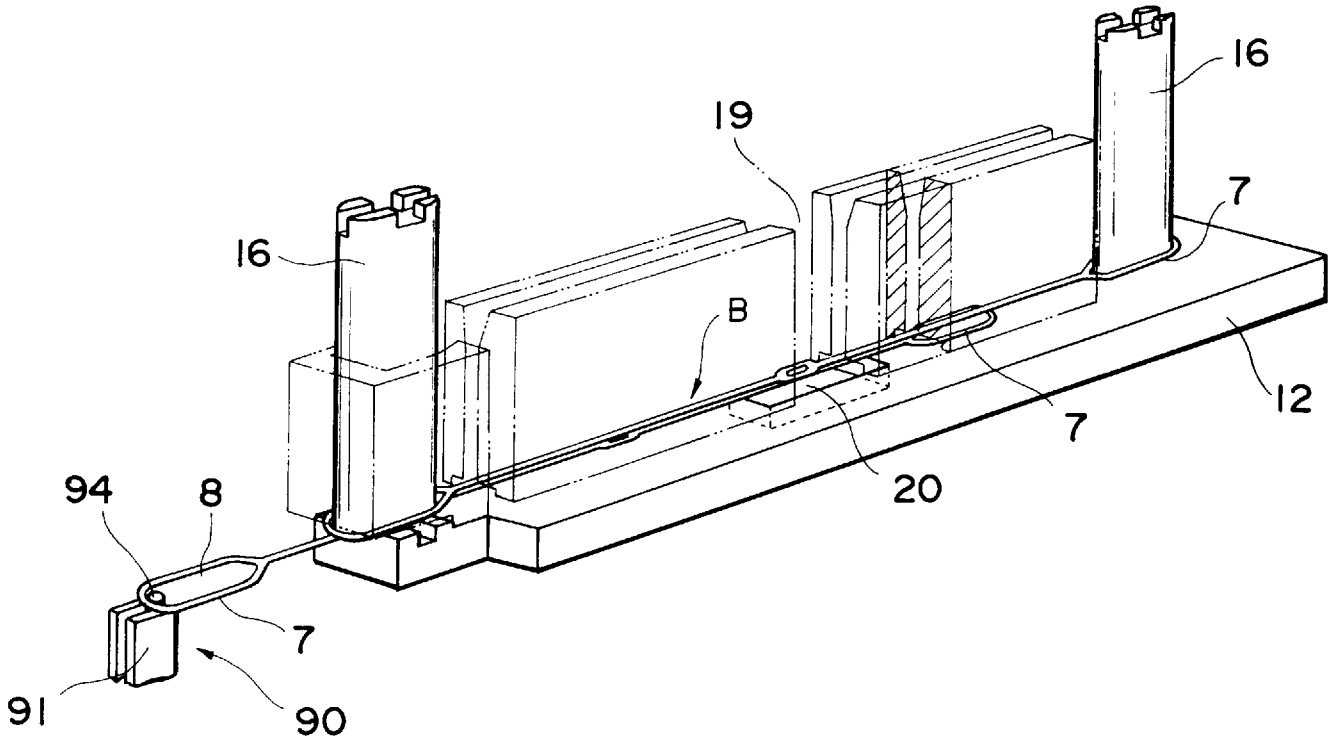
FIG. 6 is a perspective view to show a state in which the lowermost wire heald is drawn out of the wire heald stocker.

As shown in FIG. 2 and FIG. 6, the rod receiving portion 15 of housing 11 is divided into front and rear parts comprised of first rod receiving part 15A and second rod receiving part 15B. The rod receiving portion 15 is fixed on the base 12 so as to separate the first rod receiving portion 15A and the second rod receiving portion 15B from each other, whereby this space region between them can be utilized as a mail receiving space portion 19. When the mails 6 are stacked in this mail receiving space portion 19, the wide space of the mail receiving space portion 19 can enhance degrees of freedom permitting the mails 6 to move vertically and horizontally. Further, formed in the heald receiving bottom surface 12*a* is a heald escape recess 20 for expanding the lower part of the mail receiving space portion 19. Namely, the heald escape recess 20 opens the region below the lowermost mail 6.

Figure 5:
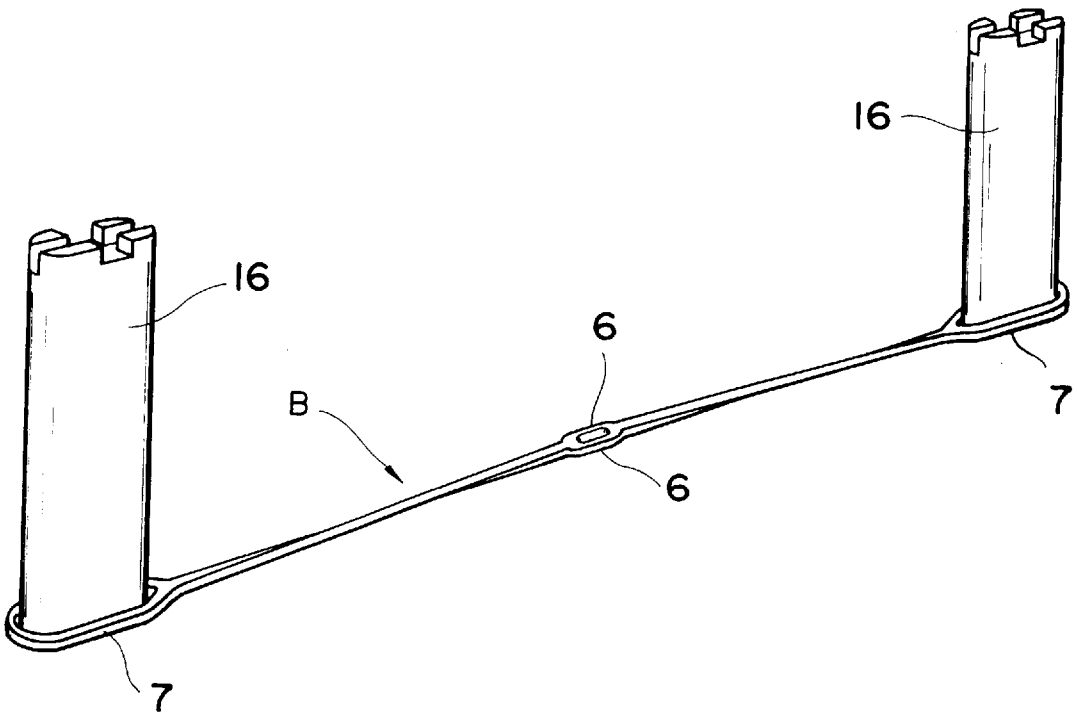
FIG. 5 is a perspective view to show a mutually tangled state of wire healds.
Figure 7:
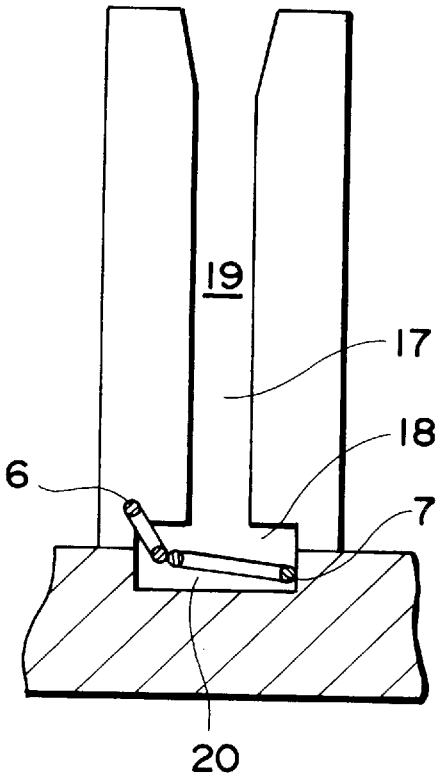
FIG. 7 is a cross-sectional view taken along line VII—VII in FIG. 2.

Thus, if upper and lower mails 6 become tangled with each other so as to reverse the upper and lower wire healdes B near the mails 6 as shown in FIG. 5, horizontal drawing of the lowermost wire heald B as shown in FIG. 6 will make the ring portion 7 under draw collide with the mail 6 as shown in FIG. 7, thereby canceling entanglement between the wire healdes B as escaping from each other. Also, the spacing δ (see FIG. 2) between the first rod receiving portion 15A and the second rod receiving portion 15B forming the mail receiving space portion 19 is set shorter than the length of the ring portion 7, whereby before the rearmost end of the ring portion 7 leaving the ring guide hole 18 of the second rod receiving portion 15B becomes completely off in the region of the mail receiving space portion 19, the front end of the ring portion 7 (the connecting end between the ring portion 7 and the rod portion 5) can be pulled into the first rod receiving portion 15A. As a result, the wire heald can be conveyed stably as keeping the ring portion 7 horizontal in the mail receiving space portion 19, and in addition, escape of the mail 6 entangled with the wire heald B under draw can be effected certainly.

As shown in FIG. 2, a heald refilling aperture 21 extending horizontally is provided at the top portion of the frame 13 of housing 11 and this heald refilling aperture 21 is provided at a position different from that of the heald drawing aperture 9 for drawing the wire heald B horizontally. Accordingly, upon refilling operation of wire healdes B, the refilling operation can be performed by a wire heald refilling magazine or the like (not shown) as utilizing compressed air from the upper part of the housing 11, the self-weight of healdes B, and so on, thus facilitating the refilling operation of wire healdes B. Further, it permits one to perform the refilling operation as looking into this aperture 21 from the top. Also, the upper part of the rod receiving slit 17 provided in the rod receiving portion 15 of the frame 13 is expanded in a funnel shape, which facilitates insertion of the wire healdes B into the rode receiving slit 17.

Figure 8:
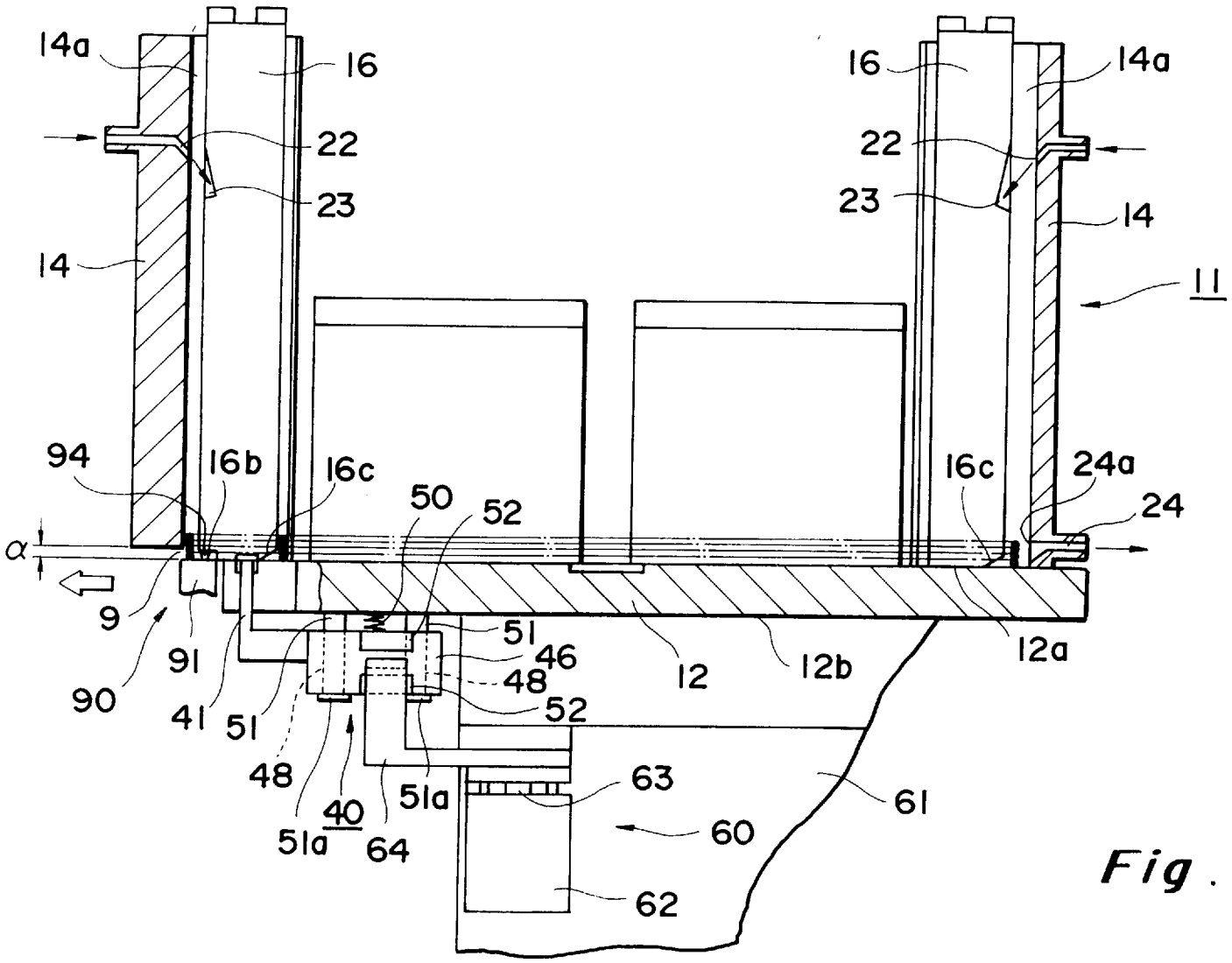
FIG. 8 is a longitudinal cross-sectional view of the wire heald stocker.

As shown in FIG. 8, an air blowoff port 22 for supplying compressed air from the outside into the ring receiving space 14*a* is provided in each upper part of the front and rear ring receiving portions 14, and each air blowoff port 22 blows off the compressed air obliquely from above toward the front and rear floating rods 16. Further, an air catch recess 23 cut in an L-shaped cross section is formed in the upper part of the floating rod 16, and this air catch recess 23 is provided at a position where it faces the air blowoff port 22.

Accordingly, since the compressed air blown off from the air blowoff port 22 continues pushing the air catch recess 23 obliquely from above it, predetermined downward pressure can be continuously applied to the floating rod 16, whereby the floating rod 16 can be prevented properly from jumping when the lowermost wire heald B is drawn out as being pinched between the lower end face 16*a* of the floating rod 16 and the heald receiving bottom surface 12*a*. Also, a descending current occurs in the ring receiving space 14*a* and this current can continuously push the ring portions 7 from the top. Thus, every time the wire heald B is drawn out, the ring portions 7 can forcibly be moved down in order along the floating rod 16, which can prevent the ring portions 7 from being caught by the floating rod 16 and thus from stopping.

Further, an air suction portion 24 for forcibly discharging the air in the ring receiving space 14*a* to the outside is provided in the lower part of the rear ring receiving portion 14, and this air suction portion 24 sucks the lower ring portions 7 mounted on the rear floating rod 16 backward. This backward suction by the air suction portion 24 is designed to cover several wire healdes B stacked from the bottom, and a suction port 24*a* of the air suction portion 24 is expanded in a funnel shape toward the inside. Thus, use of the air suction portion 24 permits the air in the ring receiving space 14*a* to be evacuated continuously, whereby the several ring portions 7 from the bottom can continuously be drawn backward. Therefore, when the lowermost wire heald B is forcibly drawn out, the wire heald B under draw is prevented from taking the wire heald B immediately above it together, which enables sure and smooth drawing of wire heald B.

Next described is a drawing apparatus 90 for drawing the wire healdes B of the magnetic material stacked vertically in the stocker 10 as described above one by one from the lowermost.

As shown in FIG. 1 and FIG. 9A to FIG. 12, the drawing apparatus 90 of wire heald according to the present invention comprises a magnetic head 91 for drawing of heald arranged to move vertically and comprised of an iron core forming a part of an electromagnet, a drawing pin 94 provided at the top part of the magnetic head 91 and made of a non-magnetic material, a translating unit 92 as a first driving means for moving the magnetic head 91 horizontally, and a piston mechanism 93 as a second driving means for moving the magnetic head 91 vertically.

Figure 13A:
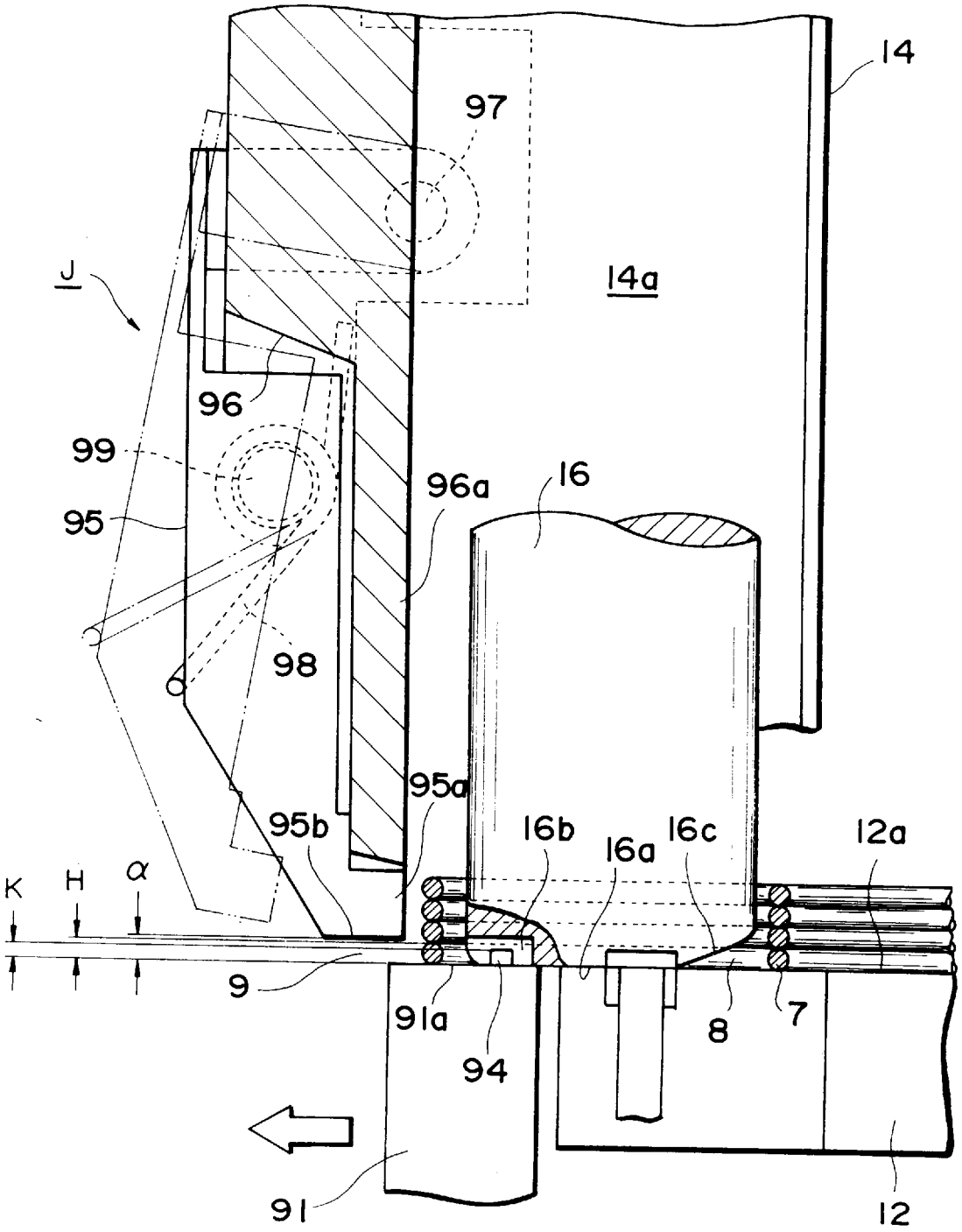
FIG. 13A is a cross-sectional view to show the multiple draw preventing portion.

As shown in FIG. 13A for drawing the lowermost wire heald B, the magnetic head 91 is opposed to the guide hole 8 formed in the lowermost front ring portion 7 and is located in front of the base 12 and below the front floating rod 16. Further, the drawing pin 94 made of the non-magnetic material is fixed to the tip (the apical end) of the magnetic head 91, and this drawing pin 94 is inserted into the guide hole 8 and has the height K a little lower than the height H of the ring portion 7. Therefore, the wire heald B can be drawn out as the drawing pin 94 catches only the lowermost ring portion 7.

Further, as shown in FIG. 1 and FIG. 13A, the front ring receiving portion 14 is provided with a multiple draw preventing portion J located in front of the front floating rod 16. This multiple draw preventing portion J has a rotatable plate-shaped switch piece 95, and this switch piece 95 is received in a switch piece receiving portion 96 of a slit shape formed in a front-end lower portion of the ring receiving portion 14. An engaging portion 95*a* provided at the tip of the switch piece 95 is located so as to face the ring receiving space 14*a* and is positioned so as to be opposed to the second and higher ring portions 7 from the bottom, excluding the lowermost ring portion 7.

This switch piece 95 rotates about a rotation axis 97 fixed to the ring receiving portion 14 and is urged against a regulating wall 96*a* of the switch piece receiving portion 96 by a torsion coil spring 98. This torsion coil spring 98 is wound around a support bar 99 fixed to the ring receiving portion 14 so that one end of the torsion coil spring 98 is in contact with the back of the switch piece 95 while the other end in contact with the ring receiving portion 14. Accordingly, this torsion coil spring 98 can keep the switch piece 95 always urged against the regulating wall 96*a*. A heald drawing aperture 9 is formed between the lower end face 95*b* of the switch piece 95 and the tip end face 91*a* of the magnetic head 91, and this heald drawing aperture 9 has such a height $\alpha$ as to permit only the lowermost wire heald B hooked on the drawing pin 94 to pass narrowly.

While the lowermost wire heald B is drawn out horizontally as hooking the lowermost ring portion 7 on the drawing pin 94 with the lowermost ring portion 7 being magnetically attached to the tip end face (attaching surface) 91*a* of the magnetic head 91, a second and higher wire healdes B from the bottom are sometimes taken together by friction. On that occasion, the other wire healdes B taken together by the lowermost wire heald B come to hit the engaging portion 95*a* of the switch piece 95 urged by the predetermined spring force to be pushed back. As a result, only the lowermost wire heald B is drawn out through the heald drawing aperture 9. When some unexpected wire healdes B are taken together over the urging force of the torsion coil spring 98, the unexpected wire healdes B other than the lowermost continuously push the switch piece 95, so that the switch piece 95 continues rotating as shown by the chain double-dashed lines. Then a predetermined detection means (a photosensor, for example) detects the rotation of the switch piece 95 to stop advance of the magnetic head 91 by the translating unit 92.

Figure 14:
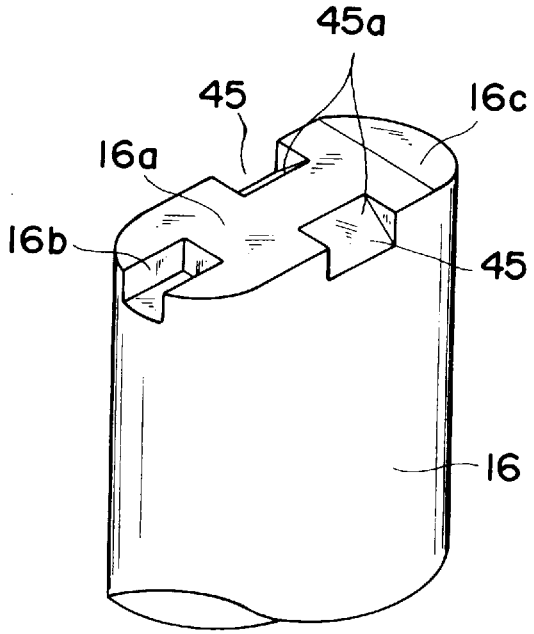
FIG. 14 is a perspective view to show the lower end portion of the front floating rod.

As shown in FIG. 13A and FIG. 14, in order to properly insert the drawing pin 94 into the guide hole 8 of the lowermost ring portion 7, the notch portion 16*b* for guiding the drawing pin 94 thereinto from the bottom is provided in the front part of the lower end face 16*a* in the front floating rod 16. Further, the tapered ring pulling portion 16*c* is formed in the rear part of the lower end face 16*a* of the floating rod 16, and this ring pulling portion 16*c* permits the front ring portion 7 under draw to be easily pulled into between the lower end face 16*a* of the front floating rod 16 and the heald receiving bottom surface 12*a*. It is, however, noted that the rear floating rod 16 may be a floating rod 16 without any notch portion 16*b* for drawing pin.

As shown in FIG. 1 and FIG. 9A to FIG. 12, the drawing apparatus 90 has the translating unit 92 as a first driving means for moving the aforementioned magnetic head 91 horizontally. This translating unit 92 is installed below the stocker 10 and located adjacent to a support stage 61 for supporting the base 12 of housing 11. Further, the translating unit 92 is composed of guide rails 92*a* housed in the main body 92A and set along the extending direction of wire heald B, a table 92*b* arranged to slide along the guide rails 92*a*, and a driving mechanism 92*c* housed in the main body 92A and arranged to move the table 92*b*. The driving mechanism 92*c* is comprised of a screw shaft 92*c*A extending along the guide rails 92*a*, a nut portion. (not shown) meshed with the screw shaft 92*c*A and fixed to the table 92*b*, and a servo motor 92*d* for driving the screw shaft 92*c*A. Accordingly, when this servo motor 92*d* is driven, the table 92*b* translates along the guide rails 92*a*. Since the stop position of the table 92*b* is electrically controlled by a control system, the apparatus is ready for a wide variety of wire healdes B sufficiently. The translating unit 92 may be a linear motor guide.

A lower part 110*c* of moving base 110 is fixed on the table 92*b*, and a support portion 91A of the magnetic head 91 is mounted to an upright portion 110*a* of the moving base 110 so that the support portion 91A may slide vertically along a guide groove 111 provided in the upright portion 110*a*. The piston mechanism 93 as a second driving means is fixed in a standing state to a lower part 110*c* of the moving base 110, and a piston rod 93*a* of this piston mechanism 93 is fixed to the support portion 91A of the magnetic head 91. Therefore, the piston mechanism 93 can translate together with the moving base 110 and can move the magnetic head 91 vertically. When the piston rod 93*a* is projected upward, the magnetic head 91 is moved toward the ring portion 7, whereby the drawing pin 94 can be inserted into the guide hole 8 of the ring portion 7.

Further, as shown in FIG. 1 and FIG. 15 to FIG. 17, an upper part 110*b* of the moving base 110 is provided with a drop preventing mechanism 112 for engaging the drawing pin 94 on the way of drawing of wire heald B to hold hooking of the lowermost ring portion 7 on the drawing pin 94. This drop preventing mechanism 112 comprises a plate-shaped drop preventing portion 113 located to face the drawing pin 94 in front thereof in the drawing direction of wire heald B and provided in the upper part 110*b* of the moving base 110, the drop preventing portion 113 being arranged to engage the drawing pin 94 on the way of drawing of the wire heald B so as to hold hooking of the ring portion 7 on the drawing pin 94, a moving base portion 114 for holding the drop preventing portion 113 on the moving base 110, a linear guide 115 for sliding and guiding the moving base portion 114 on the upper part 110*b* of the moving base 110, a piston mechanism 116 for translationally moving the moving base portion 114, fixed to the upper part 110*b* of the moving base 110, and a tension spring 117 stretched between the moving base portion 114 and the upper part 110*b* of the moving base 110.

Further, a push portion 116*a* provided at the tip end of the piston rod 116*a* in the piston mechanism 116 is opposed to an engaging projection 114*a* provided in the moving base portion 114, and the push portion 116*a*A of the piston rod 116*a* is spaced by the distance β from the engaging projection 114*a* of the moving base 114. When the moving base 110 is moved by β, the piston mechanism 116 also moves by β as following the moving base 110, but the moving base portion 114 keeps its position without following the movement of the moving base 110, because it is attached through the tension spring 117 and linear guide 115 to the moving base 110. As a result of such movement, the push portion 116*a*A of the piston rod 116 goes into contact with the engaging projection 114*a* of the moving base portion 114 and at the same time as it, the drawing pin 94 of the magnetic head 91 moved by β by the moving base 110 goes into contact with the drop preventing portion 113 free of the movement of β of the moving base 110. Accordingly, the ring portion 7 can be sandwiched between the tip end face 91*a* of the magnetic head 91 and the drop preventing portion 113, and therefore, the ring portion 7 is prevented from dropping off from the drawing pin 94 during further drawing of wire heald B. Even if an unexpected accident occurs in the magnetic head 91 to result in losing the magnetic force, the ring portion 7 will be kept from dropping off from the drawing pin 94.

When the piston rod 116*a* is projected in this state to advance the moving base portion 114 in the drawing direction, the engagement between the drop preventing portion 113 and the drawing pin 94 can be released. By retracting the piston rod 116*a*, the spring force of the tension spring 117 moves the moving base portion 114 back, thereby returning the drop preventing portion 113 to the original position.

Further, the drop preventing mechanism 112 is provided with a positioning portion 120, and this positioning portion 120 is used to keep the stop position of the drop preventing portion 113 always constant relative to the drawing pin 94 while the lowermost wire heald B held on the floating rods 16 is drawn out by the drawing pin 94. This positioning portion 120 comprises a stop pin 121 attached to the moving base portion 114, a projecting amount of which can be finely adjusted by a screw means, and a stopper rod 122 projecting from the front end of the base 12. Accordingly, urging the moving base portion 114 by the tension spring 117, the stopper rod 122 comes to hit the stop pin 121, whereby the distance of spacing between the drawing pin 94 and the drop preventing portion 113 can be always kept constant before drawing of wire heald B by the magnetic head 91.

DRAWING METHOD

Next described is the drawing method of wire heald B, based on the configuration of the drawing apparatus 90 of wire heald described above.

Figure 15:
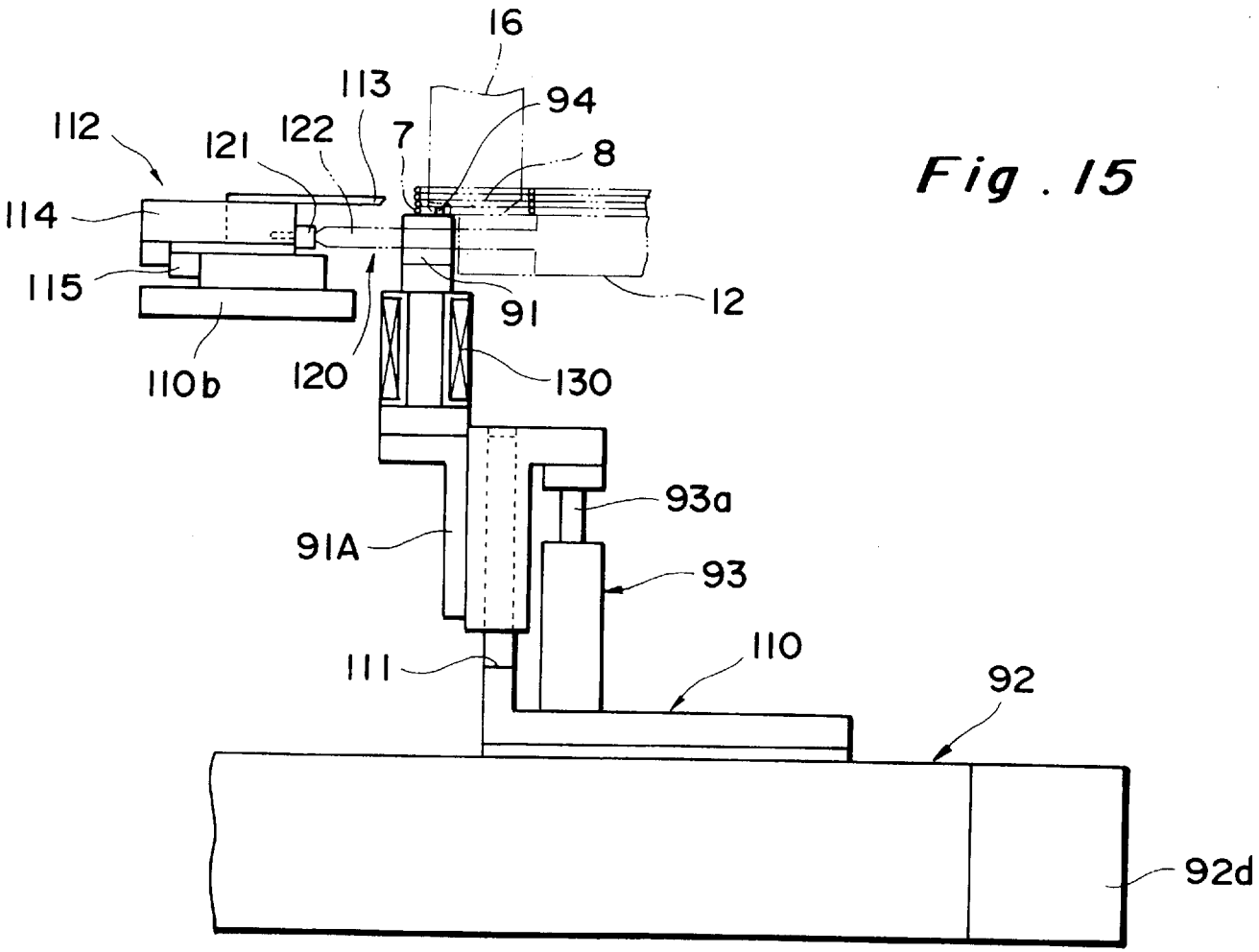
FIG. 15 is a side view to show a state in which the lowermost wire heald is hooked on the drawing pin of the magnetic head.
Figure 16:
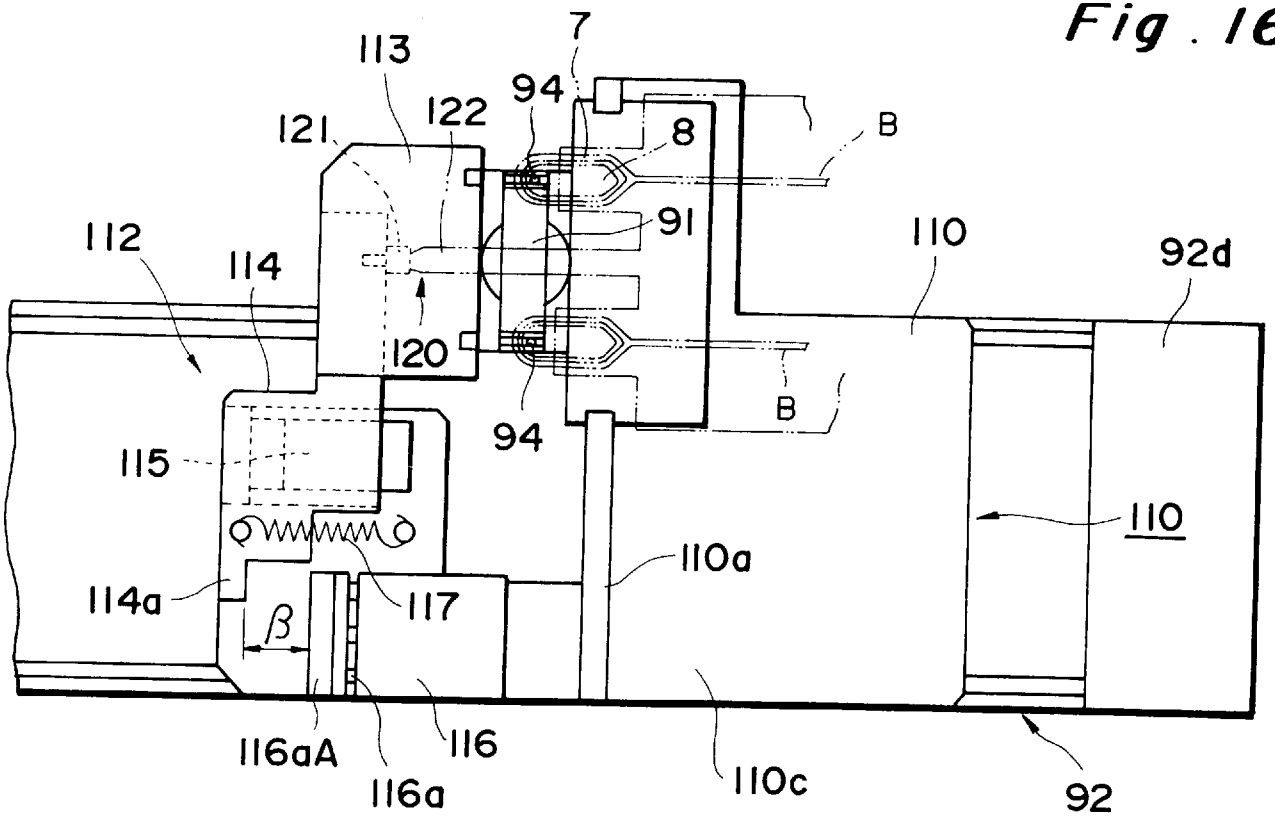
FIG. 16 is a plan view of FIG. 15.
Figure 17:
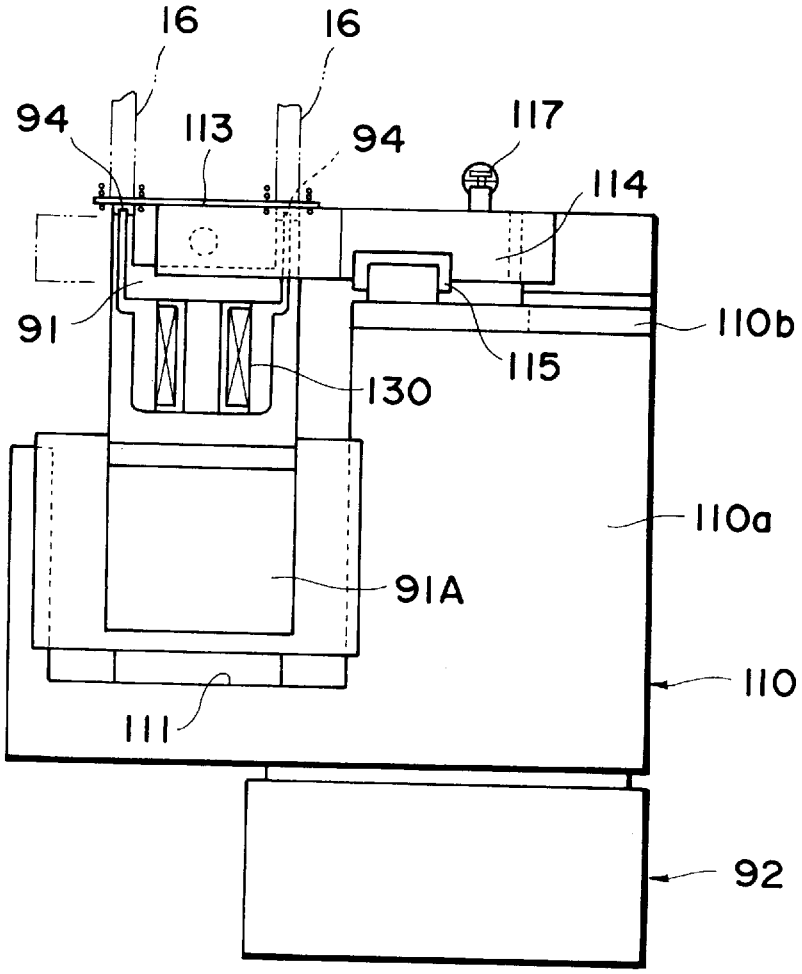
FIG. 17 is a front view of FIG. 15.

First, as shown in FIG. 15, the piston mechanism (second driving means) 93 fixed to the moving base 110 is driven to project the piston rod 93*a* upward by a predetermined amount, thereby lifting the magnetic head 91. As a result, as shown in FIG. 13A, the drawing pin 94 is inserted into a guide hole 8 of the lowest ring portion 7 and inserted into the projecting portion 16*b* of the front floating rod 16. At this time, the coil 130 disposed around the magnetic head 91 is energized to make the ring portion 7 magnetically attached to the tip end face of magnetic head 91, thus becoming ready for drawing of wire heald B.

Figure 18:
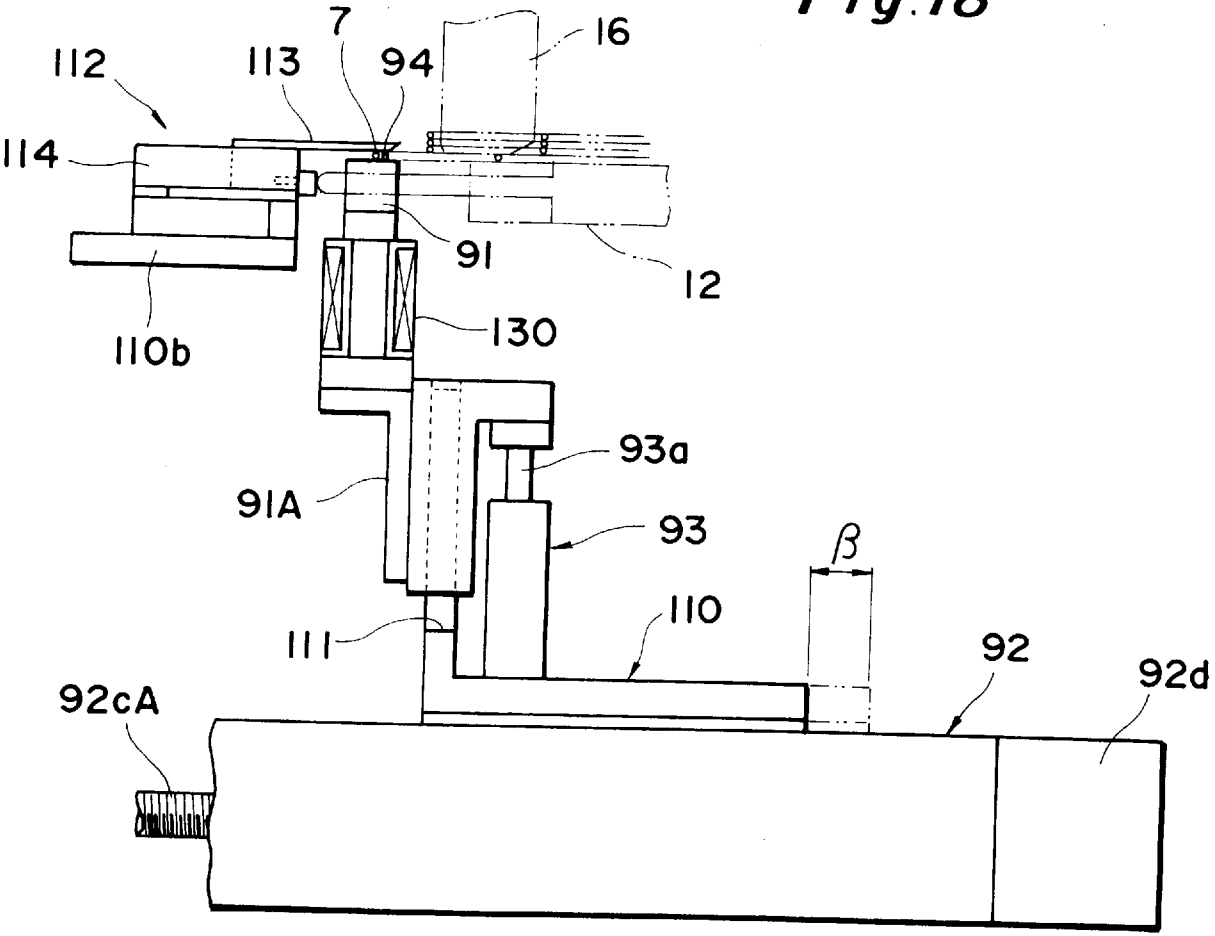
FIG. 18 is a side view to show a state in which the lowermost wire heald is drawn out up to the drop preventing portion.
Figure 19:
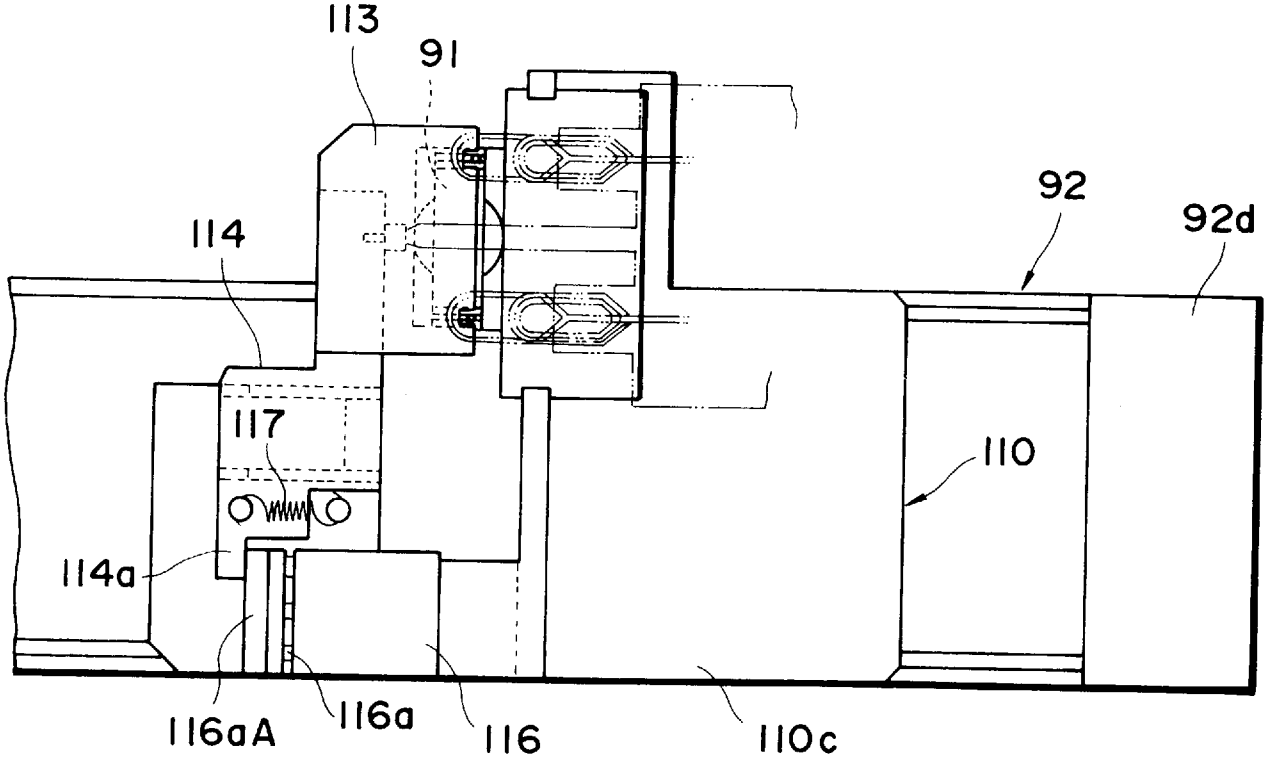
FIG. 19 is a plan view of FIG. 18.

In this state, as shown in FIG. 18 and FIG. 19, the servo motor 92*d* of the driving mechanism 92*c* in the translating unit (first driving means) 92 is driven to rotate the screw shaft 92*c*A in a predetermined direction, thereby advancing the moving base 110 horizontally by β. As a result, as the drawing pin 94 leaves the notch portion 16*b* of the front floating rod 16, the front ring portion 17 is guided into between the lower end face 16*a* of the front floating rod 16 and the heald receiving bottom surface 12*a* through the tapered ring pulling portion 16*c* (see FIG. 13A). Similarly, the rear ring portion 7 is also guided into between the lower end face 16*a* of the rear floating rod 16 and the heald receiving bottom surface 12*a* through the tapered ring pulling portion 16*c* of the rear floating rod 16.

At this time the lowermost wire heald B is drawn by β by the drawing pin 94 and at the same time, the lowermost ring portion 7 is kept as hooked on the magnetic head 91 by engagement between the drawing pin 94 and the drop preventing portion 113, whereby the lowermost ring portion 7 is properly prevented from dropping off from the magnetic head 91 during further drawing of wire heald B. The push portion 116*a*A of the piston rod 116*a* is in contact with the engaging projection 114*a* of the moving base portion 114, thereby preparing for movement of the drop preventing portion 113.

Figure 20:
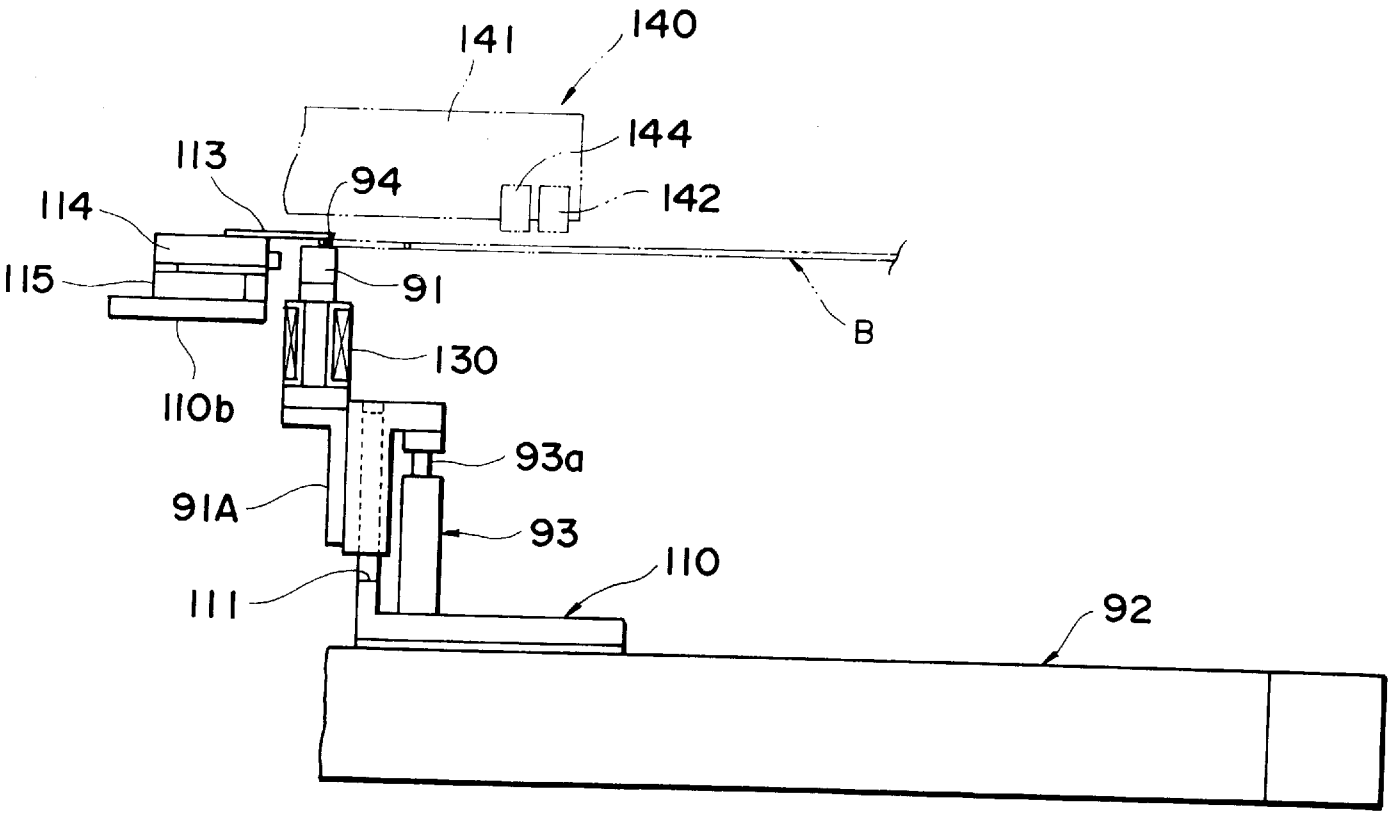
FIG. 20 is a side view to show a midway state of drawing of wire heald by the magnetic head.
Figure 21:
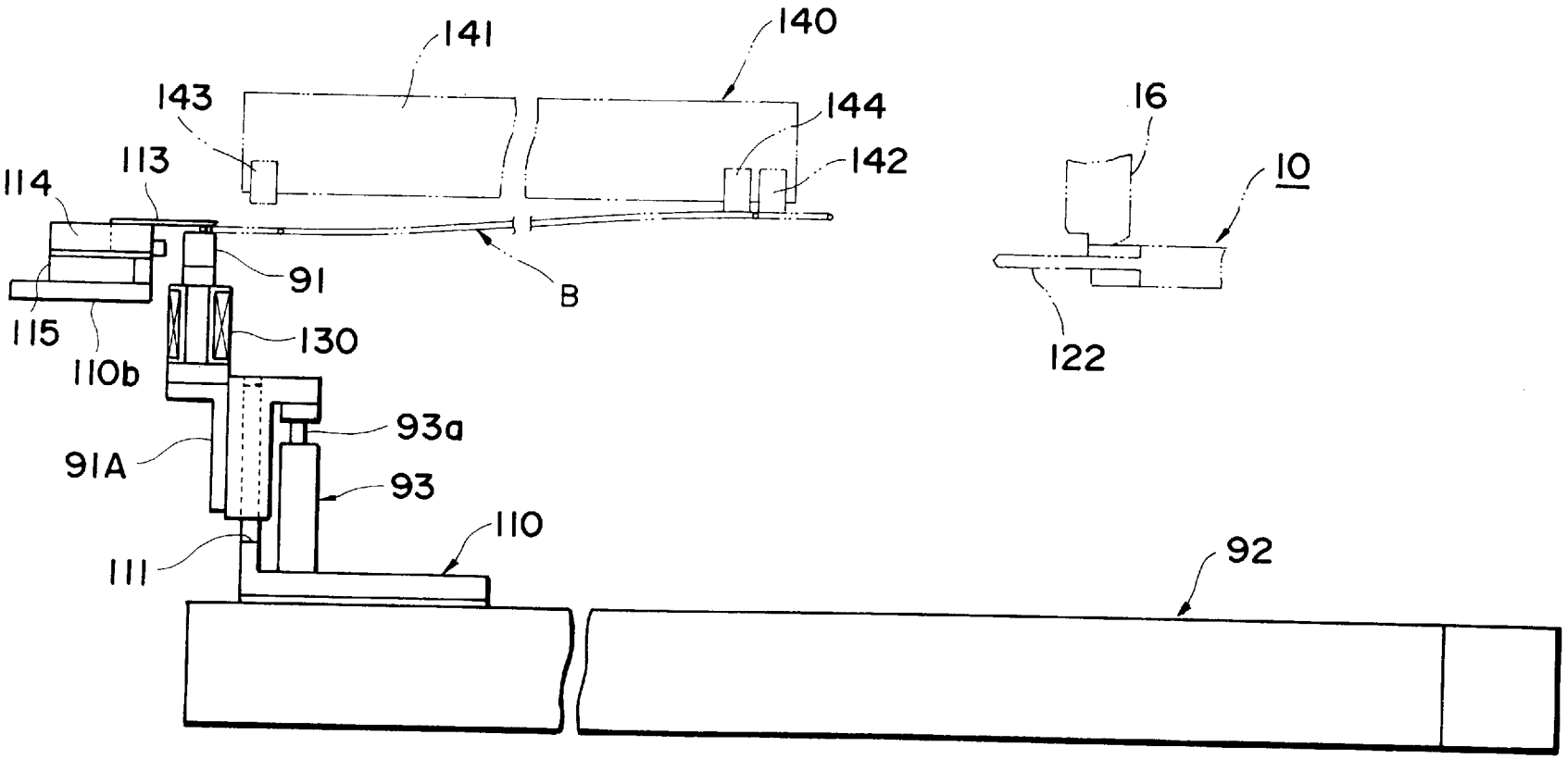
FIG. 21 is a side view to show a completely drawn state of the wire heald out of the stocker.
Figure 22:
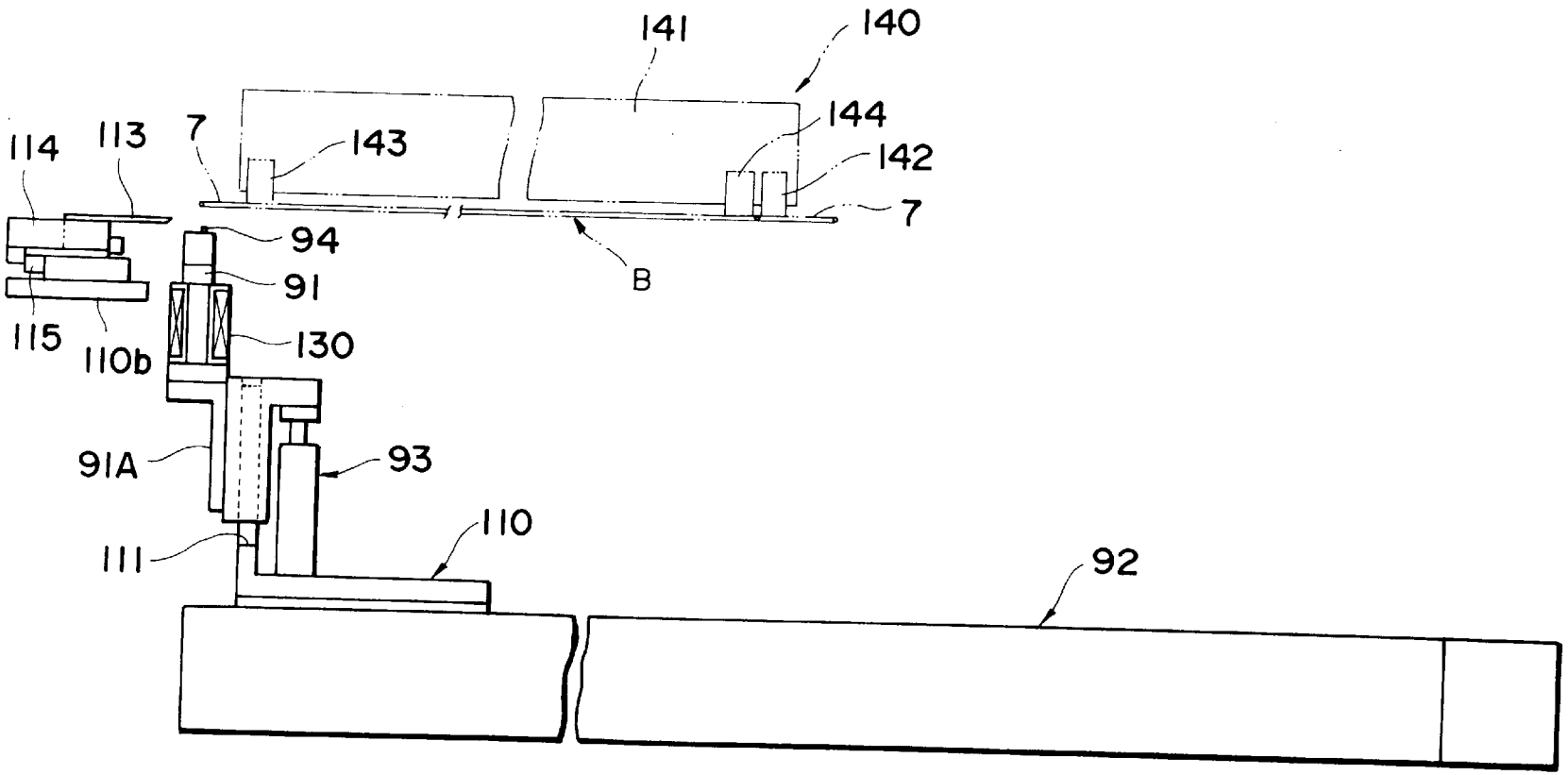
FIG. 22 is a side view to show a state in which the wire heald drawn out is transferred to the standing block.
Figure 23:
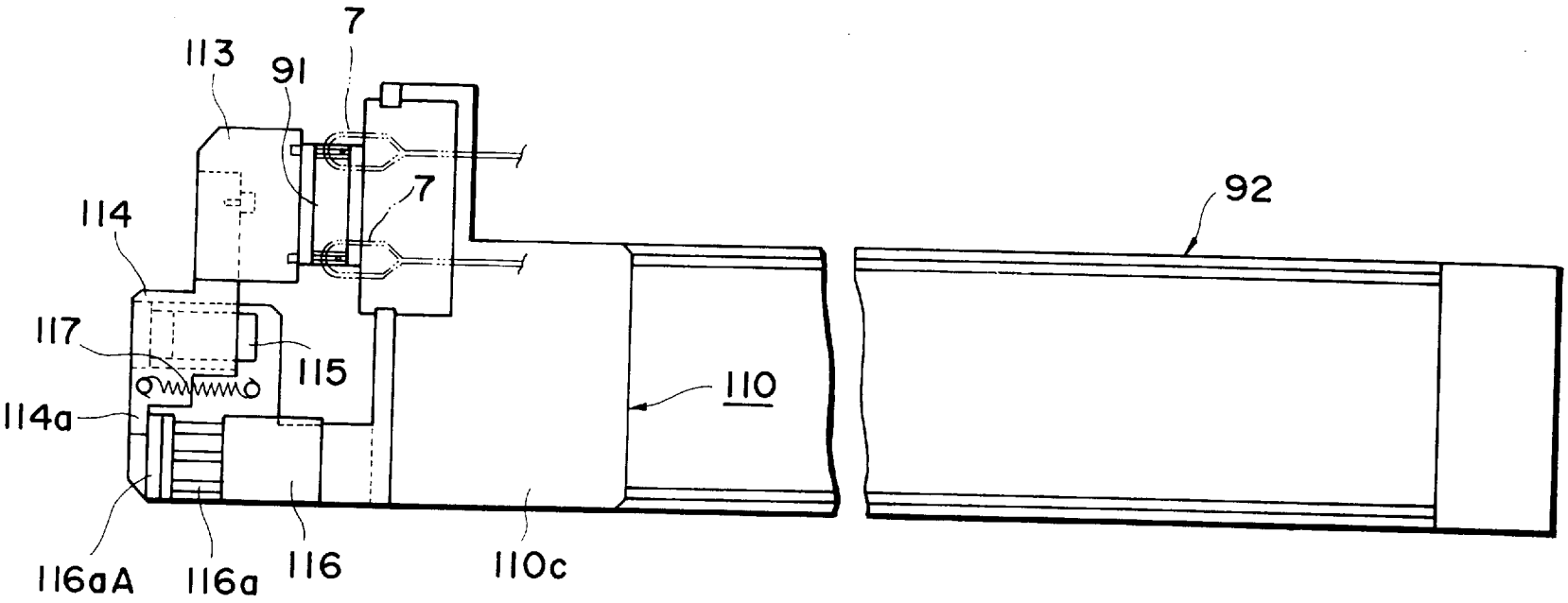
FIG. 23 is a plan view of FIG. 22.

After that, the driving mechanism 92*c* shown in FIG. 1 is actuated to advance the moving base 110 as shown in FIG. 20 while the lowermost ring portion 7 is held as hooked on the magnetic head 91 by cooperation of the drawing pin 94 with the drop preventing portion 113 and by the magnetic sticking force of the magnetic head 91. After the lowermost wire heald B is drawn out completely from the stocker 10 as shown in FIG. 21, the piston rod 116*a* is projected to advance the moving base portion 114 in the drawing direction against the spring force of the tension spring 117, as shown in FIG. 22 and FIG. 23, thereby releasing the engagement between the drop preventing portion 113 and the drawing pin 94. At this time the electric current to the coil 130 disposed around the magnetic head 91 is switched to the damped alternating current for degassing, whereby the ring portion 7 of wire heald B can be released from the magnetic head 91 as erasing remanent magnetization of the wire heald B magnetized by the magnetic head 91 when magnetically attached thereto.

Figure 24:
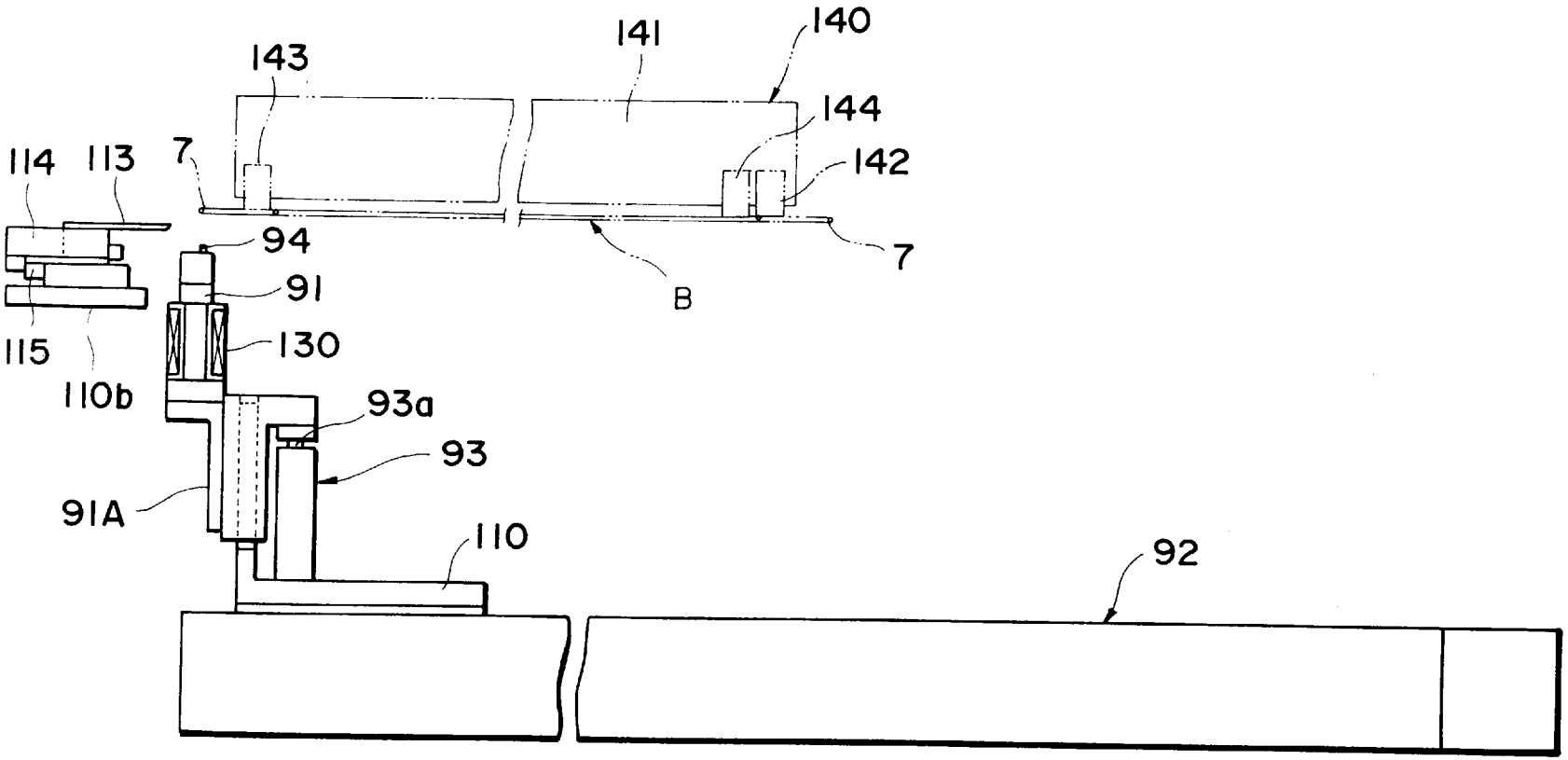
FIG. 24 is a side view to show a state in which the magnetic head is moved down for taking the magnetic head back.
Figure 25:
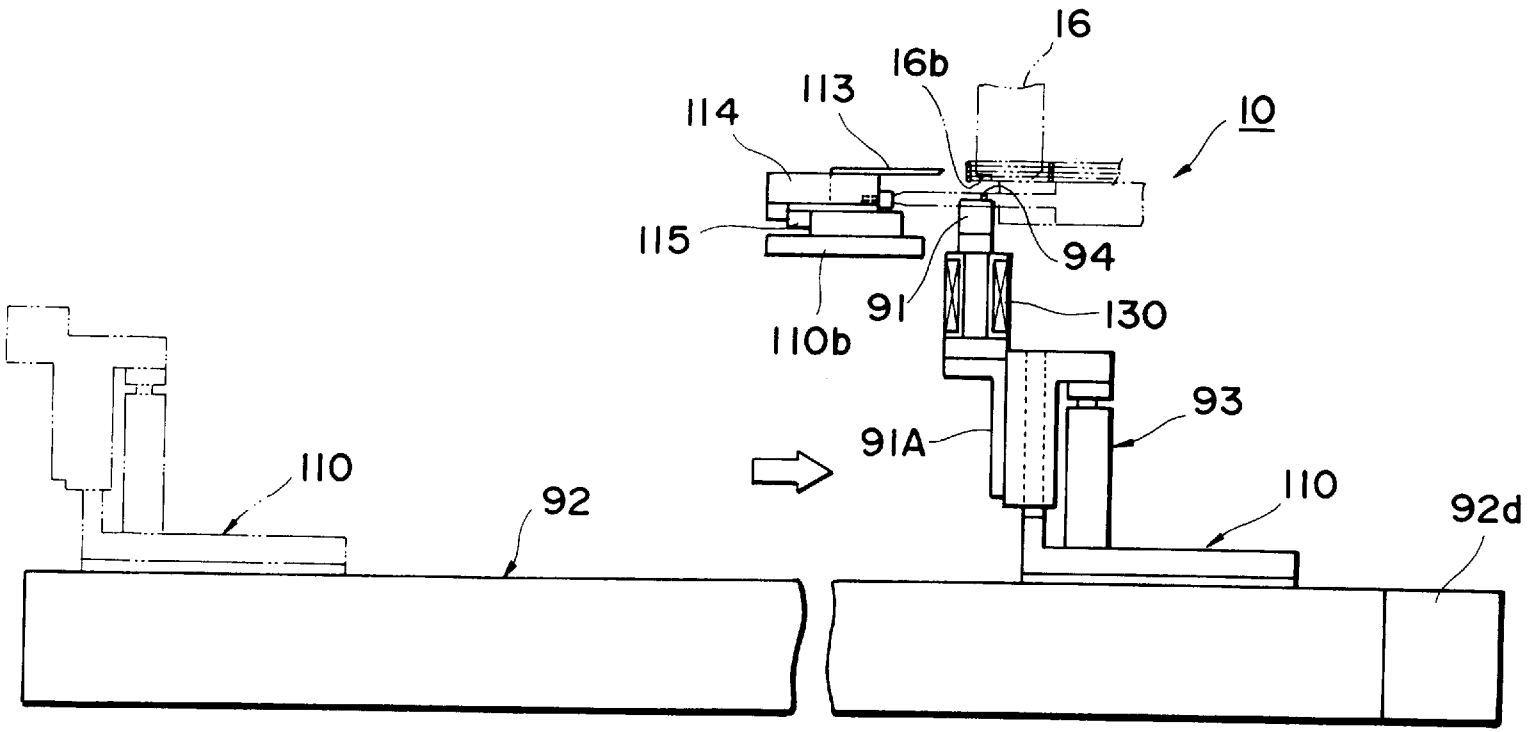
FIG. 25 is a side view to show a state in which the magnetic head is taken back to the stocker.

After that, as shown in FIG. 24, the lowermost wire heald B is transferred to a standing block 141 of a heald transferring mechanism 140 described hereinafter. Then the piston mechanism 93 is actuated to move the piston rod 93*a* down and to retract the moving base 110 along the guide rails 92*a* as shown in FIG. 25, thereby returning the drawing pin 94 of the magnetic head 91 to immediately below the notch portion 16*b* of the floating rod 16.

Figure 26:
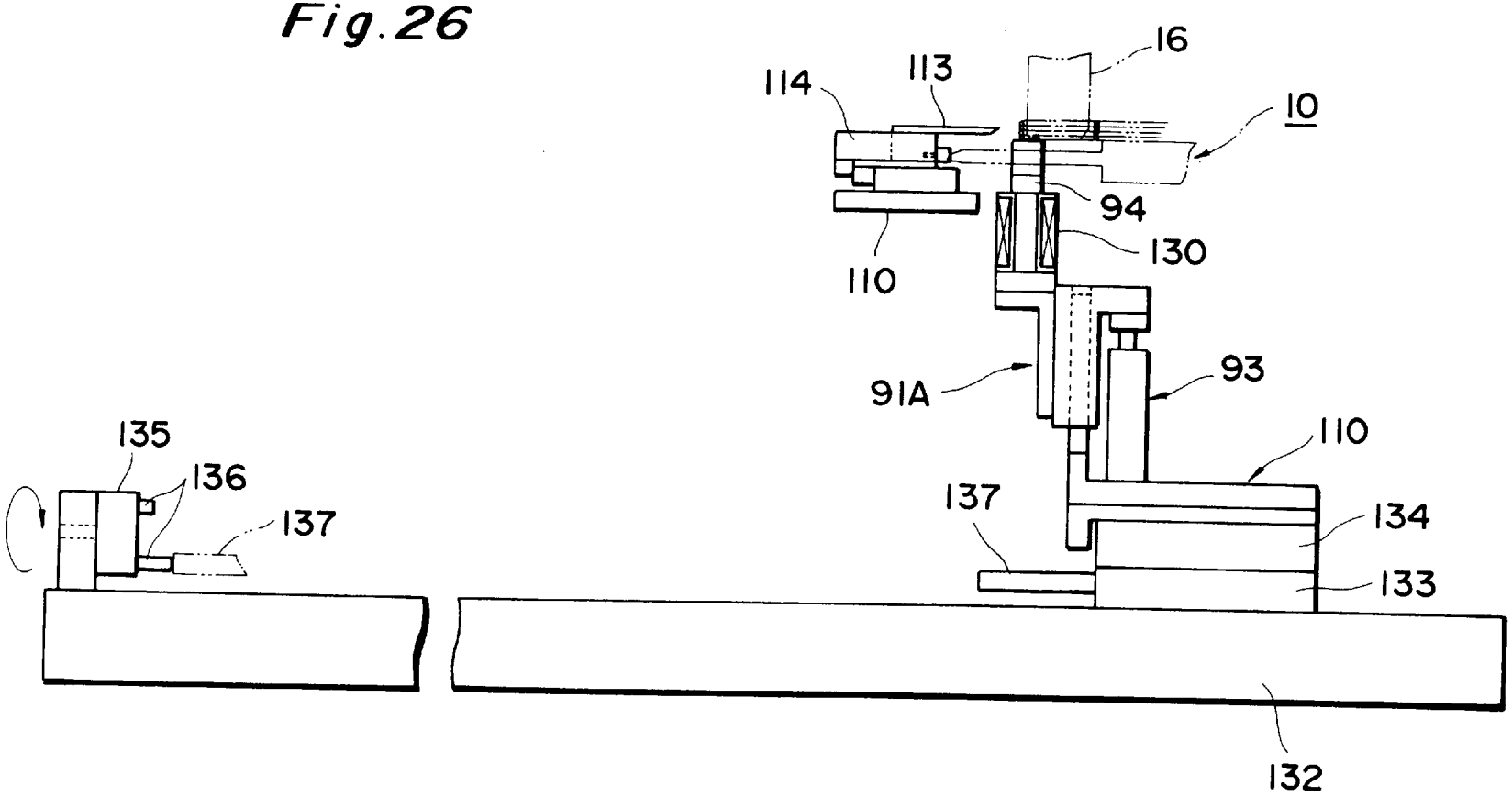
FIG. 26 is a side view to show another embodiment of the drawing apparatus of wire heald.
Figure 27:
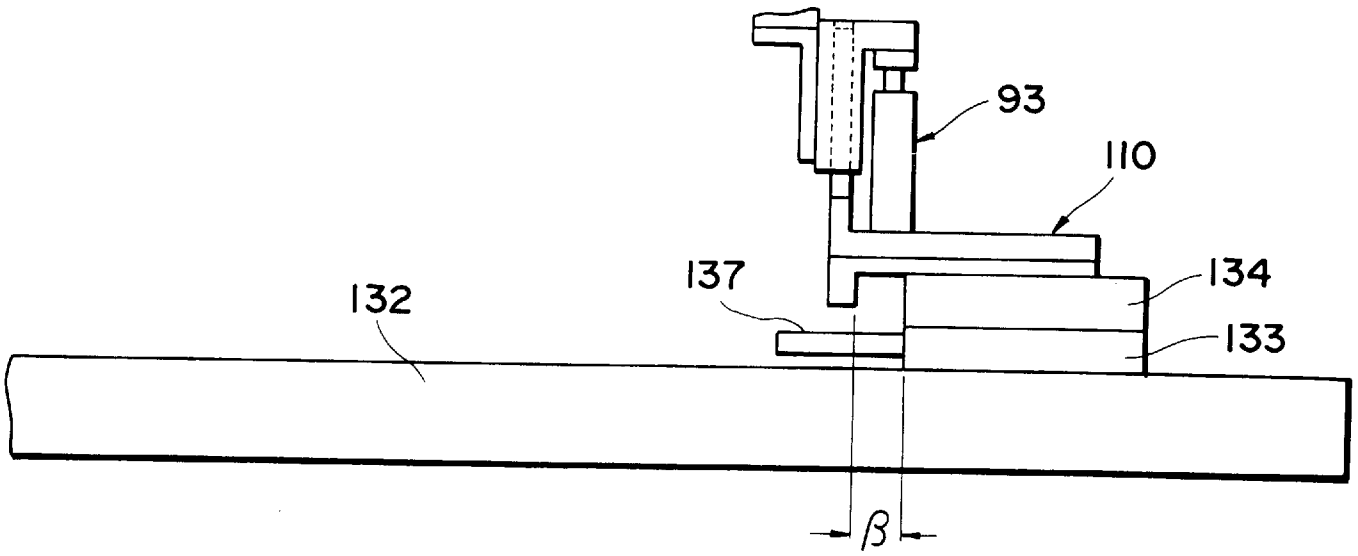
FIG. 27 is a side view to show a state in which the moving base shown in FIG. 26 is drawn slightly by the air cylinder.

FIG. 26 shows another drawing apparatus 131 of wire heald B according to another embodiment, and this drawing apparatus 131 has a translating unit 132 comprised of a rodless air cylinder. A sliding table 133 is disposed on this translating unit 132 and an air cylinder 134 is fixed on this sliding table 133. The moving base 110 is retracted by β by this air cylinder 134 (see FIG. 27). Further, the sliding table 133 is provided with a stopper rod 137 and a stopper portion 135 for forcibly stopping the moving base 110 is disposed at the front end of the translating unit 132. The stopper rod 137 is located opposite to the stopper portion 135.

Stop pins 136 different in length are attached to the stopper portion 135. When a stop pin 136 is made to butt against the stopper rod 137, the sliding table 133 is stopped at an arbitrarily determined position. Since the stop portion 135 is constructed in a revolver configuration capable of rotating and stopping at an arbitrary position, an arbitrary stop pin 136 can be selected out of the various stop pins 136 to butt against the stopper rod 137 by properly rotating the stop portion 135 with necessity. This selection of arbitrary one of stopper pins 136 of different lengths permits arbitrary selection of a moving distance of the sliding table 133 by the translating unit 132, thus making the apparatus ready for a variety of wire healdes B different in total length. It is needless to mention that the number of selection of moving distances of the sliding table 133 can be changed depending upon the number of stop pins 136.

Here, as shown in FIG. 21, the heald transferring mechanism 140 is disposed ahead of the stocker 10, and this heald transferring mechanism 140 has the standing block 141 arranged to rotate 90 about the support shaft (not shown) located nearly at the center. First and second magnetic heads 142, 143 for fixation of heald constituting respective electromagnets are provided at the both ends of the standing block 141. These magnetic heads 142, 143 are exposed to the conveyance path of wire heald B and are spaced from each other by a distance corresponding to the total length of wire heald B. A degaussing head 144 is disposed between the first magnetic head 142 and the second magnetic head 143, and this degaussing head 144 is provided adjacent to the first magnetic head 142 on the entrance side of heald.

When the lowermost wire heald B is drawn out of the stocker 10 using the drawing pin 94, the wire heald B is magnetically attached to the first magnetic head 142 of the standing block 141 as shown in FIG. 21, thereby achieving stable drawing of wire heald B. At this time remanent magnetization occurs in the wire heald B by the magnetic force of the first magnetic head 142. Thus, the degaussing alternating current is supplied to the coil (not shown) disposed around the degaussing head 144, whereby the wire heald B can be drawn out as erasing the remanent magnetization caused in the wire heald B by the first magnetic head 142. When the wire heald B is drawn out completely and when the both ring portions 7 of the wire heald B are located below the first and second magnetic heads 142, 143, drawing of wire heald B is stopped.

After that, as shown in FIG. 22, the engagement between the drop preventing portion 113 and the drawing pin 94 is released and the current to the coil 130 is switched to the damped alternating current for degaussing to degauss the ring portion 7 magnetized by the magnetic head 91, thereby releasing the ring portion 7 from the magnetic head 91. Then, in the standing block 141, the coil (not shown) disposed around the second magnetic head 143 is energized, so that the ring portion 7 of wire heald B is magnetically attached to the second magnetic head 143 as the lowermost wire heald B is transferred to the standing block 141. After that, the wire heald B transferred to the standing block 141 is made upright by rotating the standing block 141 90° and it is conveyed to the warp passing mechanism (not shown) by a predetermined conveying means. At this time, the damped alternating current for degaussing is supplied to each coil of the degaussing head 144, first magnetic head 142, and second magnetic head 143, thereby eliminating the remanent magnetization of wire heald B. Such elimination of remanent magnetization can suppress a phenomenon of mutual gathering of wire healdes B in a weaving process with an automatic weaving machine.

Figure 28:
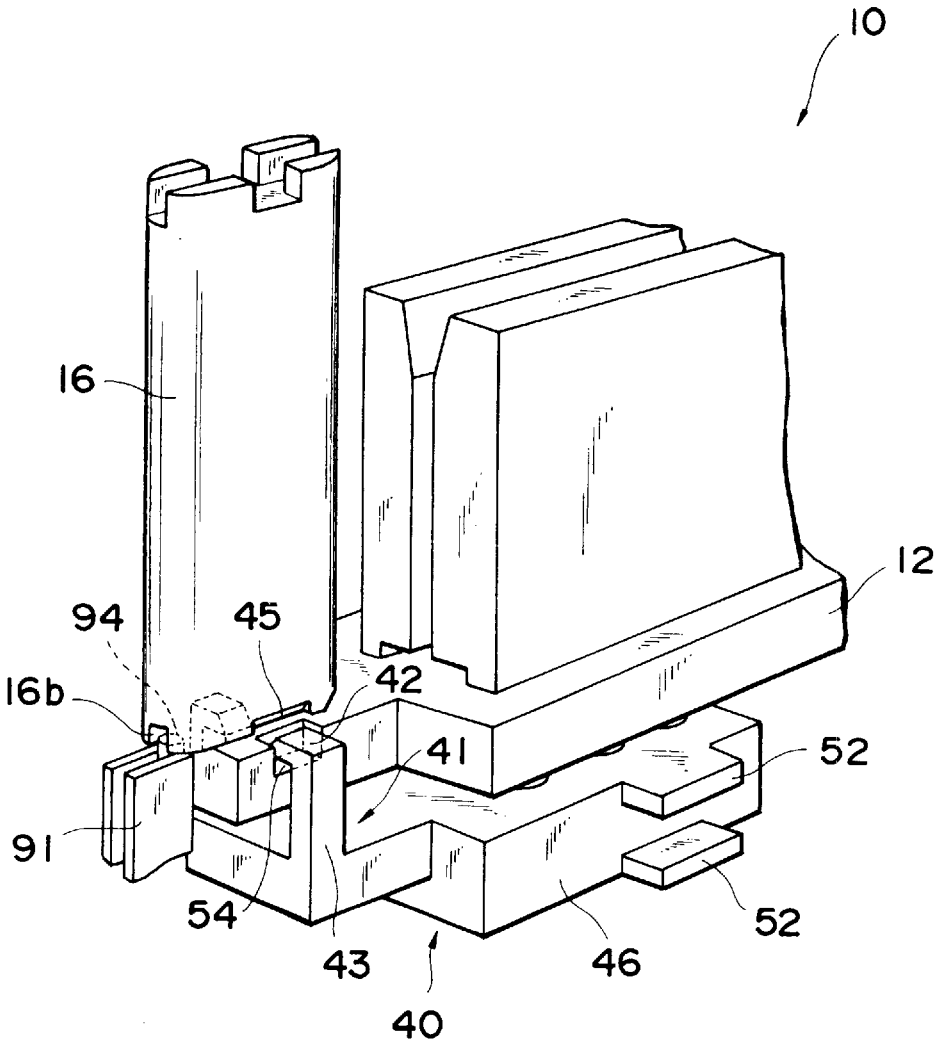
FIG. 28 is a perspective view to show the front wire heald separating mechanism.
Figure 29:
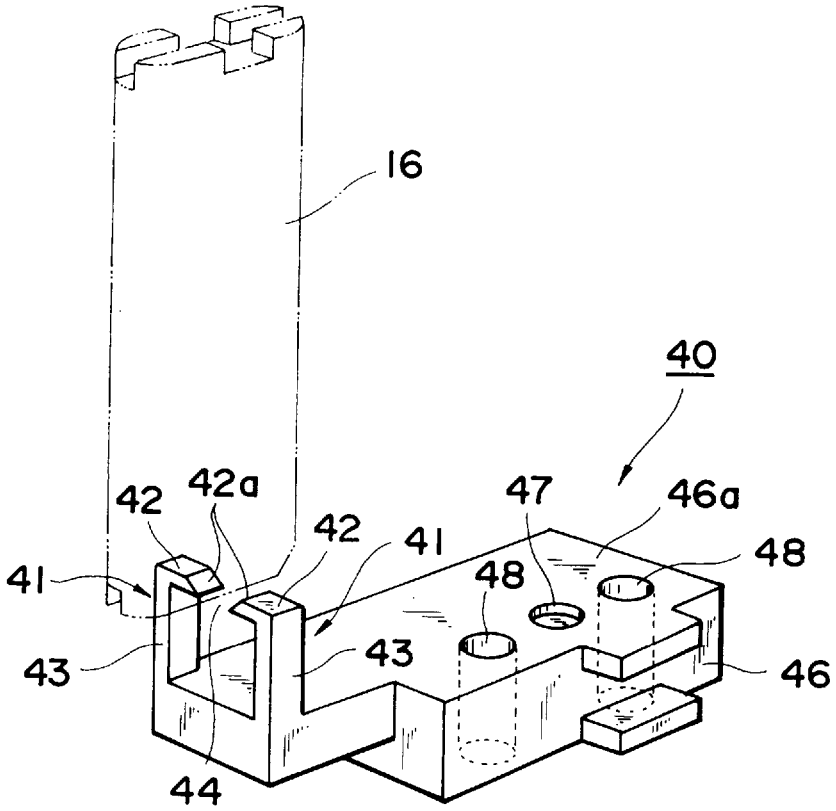
FIG. 29 is a perspective view to show the positional relation between the front wire heald separating mechanism and the floating rod.
Figure 30:
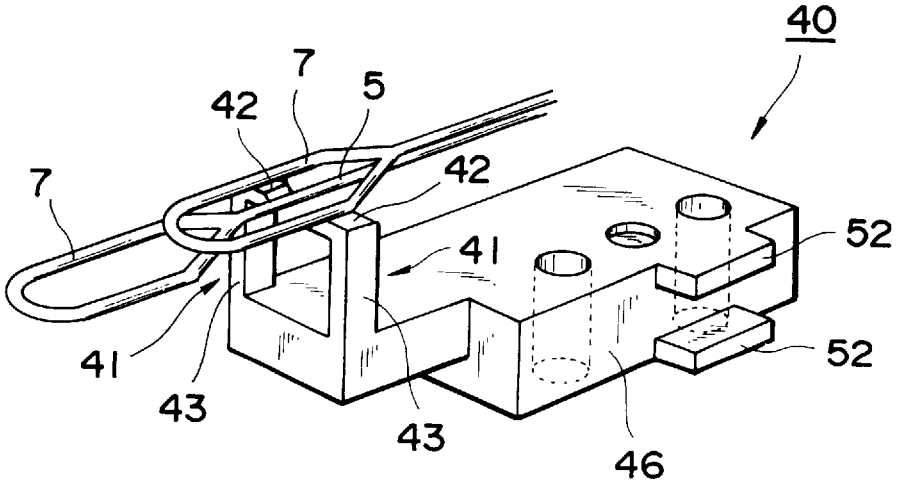
FIG. 30 is a perspective view to show a state in which upon separation of wire heald the lowermost wire heald is drawn out slightly by the drawing pin.

As shown in FIG. 1, FIG. 8, and FIG. 28, the wire heald stocker 10 has a wire heald separating mechanism, 40 for surer drawing of the lowermost wire heald B (at the extremal end), and this wire heald separating mechanism 40 is provided on the front side of stocker 10. In addition, the wire heald separating mechanism 40 has push claws 41 as pushing-back claws located below the front floating rod 16, as shown in FIG. 29 and FIG. 30. The push claws 41 are formed in an L-FHP shape and the left and right push claws 41 make a pair. Each push claw 41 is comprised of a claw portion 42 extending horizontally and arranged to be inserted into the front floating rod 16 to be engaged with the lowermost ring portion 7 held at that position, and a support portion 43 extending downward from the base end of the claw portion 42 for supporting the claw portion 42.

The tip portions (the free end portions) of the left and right claw portions 42, 42 are spaced from each other to form clearance 44 between the claw portion 42, 42, and this clearance 44 is slightly greater than the diameter of rod portion 5 of wire heald B. Formed at the tip portion of the claw portion 42 is a taper surface 42*a* inclined obliquely downward toward the tip. As the push claws 41 rise, the tip portions of the claw portions 42 are inserted into the claw engaging recesses 45 formed in the lower end face 16*a* in the front floating rod 16. For that purpose, a, taper surface 45*a* matching with the taper surface 42*a* of claw portion 42 is formed in the upper surface of each claw engaging recess 45 (See FIG. 14). As shown in FIG. 28, it is necessary for the claw portions 42 to be buried completely in the base 12 upon descent of the push claws 41, and therefore, claw receiving recesses 54 are formed in the tip-side upper surface of the base 12. However, in the cases wherein the rear floating rod 16 is arranged not to be moved vertically by the push claws 41, the rear floating rod 16 does not always have to be provided with the foregoing claw engaging recesses 45.

Further, as shown in FIG. 28, the wire heald separating mechanism 40 has a base portion 46 for securing each L-shaped push claw 41 in a standing state, and this base portion 46 is located below the base 12. A recess 47 for seating of spring is formed in an upper surface 46*a* of this base portion 46 and pin insertion holes 48 vertically penetrating the base portion 46 are formed in the base portion 46 on either side of the recess 47 (see FIG. 29). The upper surface 46*a* of base portion 46 and the bottom surface 12*b* of base 12 are connected through a compression spring 50 seated in the recess 47 and this compression spring 50 urges the base portion 46 in a leaving direction relative to the base 12.

Two pins 51 project downward from the bottom surface 12*a* of base 12, these pins 51 are inserted into the pin insertion holes 48 of base portion 46, and stopper portions 51*a* of snap rings or the like are provided at the lower ends of pins 51. In this arrangement, the base portion 46 can be moved vertically in the extending direction of pin 51 under elasticity of spring 50. A pair of upper and lower tongues 52 to be engaged with the actuator member 64 described hereinafter project from the base portion 46 (see FIG. 28). This upper tongue 52 is pushed up by the tip of the actuator member 64, and the lower tongue 52 is pushed down by the tip of the actuator member 64 in the cases where the base portion 46 is not moved down smoothly by the compression spring 50.

Here, as shown in FIG. 8, the base portion 46 is moved vertically (in the heald stack direction) by a driving means 60. This driving means 60 comprises an air cylinder 62 fixed to the support stage 61 for supporting the base 12 of housing 11, a cylinder rod 63 arranged to reciprocate vertically in a predetermined stroke relative to the air cylinder 62 and prevented from rotating, and an actuator member 64 fixed to the tip of the cylinder rod 63 and arranged to engage with the tongue 52 of the base portion 46 at the tip thereof. Accordingly, the base portion 46 can be moved vertically by a predetermined amount in accordance with the stroke amount of the cylinder rod 63. When the tip of the actuator member 64 is inserted between the tongues 52, there is a play given to the actuator member 64 between the tongues 52, so that the stroke amount of the cylinder rod 63 is not equal to the ascent amount of the base portion 46. If the push claws 41 are arranged to be directly driven by the air cylinder 62, there is no need for employing the base portion 46 and actuator member 64 and there is no need for giving the play between the tongues 52 and the actuator member 64, either.

WIRE HEALD SEPARATION (by the wire heald separating mechanism 40)

Next described is the wire heald separating method by the wire heald separating mechanism 40 described above.

Figure 31:
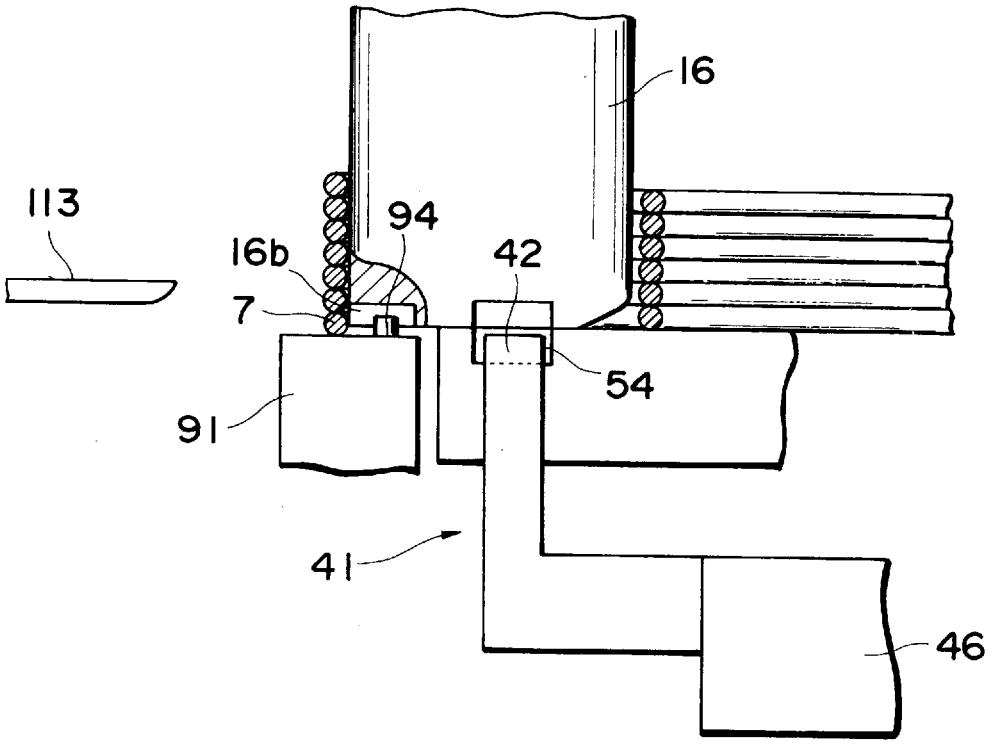
FIG. 31 is a partially enlarged side view to show a state before drawing the lowermost wire heald.
Figure 32A:
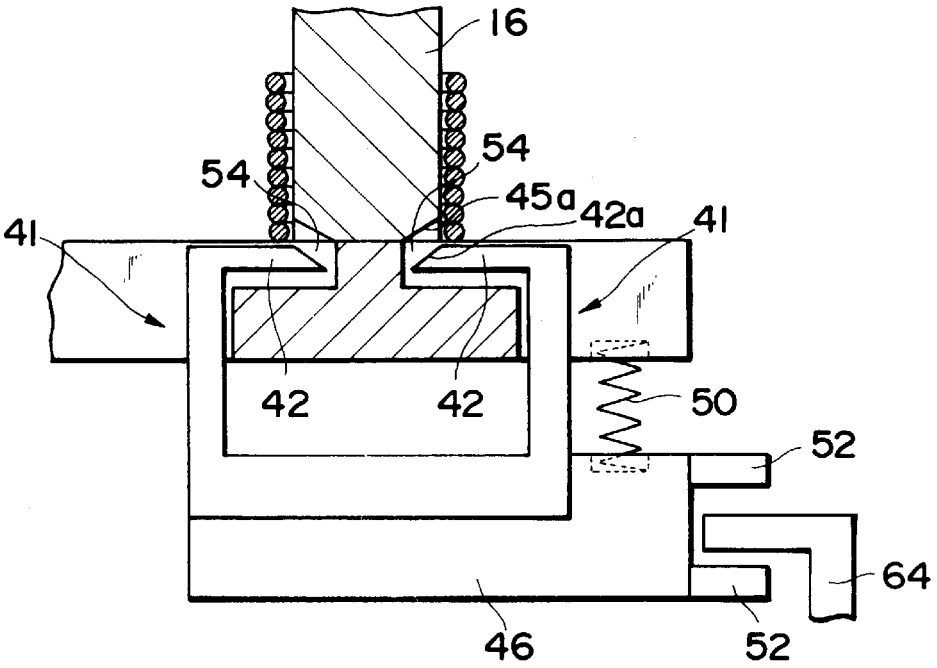
FIG. 32A is a longitudinal cross-sectional view of FIG. 31.

As shown in FIG. 31 and FIG. 32A, for drawing the lowermost wire heald B, the drawing pin 94 is first inserted into the notch portion 16*b* of the front floating rod 16 and at the same time as it, the ring portion 7 of the lowermost wire heald B is magnetically attached to the magnetic head 91. At this time the claw portions 42 of the push claws 41 are completely buried in the claw receiving recesses 54 and thus, they do not impede drawing of the ring portion 7. After that, the lowermost ring portion 7 is drawn out slightly by the drawing pin 94 to shift the lowermost ring portion 7 relative to the second (next) ring portion 7 from the bottom and to expose the next ring portion 7, thereby making the apparatus ready for separation of the lowermost wire heald B (see FIG. 30). At this time the magnetic head 91 is moved horizontally before the drawing pin 94 comes to below the drop preventing portion 113 standing by in front of the heald drawing aperture 9, whereby cooperation of the drop preventing portion 113 with the magnetic head 91 prevents falling of the ring portion 7 of the lowermost wire heald B thereafter.

Figure 33:
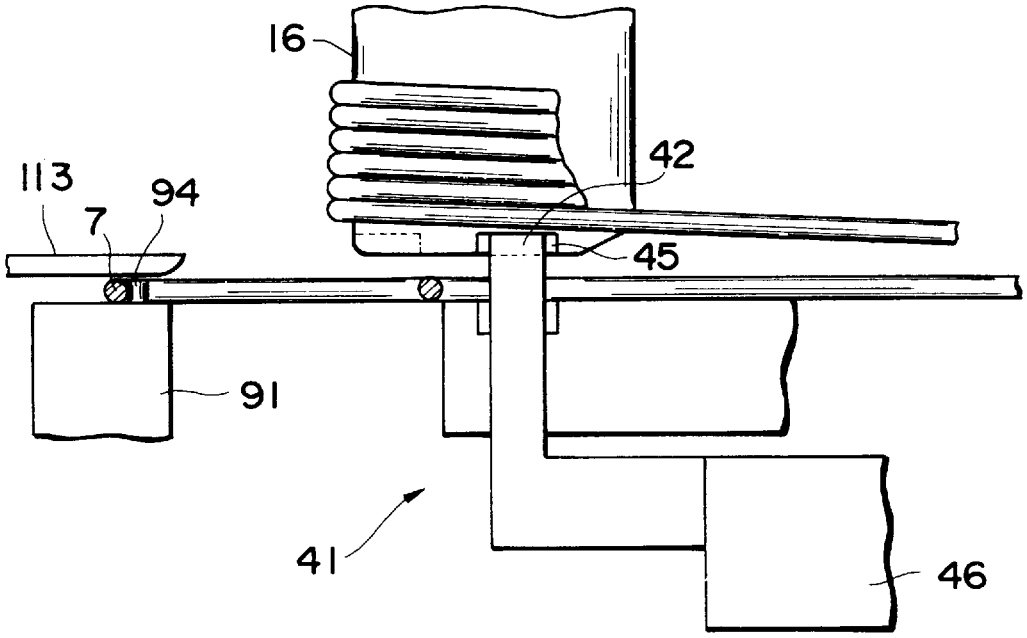
FIG. 33 is a partially enlarged side view to show a slightly drawn state of the lowermost wire heald.
Figure 34A:
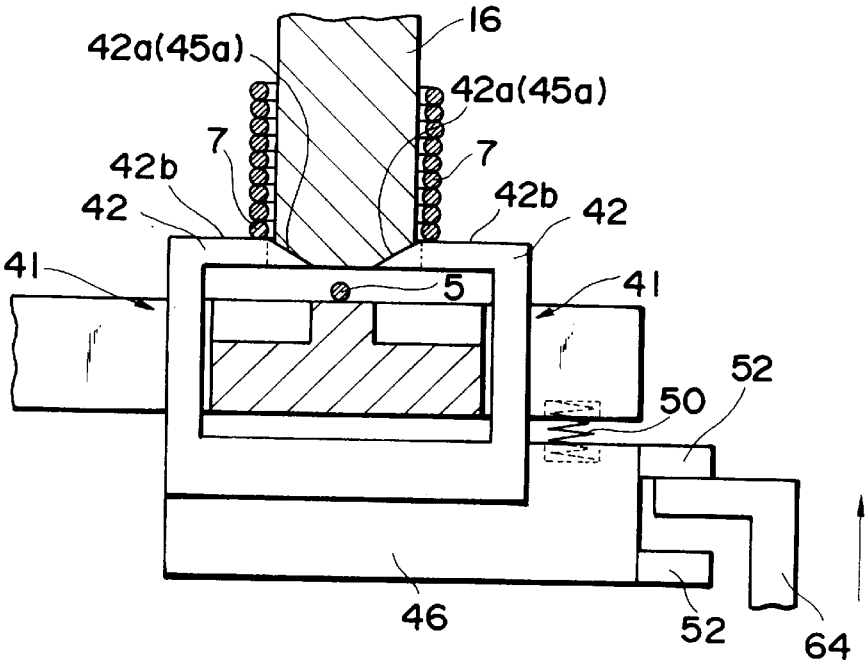
FIG. 34A is a longitudinal cross-sectional view of FIG. 33.

After that, as shown in FIG. 33 and FIG. 34A, the air cylinder 62 is actuated to raise the actuator member 64 so as to push the upper tongue 52 up by the tip of the actuator member 64, thereby raising the base portion 46 by the predetermined amount against the spring force of the compression spring 50. At this time the rod portion 5 of the lowermost wire heald B passes through the clearance 44 between the claw portions 42 with rise of the push claws 41, and therefore, the lowermost wire heald B continuously keeps its position without being affected by the rise of the push claws 41. Then the claw portions 42 are inserted into the claw engaging recesses 45 of the front floating rod 16 to match the taper surfaces 42*a* thereof with the taper surfaces 45*a* and thereafter to push the front floating rod 16 up from the bottom.

Further, utilizing the upper surfaces 42*b* of the claw portions 42, the next ring portion 7 exposed is pushed up from the bottom. As a result, the ring portions 7 in a stack state put around the floating rod 16 and kept at that position and the front floating rod 16 can be lifted simultaneously, whereby only the lowermost wire heald B can be separated from the other wire healdes B at the place of the front floating rod 16. Then cooperation of the drop preventing portion 113 with the magnetic head 91 achieves smooth drawing of the lowermost wire heald B as surely hooking the lowermost ring portion 7 on the drawing pin 94. After the lowermost wire heald B is drawn out completely, the air cylinder 62 is actuated to lower the actuator member 64, whereby the base portion 46 returns to the position of FIG. 32A by the spring force of the compression spring 50, thus preparing for the next drawing operation.

Figure 35A:
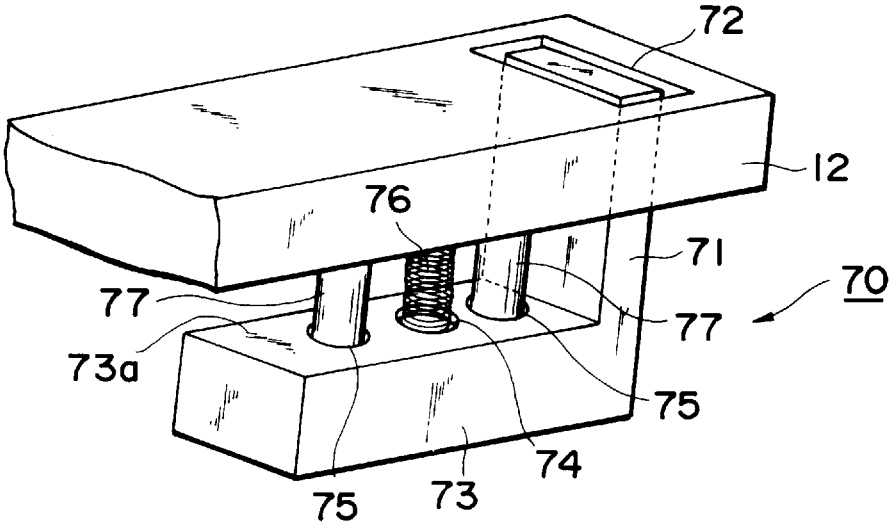
FIG. 35A is a perspective view to show the rear wire heald separating mechanism.
Figure 36:
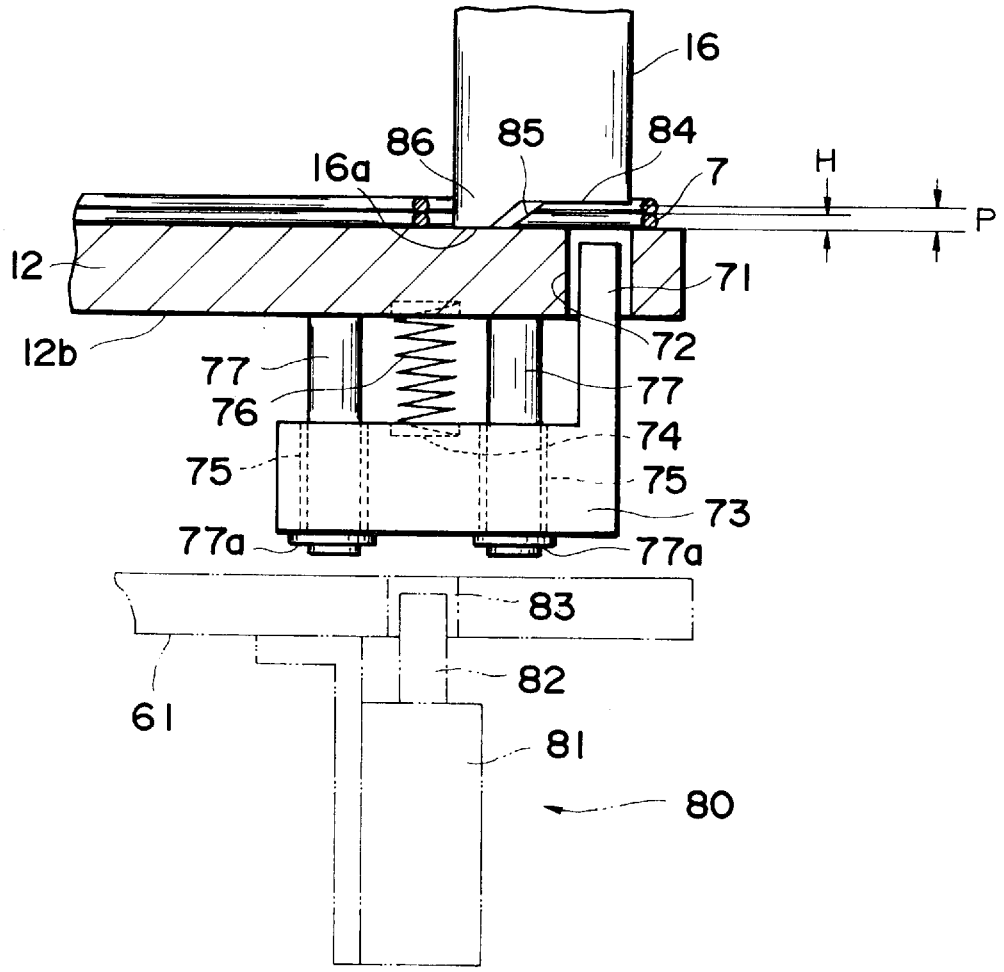
FIG. 36 is a side view of the rear wire heald separating mechanism shown in FIG. 35A.

Next, as shown in FIG. 35A and FIG. 36, the wire heald stocker 10 comprises a wire heald separating mechanism 70 for surer drawing of the lowermost wire heald B (at the extremal end). This wire heald separating mechanism 70 is provided on the rear side of the stocker 10 and has a push member 71 as a block-shaped pushing-back member extending vertically as positioned below the rear floating rod 16. This push member 71 is inserted in a rectangular aperture 72 formed in the base 12 and below the lower floating rod 16 and stands on a base portion 73 located below the base 12. The block push member 71 may be formed in a claw shape or in a hollow shape for reduction of weight.

A recess 74 for seating of spring is formed in an upper surface 73*a* of this base portion 73, and pin insertion holes 75 vertically penetrating the base portion 73 are formed on either side of the recess 74 in the base portion 73. The upper surface 73*a* of base portion 73 and the bottom surface 12*b* of base 12 are connected through a compression spring 76 seated in the recess 74, and this compression spring 76 urges the base portion 73 in a leaving direction from the base 12. Thus, two pins 77 project downward from the bottom surface 12*a* of base 12, the pins 77 are inserted into the pin insertion holes 75 of the base portion 73, and stopper portions 77*a* of snap rings or the like are provided at the lower ends of the pins 77, whereby the base portion 73 can be moved vertically in the extending direction of pins 77. The pins 77 are inserted in the pin insertion holes 75 without a play.

Here, the base portion 73 is moved vertically (in the heald stack direction) by a driving means 80 located immediately below it, and the driving means 80 is located immediately below the base portion 73. This driving means 80 comprises an air cylinder 81 fixed through a bracket or the like to a part of the support stage 61 for supporting the base 12 of the housing 11, and a cylinder rod 82 arranged to reciprocate vertically in a predetermined stroke relative to the air cylinder 81. The tip of the cylinder rod 82 is inserted into an aperture 83 formed in the support stage 61 below the base portion 73 from the bottom, thus facing the bottom surface of the base portion 73. Then the cylinder rod 82 is projected from the aperture 83 to push the base portion 73 up by the tip of the cylinder rod 82, thereby raising the base portion 73 and push member 71. Then the cylinder rod 82 is lowered to make the cylinder rod 82 buried in the aperture 83, thereby lowering the base portion 73 and push member 71 by the urging force of the spring 76. In such an arrangement that the air cylinder 81 is fixed to the base 12 and that the air cylinder 81 directly drives the push member 71, there is no need for employing the base portion 73, the spring 76, etc.

Figure 37A:
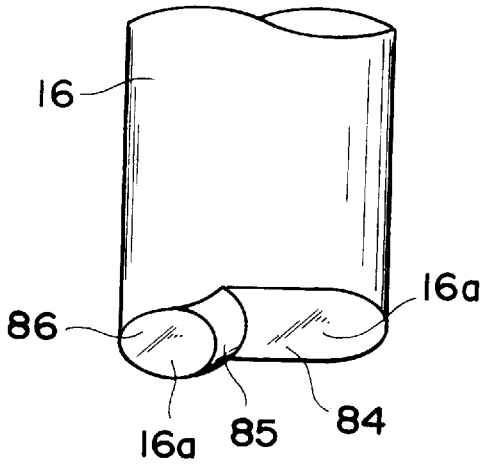
FIG. 37A is a perspective view to show the lower end portion of the rear floating rod.

As shown in FIG. 36 and FIG. 37A, a ring pulling portion 84 horizontally cut is formed in the rear part. in the lower end face 16a of the rear floating rod 16, and this ring pulling portion 84 has the cut depth P a little larger than the height H of one ring portion 7. Further, a projection 86 projecting in the axial direction is formed in the front part in the lower end face 16*a* of the rear floating rod 16, and the lower end face 16*a* on the side of this projection 86 is connected through a taper surface 85 with the lower end face 16*a* on the side of ring pulling portion 84. For surely inserting only the lowermost ring portion 7 into the ring pulling portion 84, the cut depth P is set to be smaller than the height 1.5 H of one and a half ring portion 7 or smaller than the height 2.0 H of two ring portions 7.

WIRE HEALD SEPARATION (by the wire heald separating mechanism 70)

Next described is a wire heald separating method by the wire heald separating mechanism 70 described above.

Figure 38:
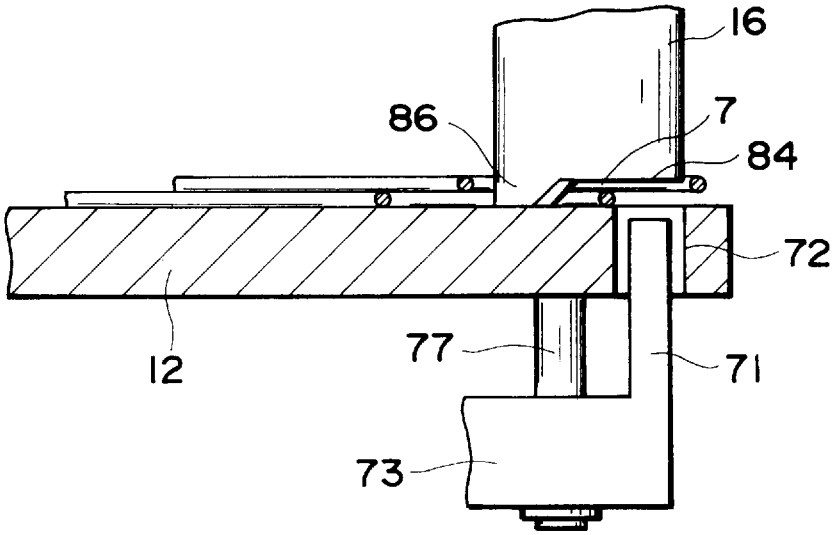
FIG. 38 is a partially enlarged side view to show a slightly drawn state of the lowermost wire heald.
Figure 39:
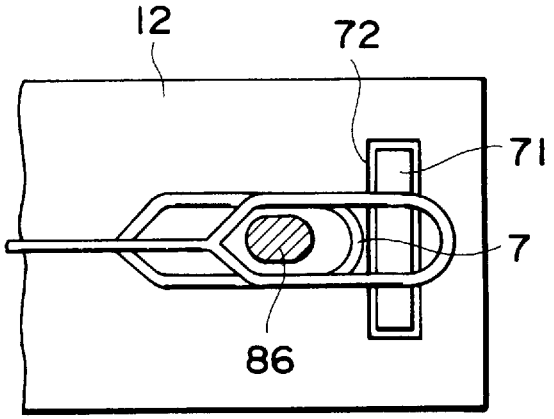
FIG. 39 is a plan view corresponding to the figure of FIG. 38.

As shown in FIG. 31 and FIG. 32A, for drawing the lowermost wire heald B, the drawing pin 94 is first inserted into the notch portion 16b of the front floating rod 16 and at the same time as it, the front ring portion 7 of the lowermost wire heald B is magnetically attached to the magnetic head 91. At this time the claw portions 42 of the push claws 41 are buried completely in the claw receiving recesses 54, and thus, they do not impede drawing of the front ring portion 7. After that, the front ring portion 7 is drawn out slightly by the drawing pin 94 to shift the lowermost ring portion 7 relative to the second (next) ring portion 7 from the bottom and to expose the next rear ring portion 7, thus making the apparatus ready for separation of the lowermost wire heald B. At this time, as shown in FIG. 38 and FIG. 39, the rear end of the rear ring portion 7 of the lowermost heald is guided into the ring pulling portion 84 of the rear floating rod 16 as passing above the aperture 72 of the base 12. Thus, the ring portion 7 does not hit the floating rod 16, thus preventing the floating rod 16 from being raised thereby. The projection 86 of the rear floating rod 16 is still located in the lowermost ring portion 7.

Figure 40:
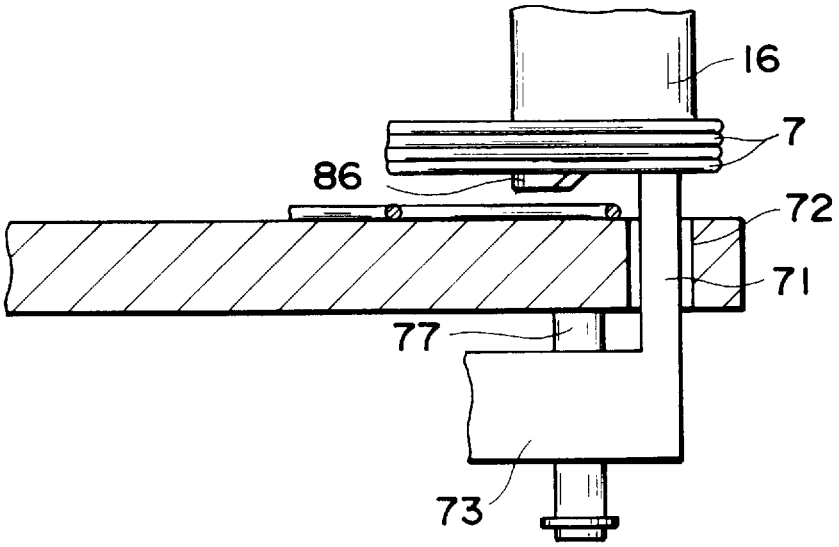
FIG. 40 is a side view to show a state in which the rear floating rod is lifted by the wire heald separating mechanism.

After that, as shown in FIG. 40, the air cylinder 81 is actuated to push the base portion 73 up by the tip of the cylinder rod 82 so as to raise the base portion 73, and, following it, the push member 71 also rises to the rear ring portion 7. As a result, as the top surface as a tip portion of the push member 71 simultaneously pushes the next ring portion 7 set around the rear floating rod 16 and kept at that position and the lower end face 16a on the side of ring pulling portion 84 up, the projection 86 inserted in the lower ring portion 7 is lifted. Accordingly, the projection 86 is separated from the base 12, thereby completely releasing engagement between the rear ring portion 7 of the lowermost heald and the rear floating rod 16. After that, the drawing pin 94 is advanced further, whereby the lowermost wire heald B is drawn out smoothly without collision between the rear floating rod 16 and the lowermost ring portion 7. After completion of such drawing of wire heald B, the cylinder rod 82 is lowered to make the tip of the cylinder rod 82 buried in the aperture 83, thereby dropping the base portion 73 and push member 71 by the urging force of the spring 76.

Since the rear floating rod 16 is thus prevented from colliding with the lowermost ring portion 7 upon drawing of the lowermost wire heald B, this arrangement can avoid abrasion due to rubbing between the lower end face 16*a* of the floating rod 16 and the wire heald B. Since collision can be avoided between the floating rod 16 and the wire heald B upon drawing of wire heald B executed at very quick speed, no excessive load is forced on the wire heald B and the wire heald B is prevented from deforming, thereby lengthening the lifetime of the wire heald B itself.

The drawing apparatus and drawing method of wire heald according to the present invention are not limited to only the embodiments as described above.

Figure 41A:
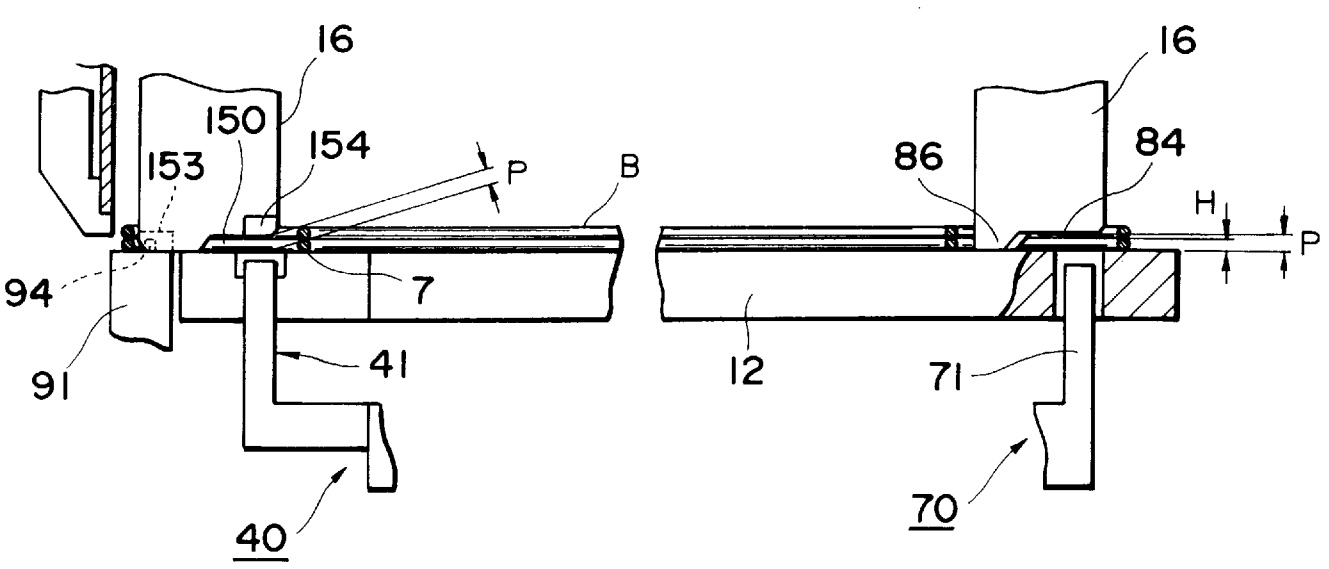
FIG. 41A is a side view to show the embodiment of the front floating rod in the drawing operation.
Figure 42A:
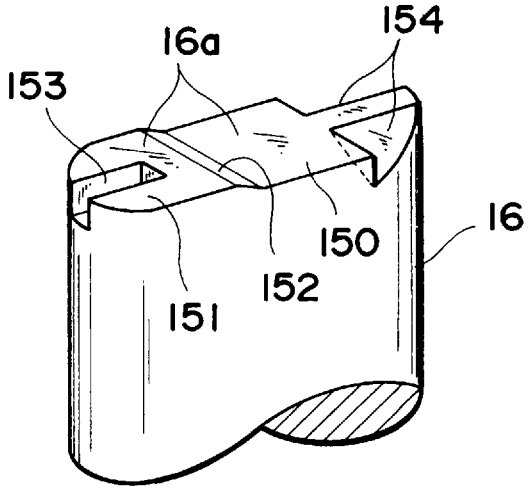
FIG. 42A is a perspective view to show the lower end face of the front floating rod.

In a modification, as shown in FIG. 41A and FIG. 42A, a ring pulling portion 150 horizontally cut is formed in the rear part in the lower end face 16*a* of the front floating rod 16, and this ring pulling portion 150 has the cut depth P a little larger than the height H of one ring portion 7. For surely pulling only the lowermost ring portion 7 into the ring pulling portion 150, this cut depth P is set to be smaller than the height 1.5 H of one and a half ring portion 7. Further, a projection 151 projecting in the axial direction is formed in the front part in the lower end face 16*a* of the front floating rod 16, and the lower end face 16*a* on the side of this projection 151 is connected through a taper surface 152 with the lower end face 16*a* on the side of ring pulling portion 150.

Further, the projection 151 is provided with a notch portion 153 for the drawing pin 94 to be inserted therein, and the front end of this notch portion 153 is open for discharge of the drawing pin 94. In the ring pulling portion 150, claw engaging recesses 154 for the claw portions 42 of the push claws 41 as shown in FIG. 29 to be inserted therein are formed at the rear end of the lower end face 16*a* of the floating rod 16.

Figure 43A:
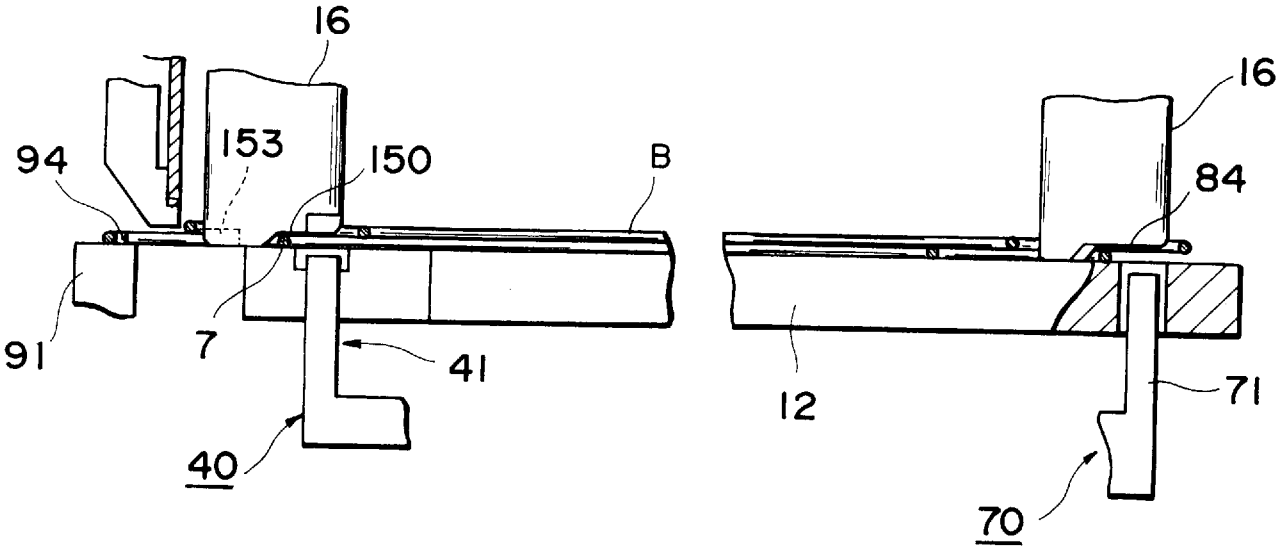
FIG. 43A is a side view to show a slightly drawn state of the lowermost wire heald in the embodiment.
Figure 44:
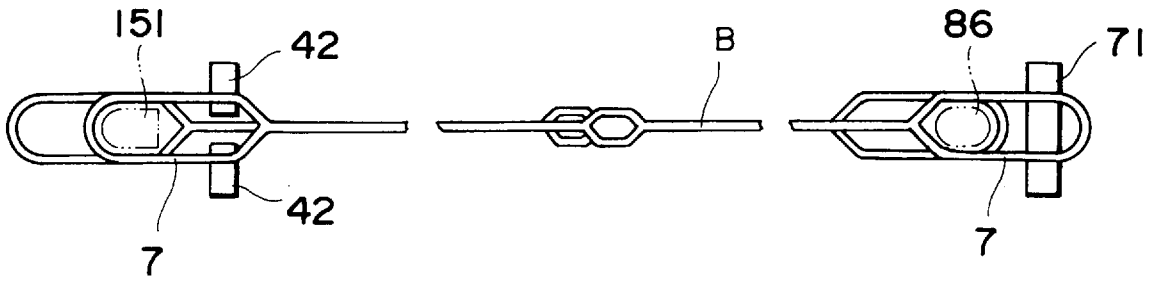
FIG. 44 is a plan view of FIG. 43A.
Figure 45A:
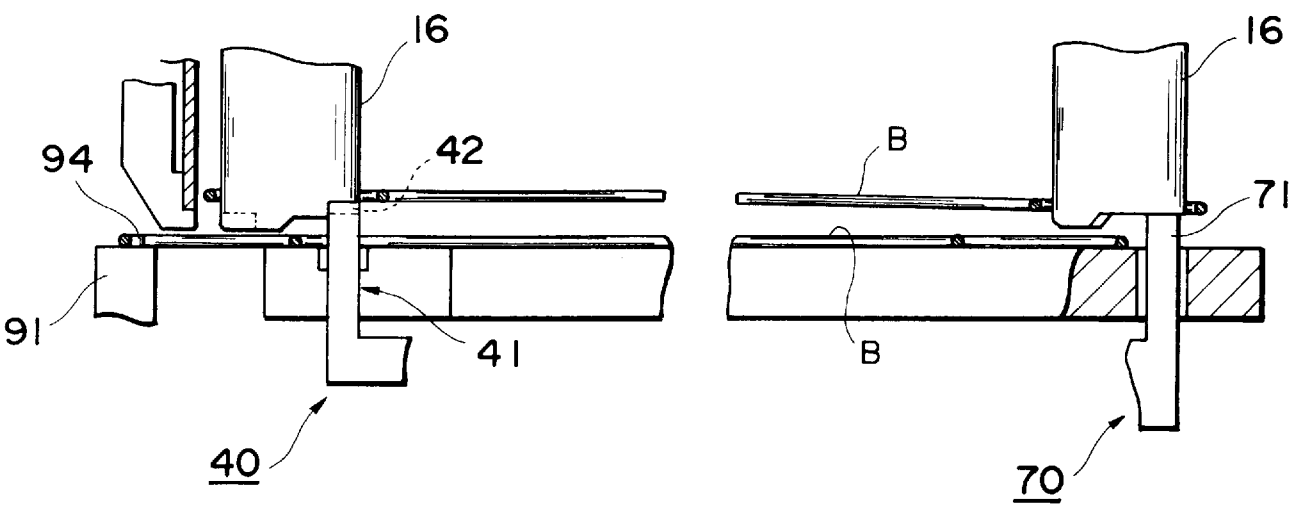
FIG. 45A is a side view to show a state in which after lifting the front and rear floating rods, the lowermost wire heald is drawn out.

Then, as shown in FIG. 43A and FIG. 44, after the drawing pin 94 is inserted into the notch portion 153, the drawing pin 94 is advanced slightly to pull the front ring portion 7 into the ring pulling portion 150. At this time, the lowermost ring portion 7 does not collide with the front floating rod 16 and the floating rod 16 is kept from being raised, which can reduce abrasion of the lower end face 16*a* of the floating rod by the wire heald B or abrasion of the wire heald B itself. The projection 151 of the front floating rod 16 is still located in the lowermost ring portion 7. After that, as shown in FIG. 45A, the front floating rod 16 is lifted by the push claws 41 of the wire heald separating mechanism 40, and the rear floating rod 16 is lifted by the push member 71 of the wire heald separating mechanism 70, whereby only the lowermost wire heald B can be separated from the other wire healdes B.

Figure 46:
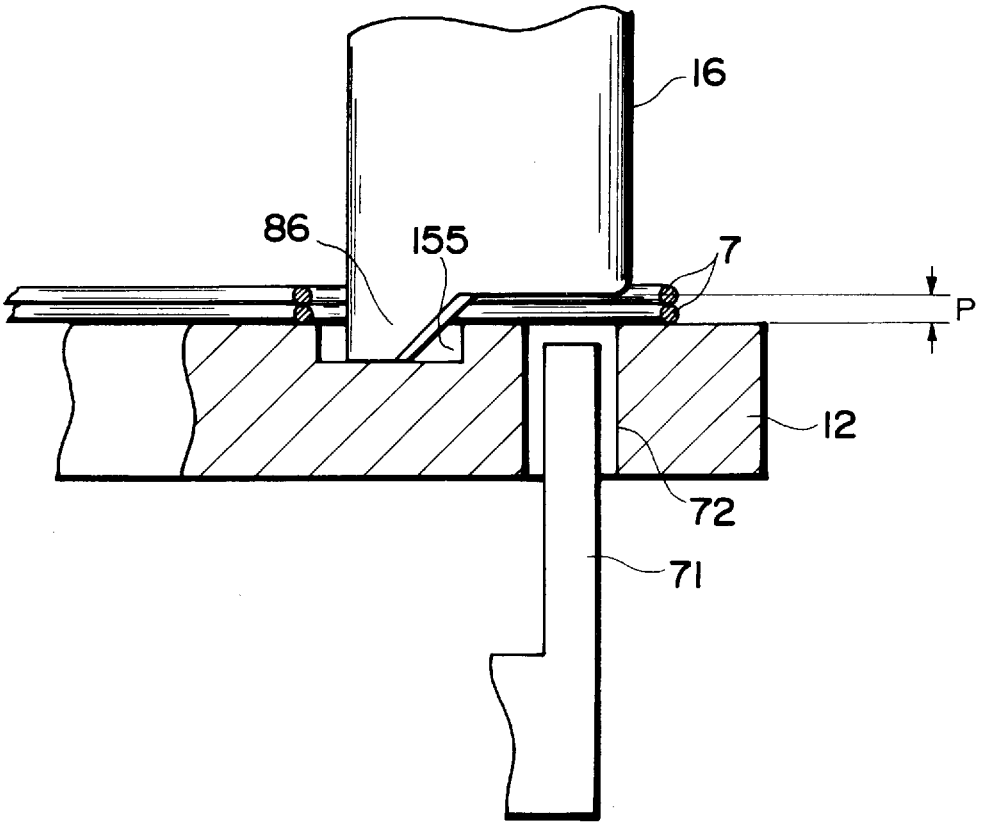
FIG. 46 is a cross-sectional view to show another embodiment of the rear floating rod.
Figure 47:
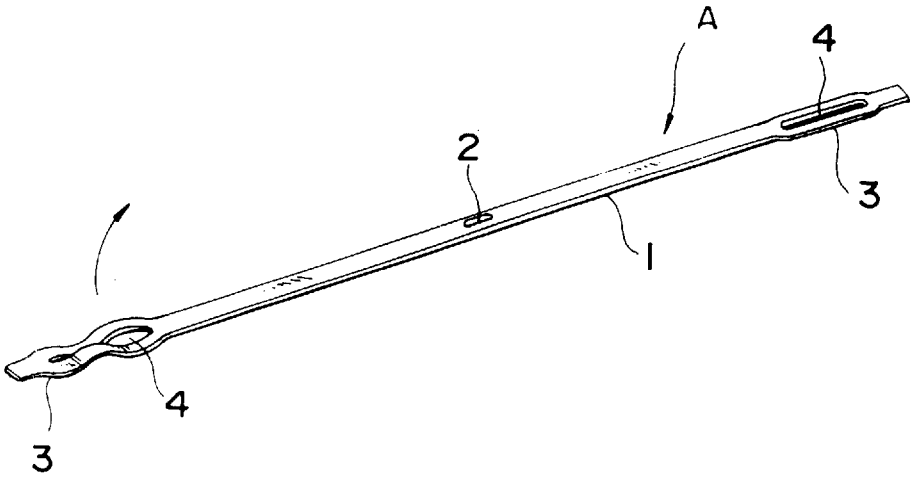
FIG. 47 is a perspective view to show an example of the flat heald.
Figure 48:
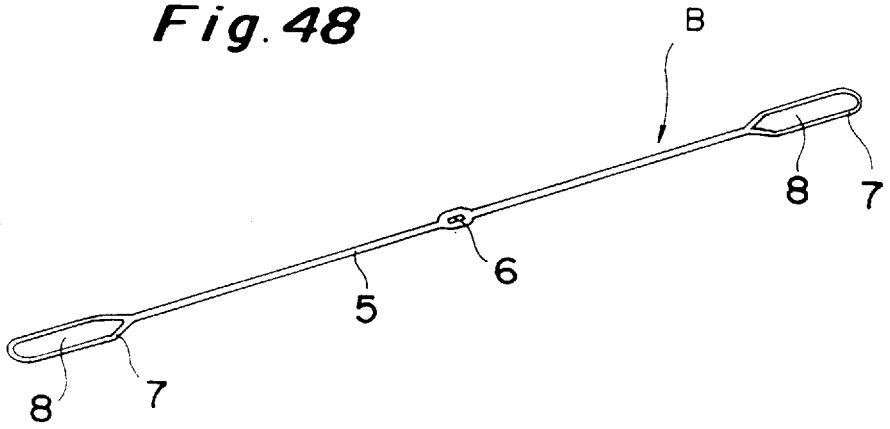
FIG. 48 is a perspective view to show an example of the wire heald.

In still another embodiment of the present invention, as shown in FIG. 46, the base 12 may be provided with a projection receiving recess 155 for receiving the projection 86 of the rear floating rod 16. By setting the projection 86 in the projection receiving recess 155 as described, the rear floating rod 16 can be stabilized on the base 12.

It is needless to mention that in the various embodiments as described above the ring pulling portions may be arbitrarily selected from the tapered ring pulling portions formed in the lower end face 16*a* of the floating rod 16 and the ring pulling portions horizontally cut therein, in the combination of the front floating rod 16 and the rear floating rod 16.

Figure 49:
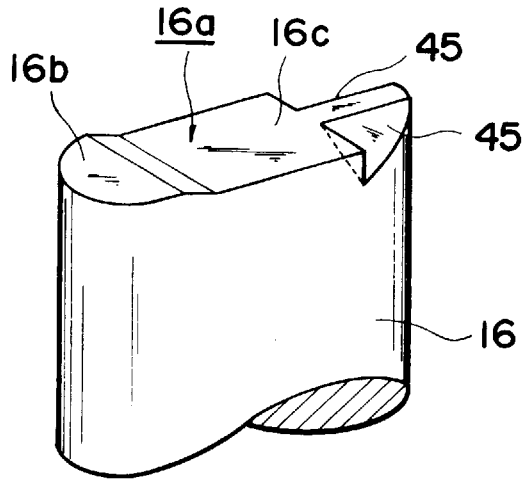
FIG. 49 is a perspective view to show the lower end face of the front floating rod.
Figure 50:
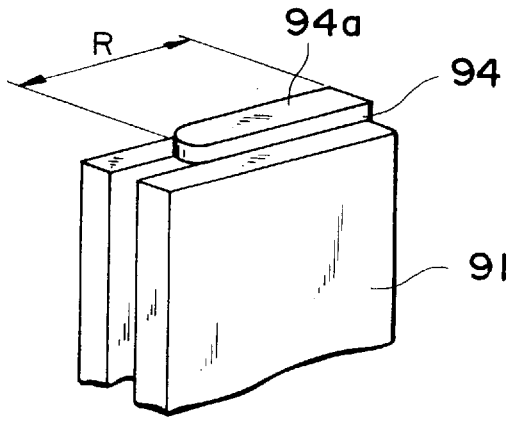
FIG. 50 is a perspective view to show the top face of the drawing pin.

In the following modification, any element denoted by the same reference numbers or characters as those of the above embodiments has the same or similer function or structures of any one of the above embodiments. Therefore, we will not explain them. In the above embodiments, the wire heald is drawn by the drawing pin without lifting the floating rod by the drawing pin. By using floating rods having bottom shapes as shown in FIGS. 49 and the drawing pin as shown in FIG. 50 and slightly lifting the floating rods by means of the drawing pin, the wire heald is may be drawn also. This modification will be explained below. The modification is only different from the above embodiments in the drawing mechanism and the shapes of the bottom of the floating rods and the drawing pins. That is, the shape of the bottom of the floating rods are shown in FIGS. 49 and the drawing pins is shown in FIG. 50. Further, the drawing mechanism lifts the floating rods by upward movement of the drawing rod. The drawing pin is inserted into the front side ring portion of the lowermost wire heald and thereafter the wire heald is drawn out by the engagement of the drawing pin and the drawing pin and the horizontal movement of the magnetic head.

Figure 3B:
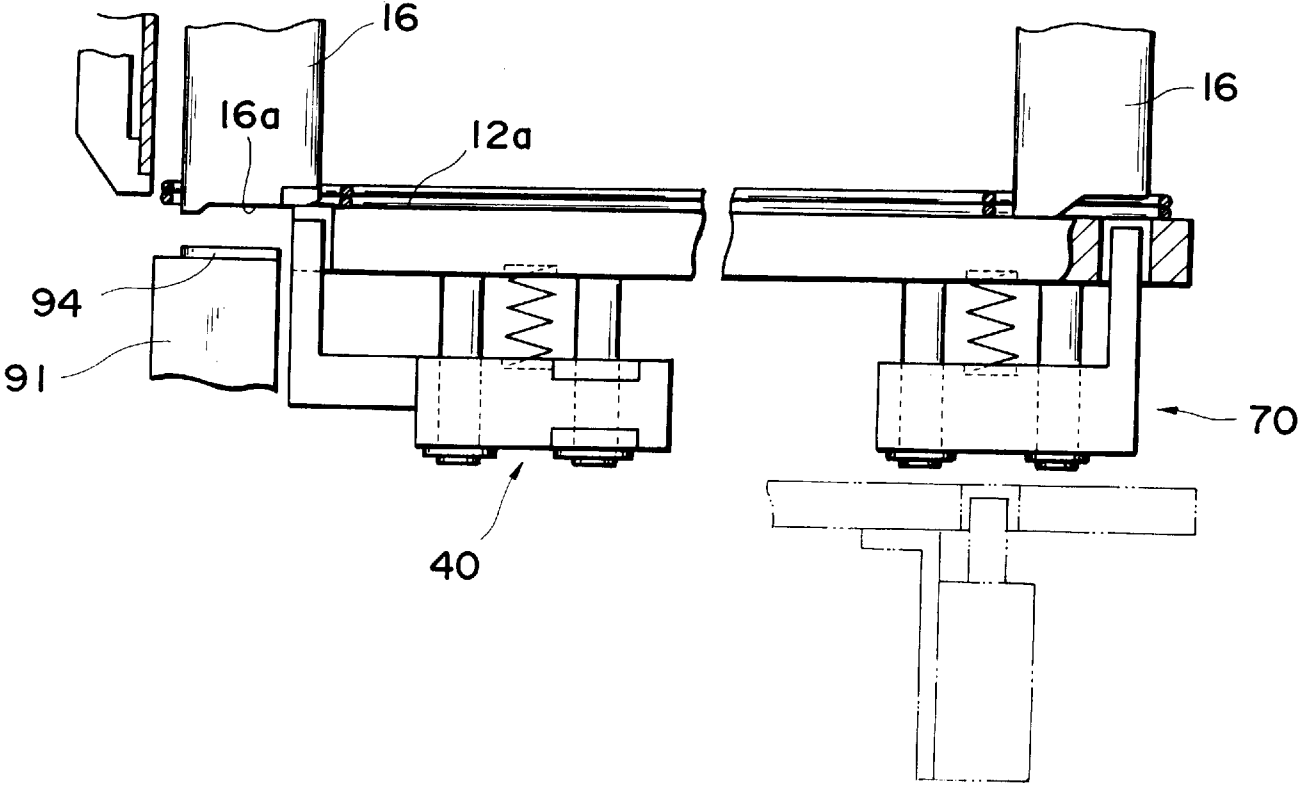
Figure 13B:
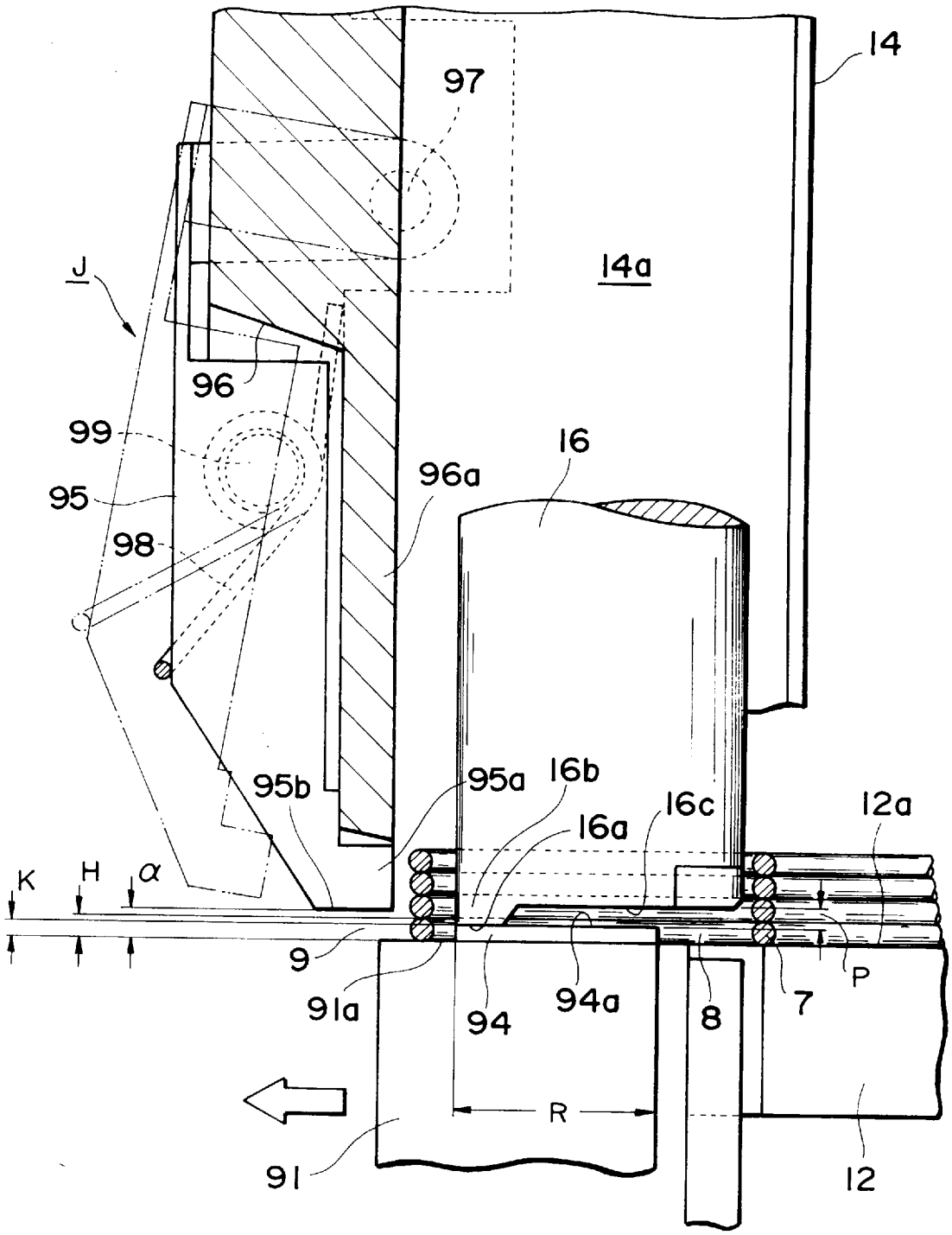
FIG. 13B is a cross-sectional view to show the another multiple draw preventing portion.
Figure 13C:
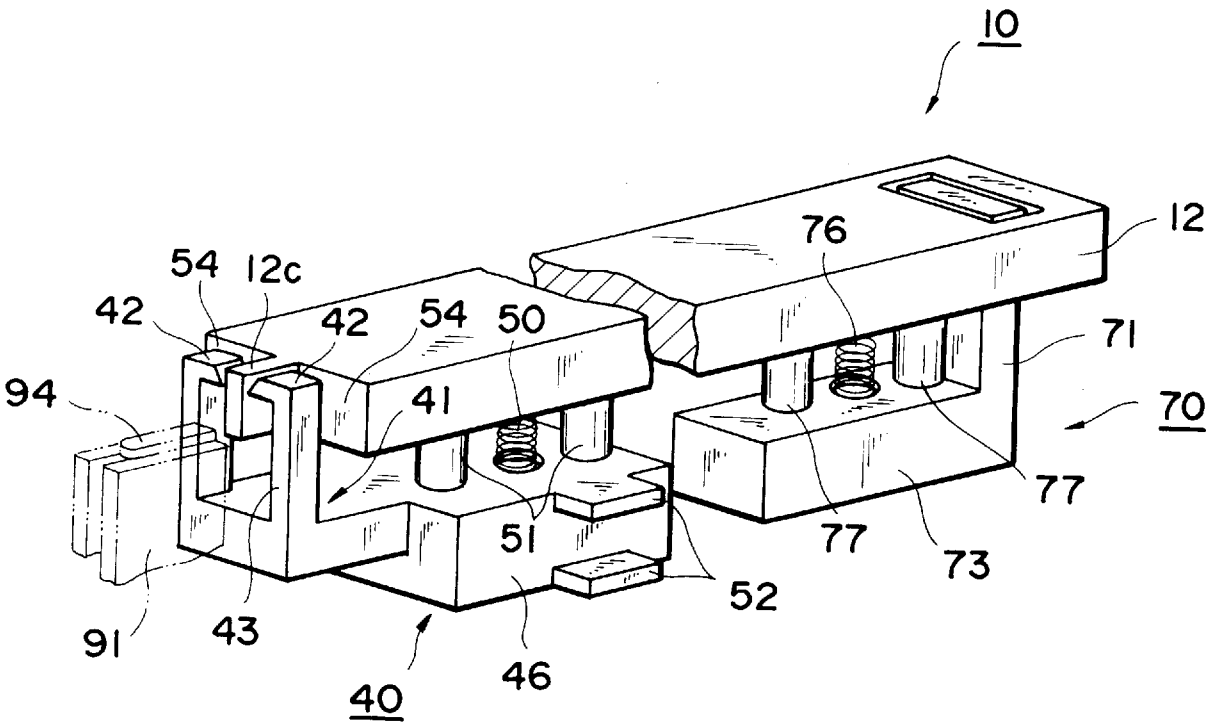
FIG. 13C is a side view to show a state in which the magnetic head stands by below the front floating rod.

As shown in FIGS. 3B, 13B and 13C, for drawing the lowermost wire heald B, the magnetic head 91 is opposed to the guide hole 8 formed in the lowermost front ring portion 7 and is located in the front of the base 12 and below the front floating rod 16. Further, the drawing pin 94 made of the non-magnetic material is fixed to the tip ( the apical end) of the magnetic head 91, and this drawing pin 94 pushes up the front floating rod 16 with a top face 94*a* thereof and this drawing pin 94 has the height K a little lower than the height H of the ring portion 7. Therefore, the wire heald B can be drawn out as the drawing pin 94 catches only the lowermost ring portion 7.

As shown in FIG. 49, a projecting portion 16*b* projecting along the axial direction to contact the top surface 94*a* of the drawing pin 94 is formed in the front part in the lower end face 16*a* of the front floating rod 16. Further, a ring pulling portion 16*c* for pulling the ring, horizontally cut is formed in the rear part in the lower end face 16*a* of the front floating rod 16, for leading the front ring portion 7 of the lowermost wire heald B thereinto. This ring pulling portion 16*c* has the cut depth P a little larger than the height H of one ring portion 7 (see FIG. 13B). Since the cut depth P is smaller than the height 1.5 H of one and a half ring portion 7, only the lowermost front ring portion 7 can be guided surely into the ring pulling portion 16*c*.

As shown in FIG. 50, the top surface 94*a* of the drawing pin 94 of the non-magnetic material is elongated in the drawing direction and, as shown in FIG. 13B, this top surface 94*a* is located immediately below the lower end face 16*a* of the projecting portion 16*b* in the front floating rod 16. Accordingly, when the magnetic head 91 is moved vertically up, the front floating rod 16 can be pushed up as shown in FIG. 13B while the lower end face 16*a* of the projecting portion 16*b* is in contact with the top surface 94*a* of the drawing pin 94.

The drawing pin 94 has at least the length R necessary to expose the next ring portion 7 as shifting the lowermost ring portion 7 relative to the second (next) ring portion 7 from the bottom. Namely, when a wire heald separating mechanism 40 described hereinafter is applied, it is necessary for the drawing pin 94 to draw only the lowermost ring portion 7 slightly as maintaining lift of the projecting portion 16*b* in the front floating rod 16 so as to put the lowermost ring portion 7 into the ring pulling portion 16*c* for pulling the ring, of the front floating rod 16. Thus, the top surface 94*a* of the drawing pin 94 has the length R necessary for such movement. However, the drawing pin 94 must be formed shorter than the ring portion 7, because it is inserted in the lowermost ring portion 7.

Next, the drawing operation in this modification will be expained below.

Figure 51:
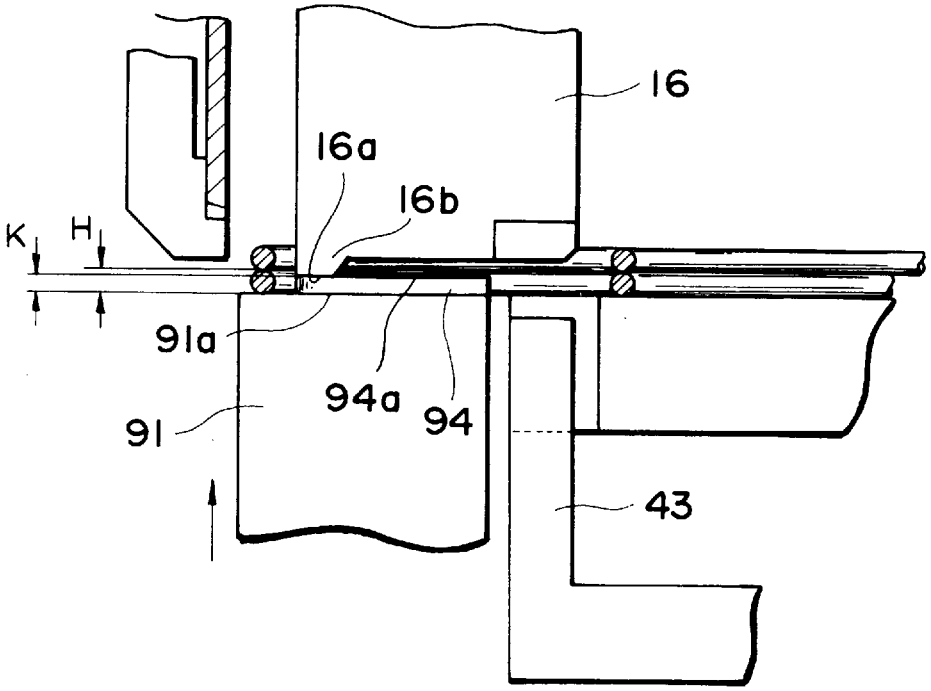
FIG. 51 is a partially enlarged side cross-sectional view to show a state in which the floating rod is lifted by the top surface of the drawing pin.

First, from the state before drawing as shown in FIGS. 3B and 9, the piston mechanism (second driving means)93 fixed to the moving base 110 is driven to project the piston rod 93*a* upward by a predetermine amount, thereby lifting the magnetic head 91, as shown FIG. 51. As the result, as shown in FIG. 51, the top face 94*a* of the drawing pin 94 is brought into contact with the lower end face 16*a* of the projecting portion 16*b* in the front floating rod 16 so as to push the front floating rod 16 by the height K of the drawing pin 94, thereby inserting the drawing pin 94 into the lowermost front ring portion 7. At this time, the coil 130 disposed around the magnetic head 91 is energized to make the ring portion 7 magnetically attached to the tip end face of magnetic head 91, thus becoming ready for drawing of wire heald B.

Figure 9A:
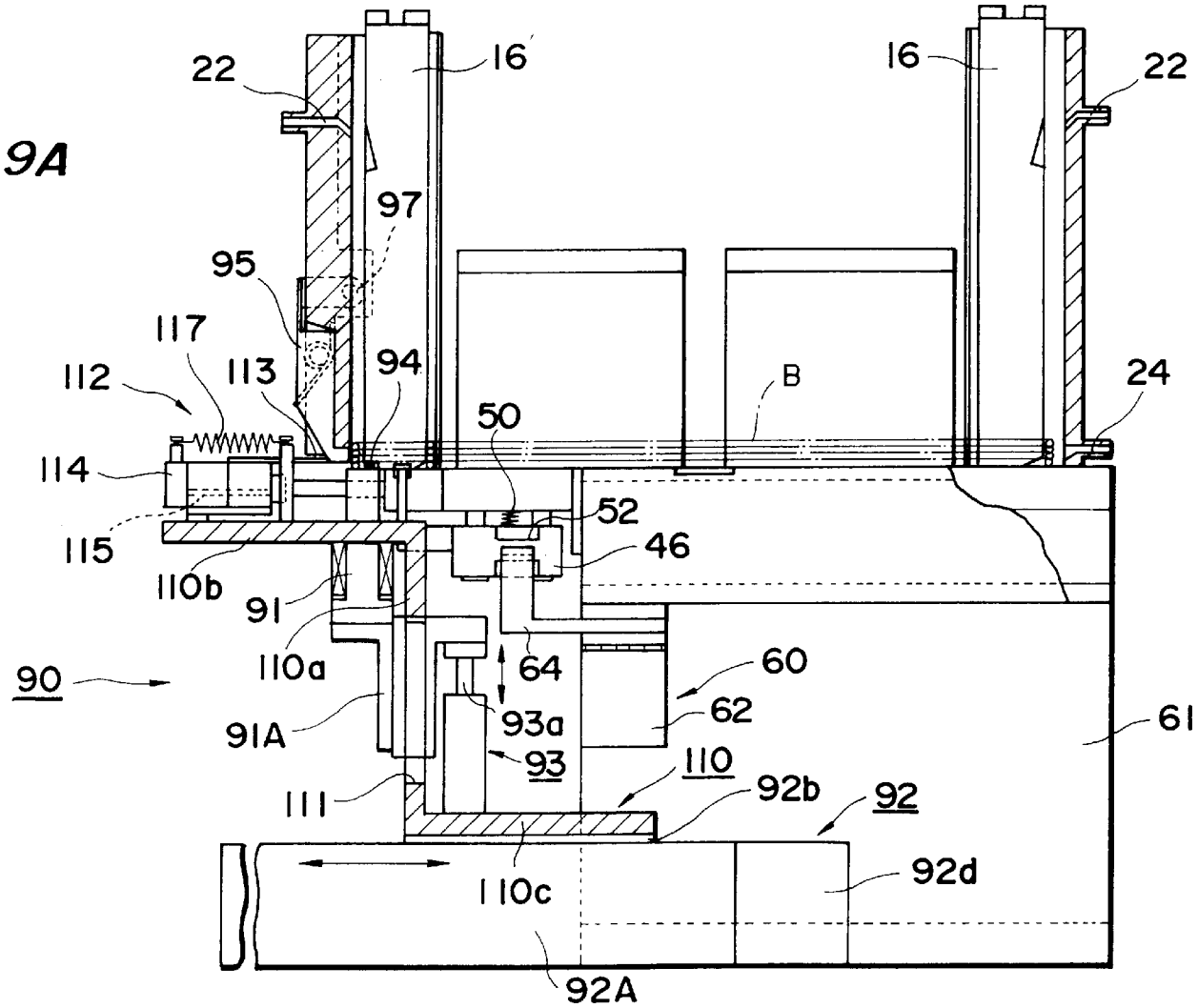
FIG. 9A is a side view to show the wire heald stocker to which the drawing apparatus of wire heald according to the present invention is applied.
Figure 9B:
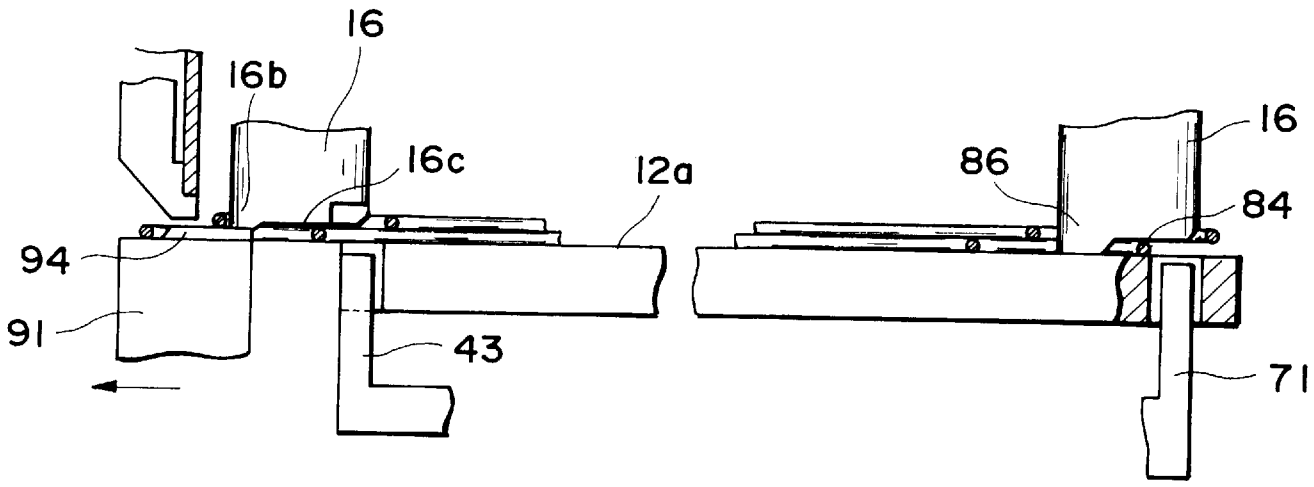
FIGS. 9B and 9C are a side view and a plane view of the drawing state that the lowermost wire heald is drawn by a drawing pin in the anothet embodiments of the present invention.
Figure 9C:
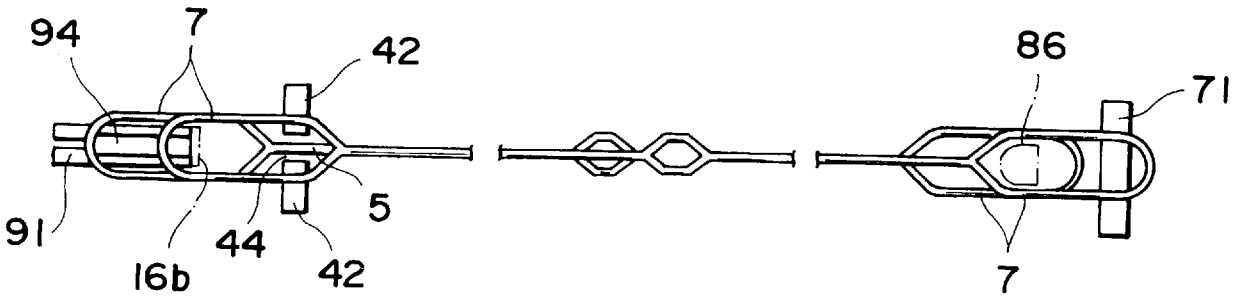
Figure 10:
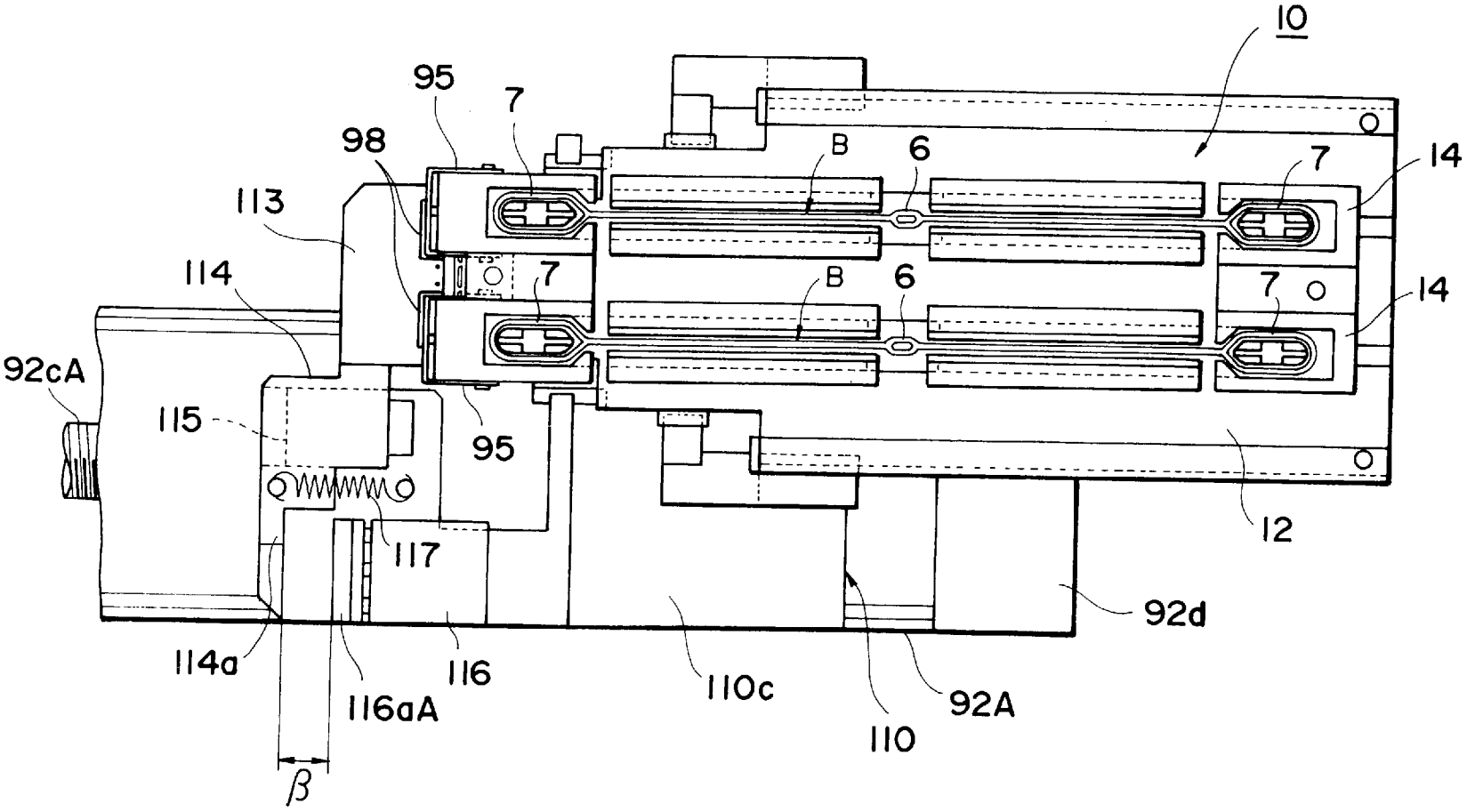
FIG. 10 is a plan view of the stocker shown in FIG. 9.
Figure 11:
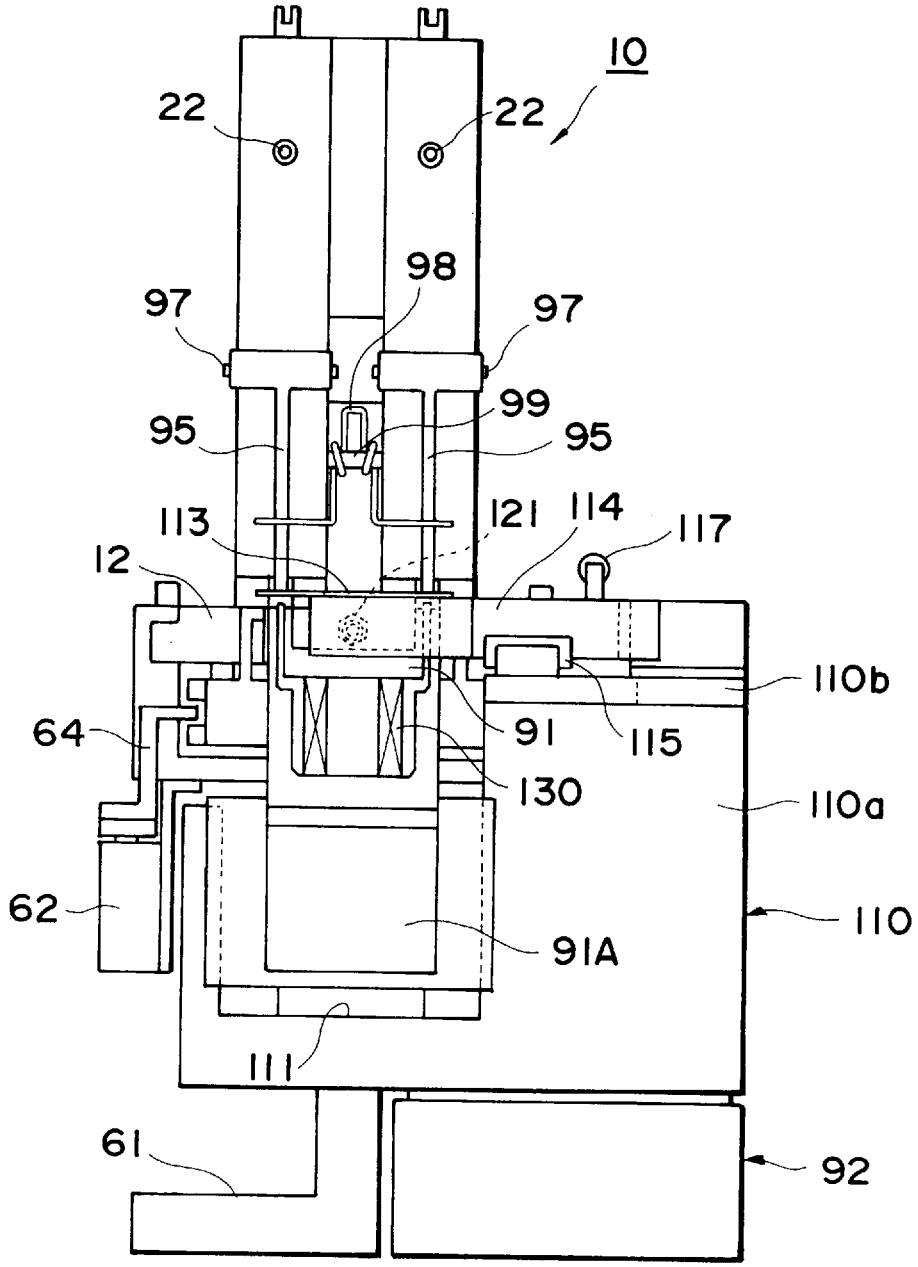
FIG. 11 is a front view of the stocker shown in FIG. 9.
Figure 12:
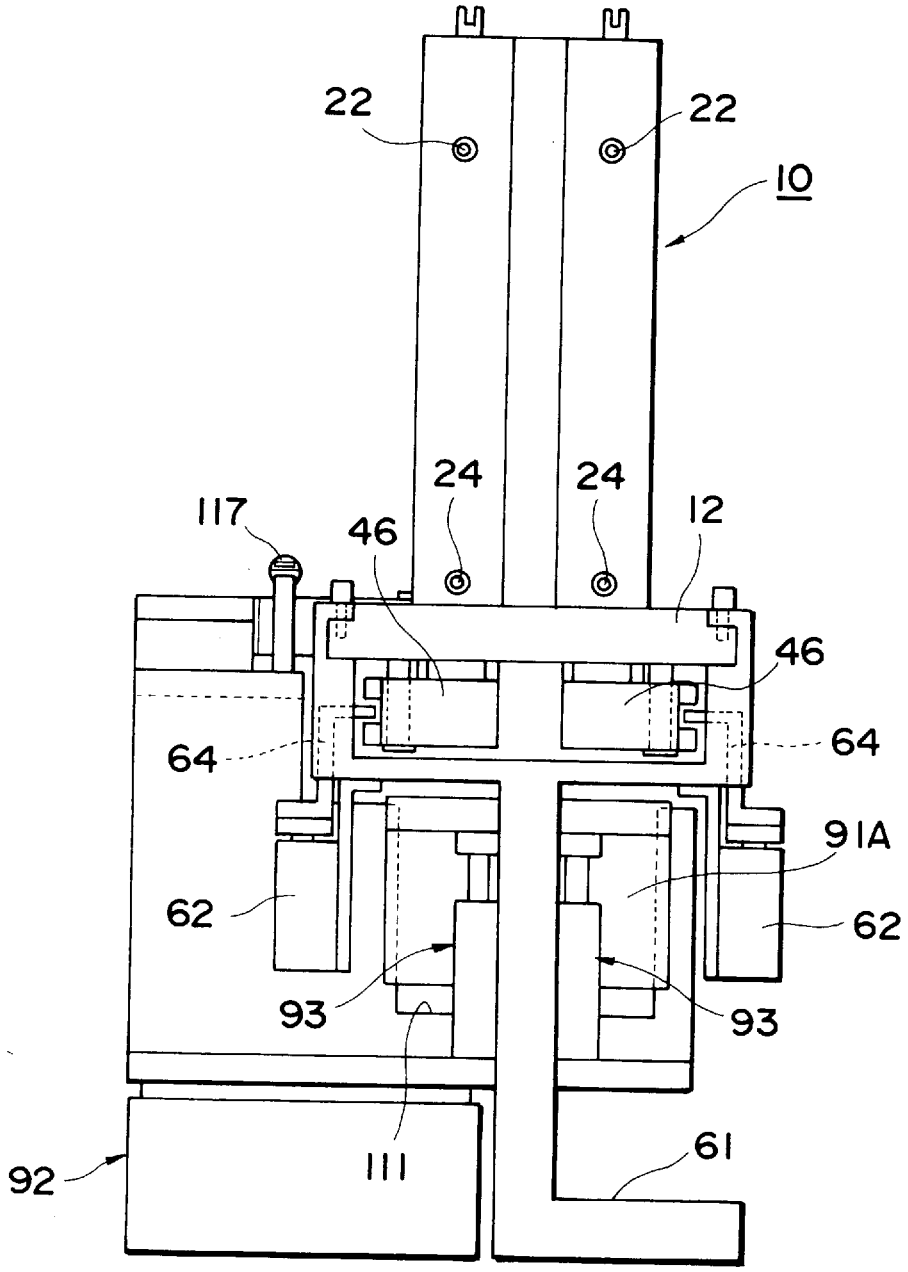
FIG. 12 is a back view of the stocker shown in FIG. 9.

In this state, as shown in FIG. 9, the servo motcr 92*d* of the driving mechanism 92*c* in the translating unit (first driving means) 92 is driven to rotate the screw shaft 92*c*A in a predetermined direction, thereby advancing the moving base 110 horizontally by β (See FIG. 10). As the result, as shown in FIGS. 9B and 9C, the lowermost ring portion 7 can be drawn into the ring pulling portion 16*c* of the front floating rod by slightly drawing out the lowermost ring portion 7 with keeping contact between the top surface 94*a* of the drawing pin 94 and the lower end face 16*a* of the notch portion 16*b* of the front floating rod 16. Accordingly the front ring portion 7 of the lowermost wire heald is guided between the lower face 16*a* of the front floating rod 16 and the heald receiving bottom surface 12*a* without contacting the front floating rod 16. Similarly, the rear ring portion 7 is also guided between the lower end face 16*a* of the rear floating rod 16 and the heald receiving bottom surface 12*a* through the ring pulling portion 84 of the rear floating rod 16.

At this time, the lowermost wire heald B is drawn by β by the drawing pin 94 and at the same time, the lowermost ring portion 7 is kept as hooked on the magnetic head 91 by engagement between the drawing pin 94 and the drop preventing portion 113, whereby the lowermost ring portion 7 is properly prevented from dropping off from the magnetic head 91 during further drawing of the wire heald B. The push portion 116*a*A of the piston rod 116*a* is in contact with the engaging projection 114*a* of the moving base portion 114, thereby preparing for movement of the drop preventing portion 113. As described, by slightly drawing pin 94, the lowermost ring portion 7 is shifted relative to the second (next) ring portion 7 from the bottom so as to expose the next ring portion 7, thereby becoming ready for separation of the lowermost wire heald B.

Figure 52:
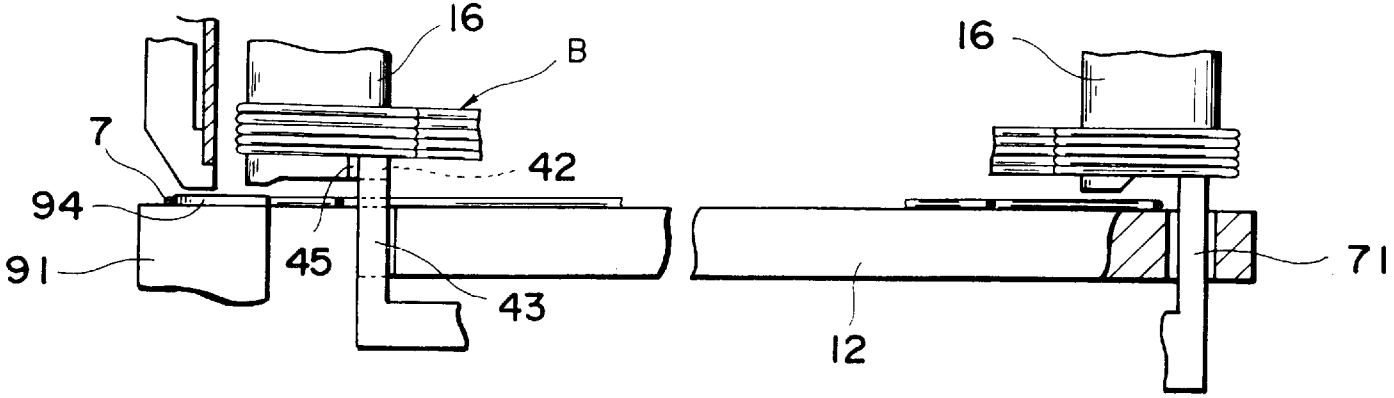
FIG. 52 is a side view to show a state in which the front and rear floating rods are lifted by the heald separating mechanisms.

After that, the air cylinder 62 shown in FIG. 9A is driven to move the actuator member 64 up so as to lift the upper tongue 52 by the tip end of the actuator member 64, so that the base portion 46 rises by a predetermined amount against the spring force of the compression spring 50. At this time, as shown in FIG. 30, FIG. 9C, and FIG. 52, with rise of push claws 41 the rod portion 5 of the lowermost wire heald B passes through the gap 44 between the claw portions 42, and therefore, the lowermost wire heald B continuously keeps its position without being affected by the rise of push claws 41.

Then the claw portions 42 are guided into the claw engaging recesses 45 of the front floating rod 16, so that the taper faces 42*a* of the claw portions 42 come to match the taper faces 45*a* of the claw engaging recesses 45. After that, they push the front floating rod 16 up from the bottom and also push the next ring portion 7 exposed from the bottom. This can lift the stacked ring portions 7 held in position around the floating rod 16 and the front floating rod 16 simultaneously, and therefore, only the lowermost front ring portion 7 is separated at the place of the front floating rod 16.

Figure 53:
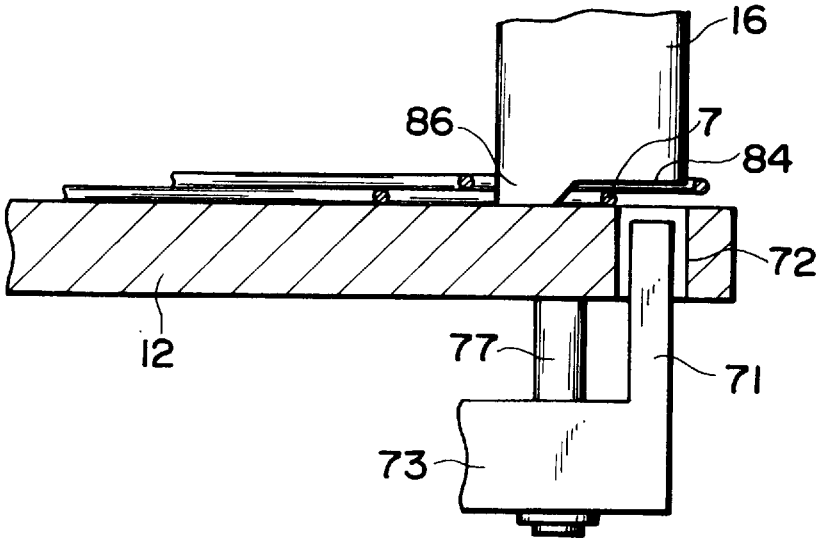
FIG. 53 is a partially enlarged side view to show a slightly drawn state of the lowermost wire heald.
Figure 54:
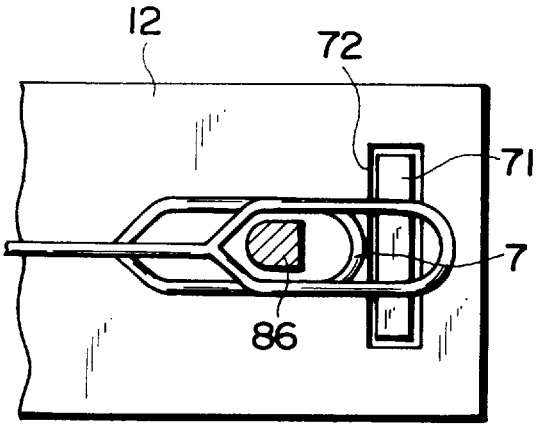
FIG. 54 is a plan view corresponding to the FIG. of FIG. 27.

Further, the front ring portion 7 is drawn out slightly by the drawing pin 94 as shown in FIG. 9B, whereby the lowermost ring portion 7 is shifted relative to the second (next) ring portion 7 from the bottom as shown in FIG. 53 and FIG. 54, thereby also exposing the next rear ring portion 7. Since at this time the rear end of the rear ring portion 7 of the lowermost heald is guided into the ring pulling portion 84 of the rear floating rod 16 as passing above the aperture 72 of the base 12, the rear ring portion 7 is kept from colliding with the rear floating rod 16 and the rear floating rod 16 is prevented from being pushed up. Then the projecting portion 86 of the rear floating rod 16 is still located in the lowermost ring portion 7.

Figure 55:
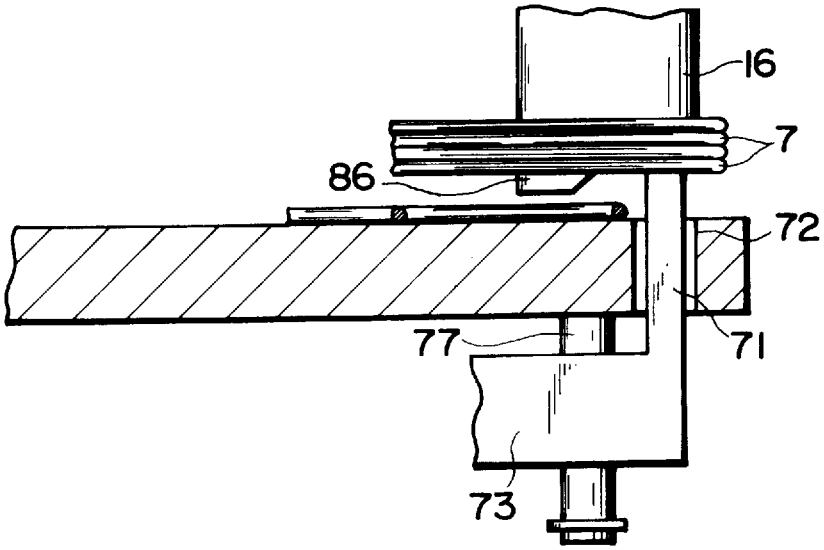
FIG. 55 is a side view to show a state in which the rear floating rod is lifted by the wire heald separating mechanism.

After that, the air cylinder 81 shown in FIG. 36G is driven to push the base portion 73 up by the tip of the cylinder rod 82, whereby the base portion 73 moves up as shown in FIG. 55. Following it, the push member 71 also moves up toward the rear ring portion 7. As a result, as the top face of the push member 71 simultaneously pushes the next ring portion 7 held in position as set around the rear floating rod 16 and the lower end face 16*a* of the ring pulling portion 84, the projecting portion 86 inserted into the lower ring portion 7 is lifted. Accordingly, the projecting portion 86 can be separated from the base 12. Then the engagement between the lowermost rear ring portion 7 and the rear floating rod 16 is released completely. In this way the lowermost wire heald B is separated perfectly from the front and rear floating rods 16 (see FIG. 52).

Figure 56:
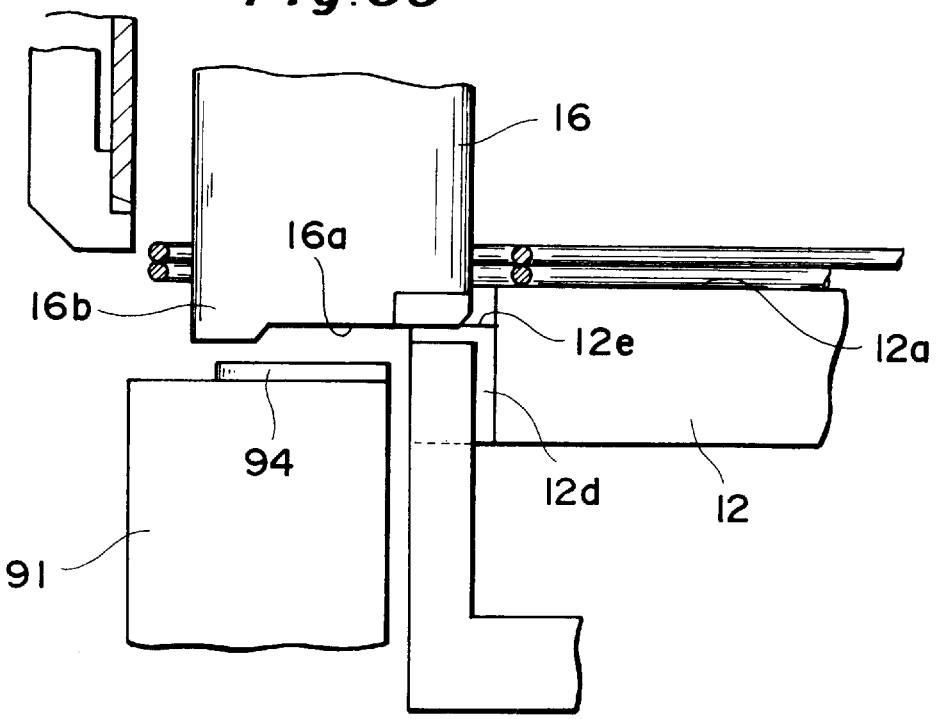
FIG. 56 is a side view to show another embodiment. of the drawing apparatus of wire heald according to the present invention.
Figure 57:
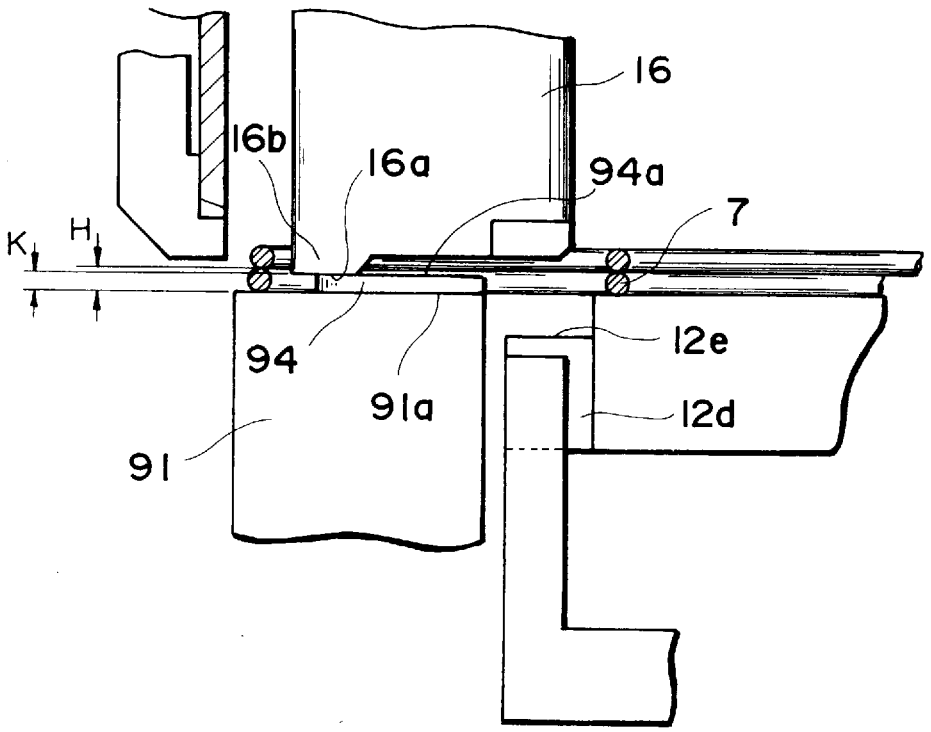
FIG. 57 is a side view to show a state in which the front floating rod is lifted by the drawing pin.

In a further modification, for example as shown in FIG. 56, a projected portion 12*d* is provided at the center of the tip portion of the base 12. An upper surface 12*e* of this projecting portion 12*d* is lower than the position of the heald receiving bottom surface 12*a* of the base 12 and the lower end face 16*a* of the floating rod 16 butts against the upper surface 12*e* of the projecting portion 12*d*. Since the lower end face 16*a* of the floating rod 16 is located one step below the heald receiving bottom surface 12*a* in this manner, the ring portions 7 in the heald group can be prevented from slipping off from the floating rod 16 even if the floating rod 16 should be moved vertically a little because of vibration from the outside. Then, as shown, in FIG. 57, the drawing pin 94 is inserted into the front ring portion 7 of the lowermost heald as pushing the front floating rod 16 by the height K of the drawing pin 94 and making the top surface 94*a* of the drawing pin 94 butt against the lower end face 16*a* of the projection 16*b* in the front floating rod 16. At this time the ring portion 7 is magnetically attached to the tip end face 91*a* of the magnetic head 91 by the magnetic force thereof, thus preparing for drawing of wire heald B.

Figure 58:
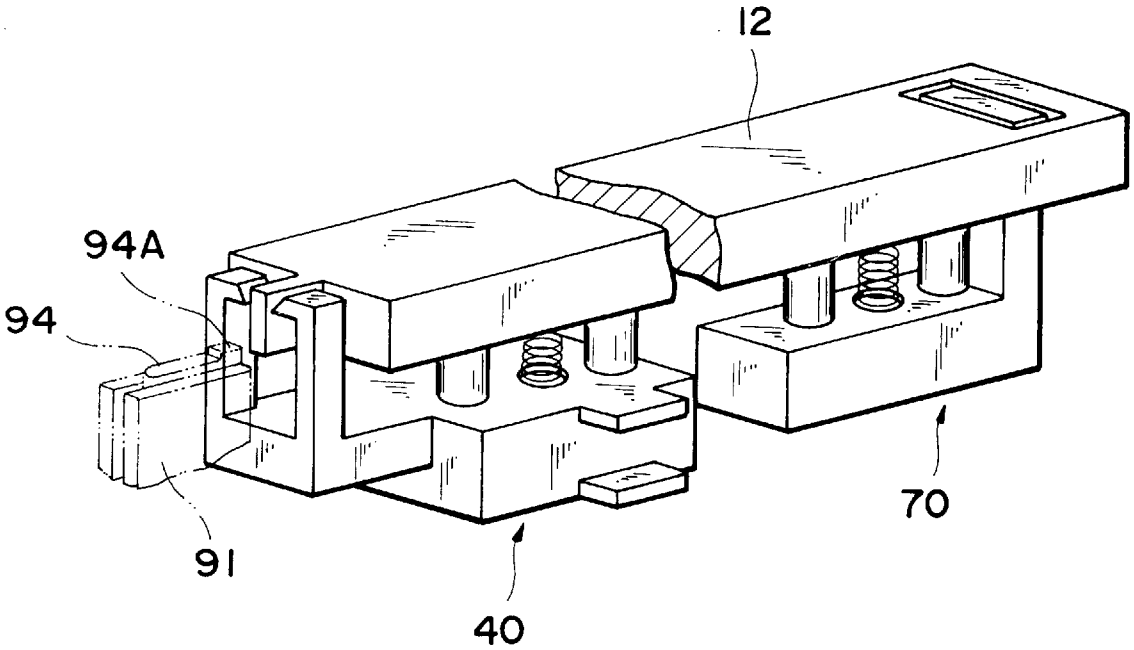
FIG. 58 is a perspective view to show still another embodiment of the drawing apparatus of wire heald according to the present invention.
Figure 59:
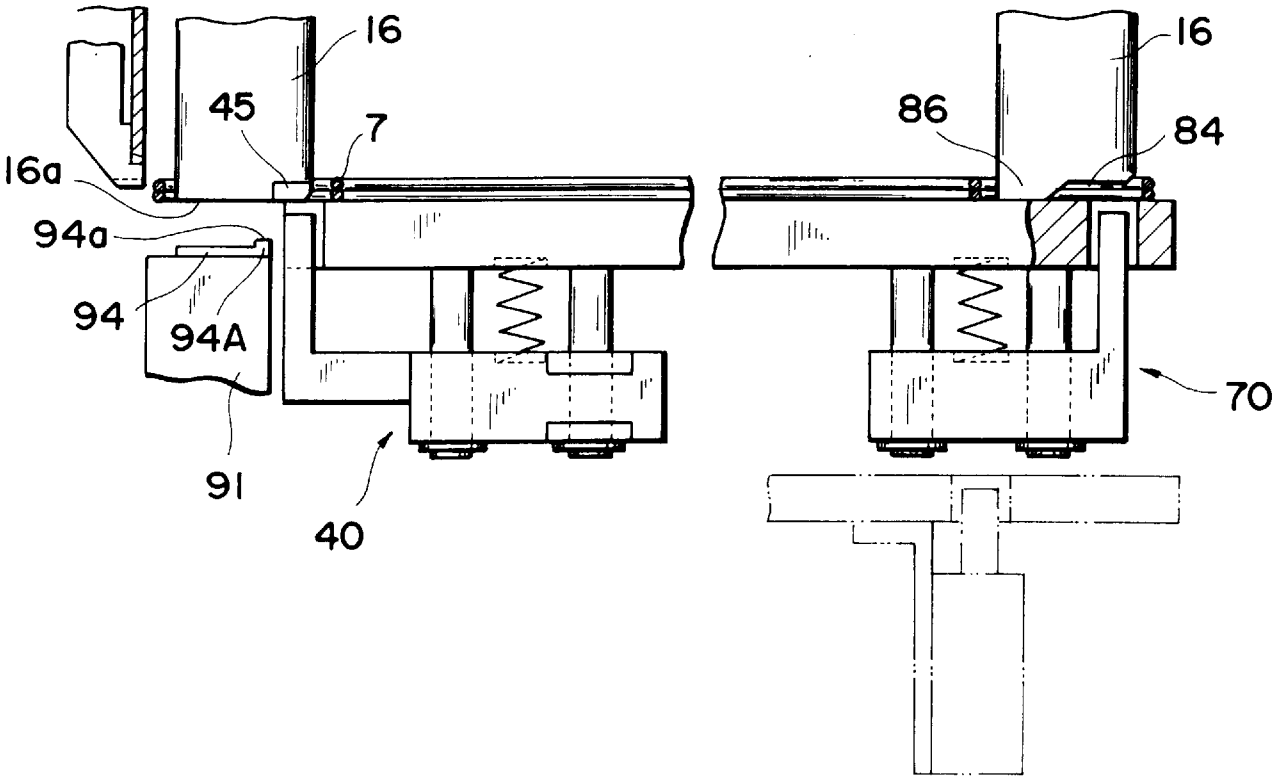
FIG. 59 is a side view to show a state in which the magnetic head stands by below the front floating rod.
Figure 60:
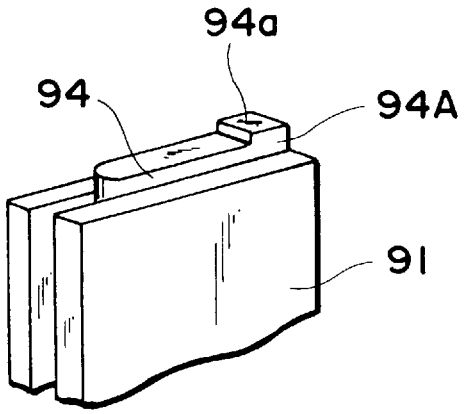
FIG. 60 is a perspective view to show another embodiment of the drawing pin.
Figure 61:
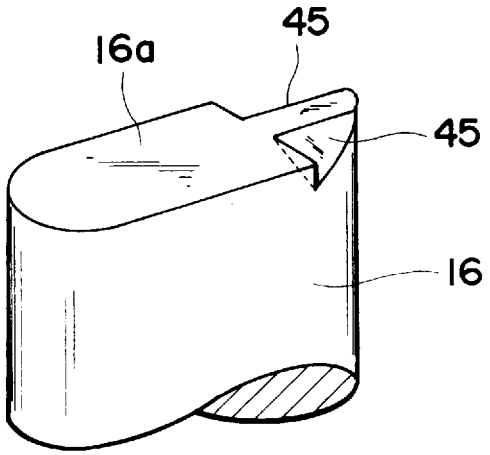
FIG. 61 is a perspective view to show another embodiment of the floating rod.

In further modification of the above modification, as shown in FIG. 58 to FIG. 60, a push projection 94A for pushing the lower end face 16*a* of the floating rod 16 up is provided in the rear part of the drawing pin 94, and a top surface 94*a* of the drawing pin 94 is one step higher at the position of the push projection 94A. Further, the lower end face 16*a* of the flowing rod 16 is flat as shown in FIG. 61.

Figure 62:
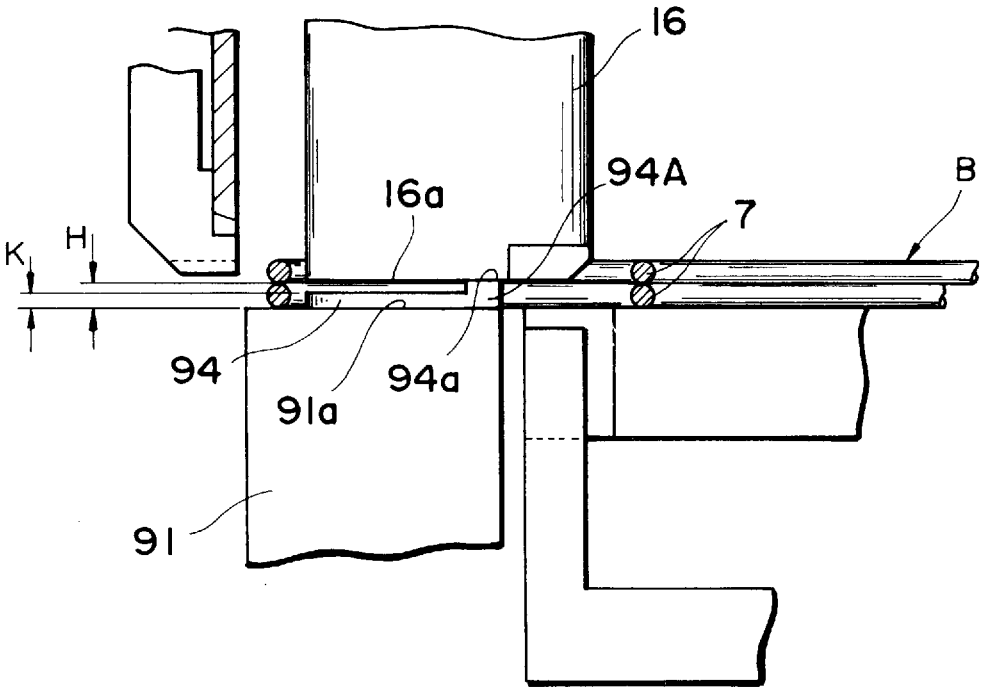
FIG. 62 is a side view to show a state in which the floating rod is lifted by the drawing pin shown in FIG. 60.

Then, as shown in FIG. 62, the magnetic head 91 is raised to make the top surface 94*a* of the push projection 94A in the drawing pin 94 butt against the lower end face 16*a* of the front floating rod 16 and then to push the front floating rod 16 up by the push projection 94A of the drawing pin 94. At this time, the lower end face 16*a* of the floating rod 16 is lifted to a position higher than the height H of the lowermost ring portion 7 and at the same time, the drawing pin 94 is inserted into the front ring portion 7 of the lowermost heald. Then the ring portion 7 is magnetically attached to the tip end face 91*a* of the magnetic head 91, thus preparing for drawing of wire heald B.

Figure 63:
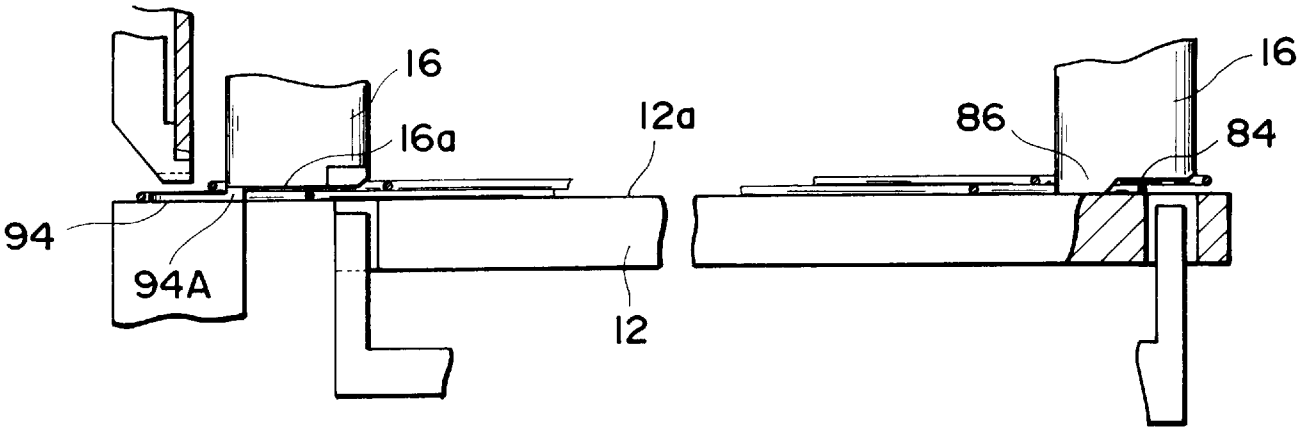
FIG. 63 is a side view to show a state in which the lowermost wire heald is drawn out by the drawing pin.

In this state, as shown in FIG. 63, as the top surface 94*a* of the push projection 94A in the drawing pin 94 butts against the lower end face 16*a* of the front floating rod 16, the magnetic head 91 is advanced to draw the lowermost ring portion 7 slightly by the drawing pin 94. As a result, the lowermost ring portion 7 is pulled to below the lower end face 16*a* of the front floating rod 16 without touching the lower end face 16*a* of the floating rod 16. Accordingly, the front ring portion 7 of the lowermost heald can be pulled in below the lower end face 16*a* of the front floating rod 16 without colliding with the front floating rod 16. Similarly, the rear ring portion 7 is also pulled into between the lower end face 16*a* of the rear floating rod 16 and the heald receiving bottom surface 12*a* through the ring pulling portion 84 of the rear floating rod 16. In this way, the drawing pin 94 pulls the lowermost ring portion 7 slightly to shift the lowermost ring portion 7 relative to the second (next) ring portion 7 from the bottom and to expose the next ring portion 7, thus preparing for separation of the lowermost wire heald B (see FIG. 63).

Figure 64:
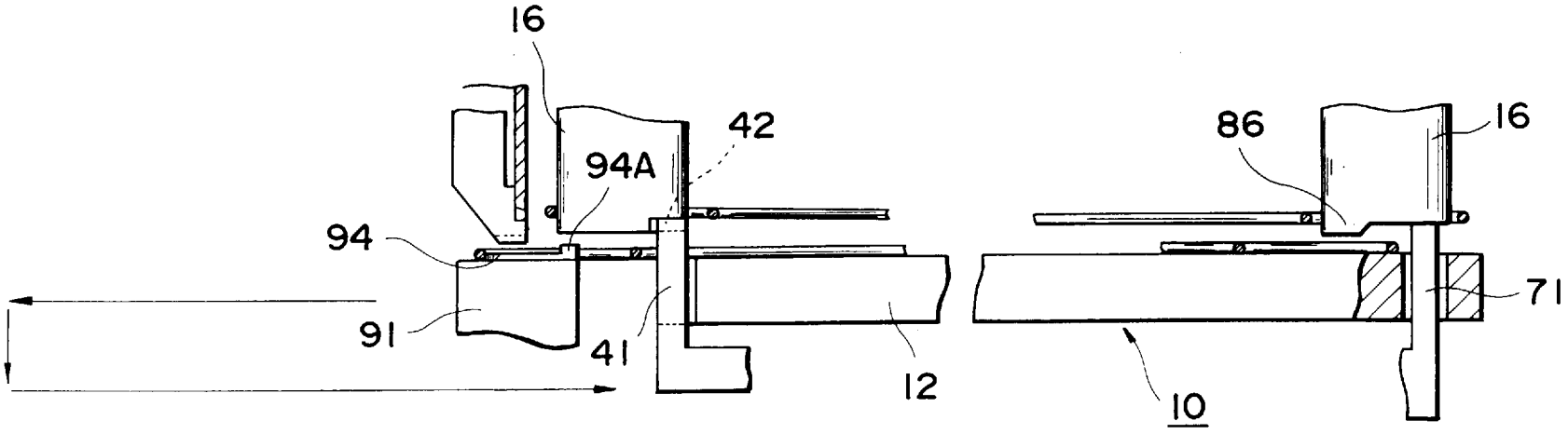
FIG. 64 is a side view to show a state in which after lifting the front and rear floating rods by the wire heald separating mechanisms, the lowermost wire heald is drawn out.

After that, as shown in FIG. 64, the push claws 41 are raised to push the front floating rod 16 up by the claw portions 42 and also push the next ring portion 7 exposed, from the bottom. As a result, at the place of the front floating rod 16 separation of the front ring portion 7 in the lowermost wire heald B is completed. Further, the push member 71 is raised toward the rear ring portion 7 to lift the rear floating rod 16, thereby completing separation of the rear ring portion 7 in the lowermost wire heald B.

Figure 65:
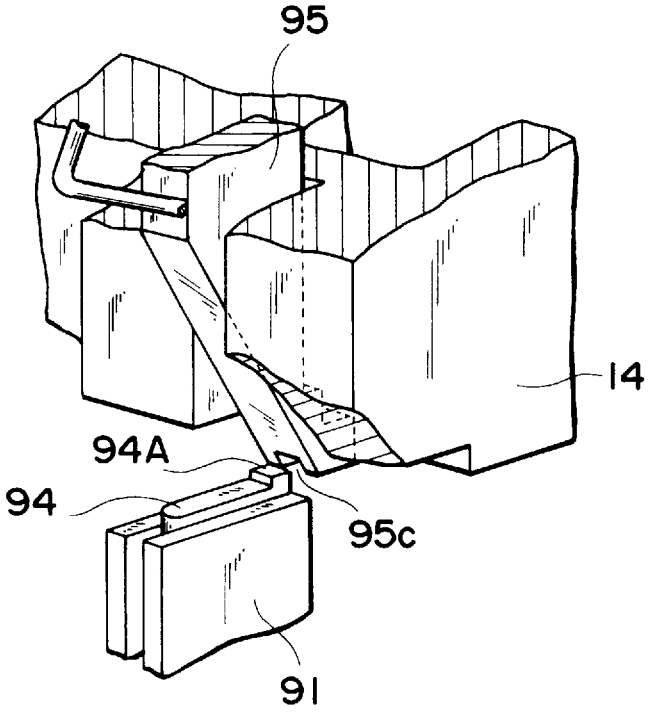
FIG. 65 is a perspective view to show the ring receiving portion.

After that, the magnetic head 91 is advanced further to discharge the lowermost wire heald B out of the stocker 10. In order to prevent the push projection 94A of the drawing pin 94 from colliding with the switch piece 95 of the multiple draw preventing portion J upon drawing of the lowermost wire heald B, a notch gate 95*c* for permitting the push projection 94A to pass therethrough is provided at the lower end of this switch piece 95, as shown in FIG. 65.

As to the separating apparatus and method, though not shown, the drawing apparatus and drawing method of the present invention can be applied to a horizontally stacked heald group of wire healdes B suspended vertically by mounting ring portions 7 of many wire healdes B on a pair of upper and lower floating rods extending horizontally and biased by spring against the base extending vertically.

For example, the upper ring portion 7 of the wire heald B at the extremal end (or at the "frontmost end" in this case) is magnetically attached to the magnetic head and the magnetic head is raised slightly, whereby the frontmost wire heald B moves up slightly as hooked on the drawing pin. As a result, the upper ring portion 7 of the frontmost wire heald B is shifted slightly relative to the upper ring portion 7 of the next (the second from the frontmost) wire heald B, thereby exposing the upper ring portion 7 of the next heald. After that, the claw portions of push claws as shown in FIG. 29 are moved toward the next ring portion 7 horizontally (in the heald stack direction) from the outside. At this time, the next ring portion is pushed back by the claw portions as the rod portion of the extreme wire heald B passes between the push claws, thereby separating the upper ring portion 7 of the frontmost heald from the upper ring portion 7 of the next heald.

For separating the lower ring portion 7 of the frontmost heald from the lower ring portion 7 of the next heald, the wire heald B is raised slightly by the magnetic head to shift the lower ring portion 7 of the frontmost wire heald B a little, thereby exposing the lower ring portion 7 of the next heald. After that, the pushing-back member as shown in FIG. 35A is moved toward the next ring portion 7 horizontally (in the heald stack direction) from the outside. At this time, the tip of the pushing-back member pushes the next ring portion back to separate the lower ring portion 7 of the frontmost heald from the lower ring portion 7 of the next heald. Then, at the point of completion of separation of the front and rear portions of the frontmost wire heald B from the other wire healdes B, the magnetic head is raised further to completely draw only the frontmost wire heald B upward as hooking it on the drawing pin.

Figure 66A:
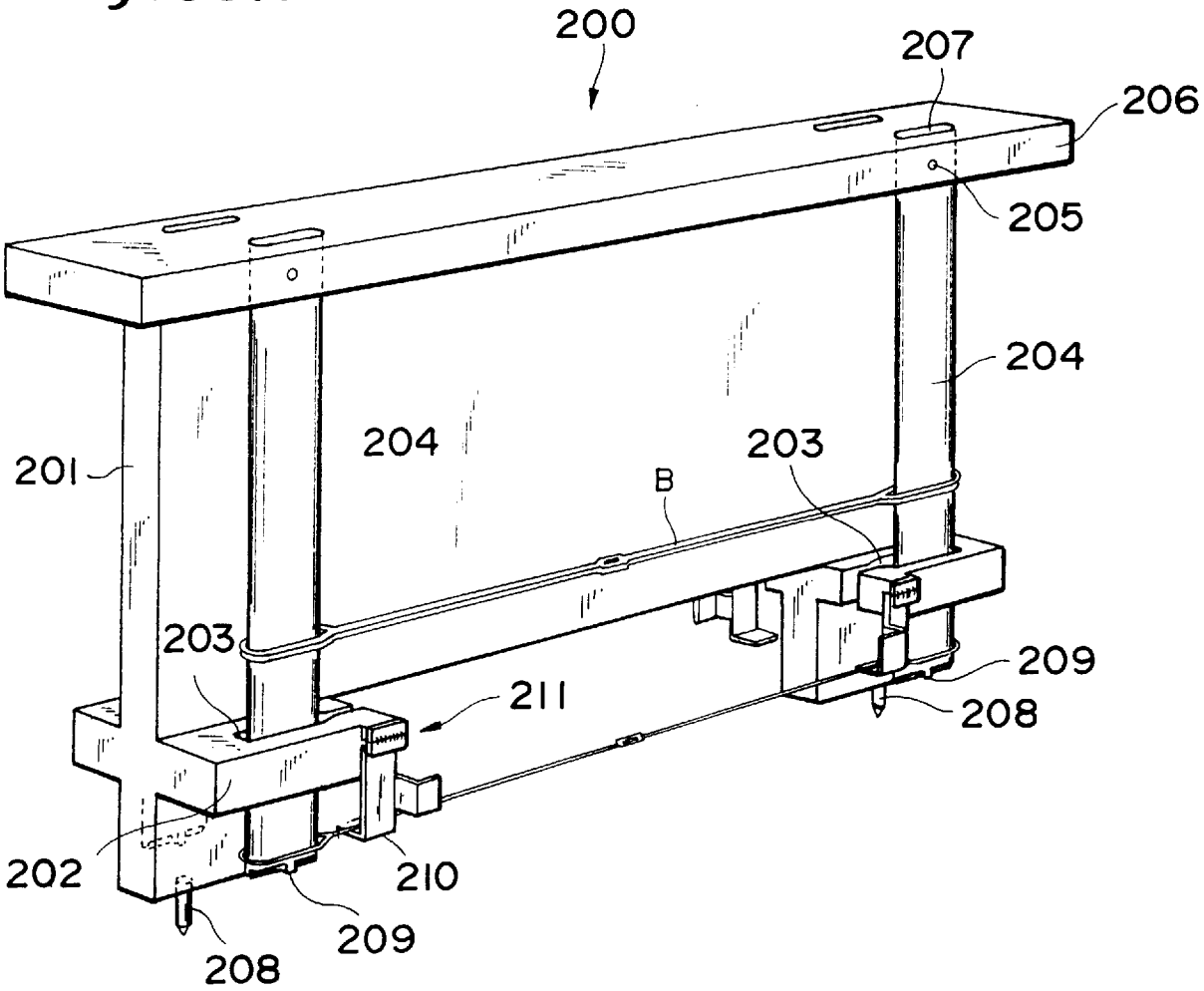
FIG. 66A is a perspective view to show a cartridge for the wire heald stocker.
Figure 66B:
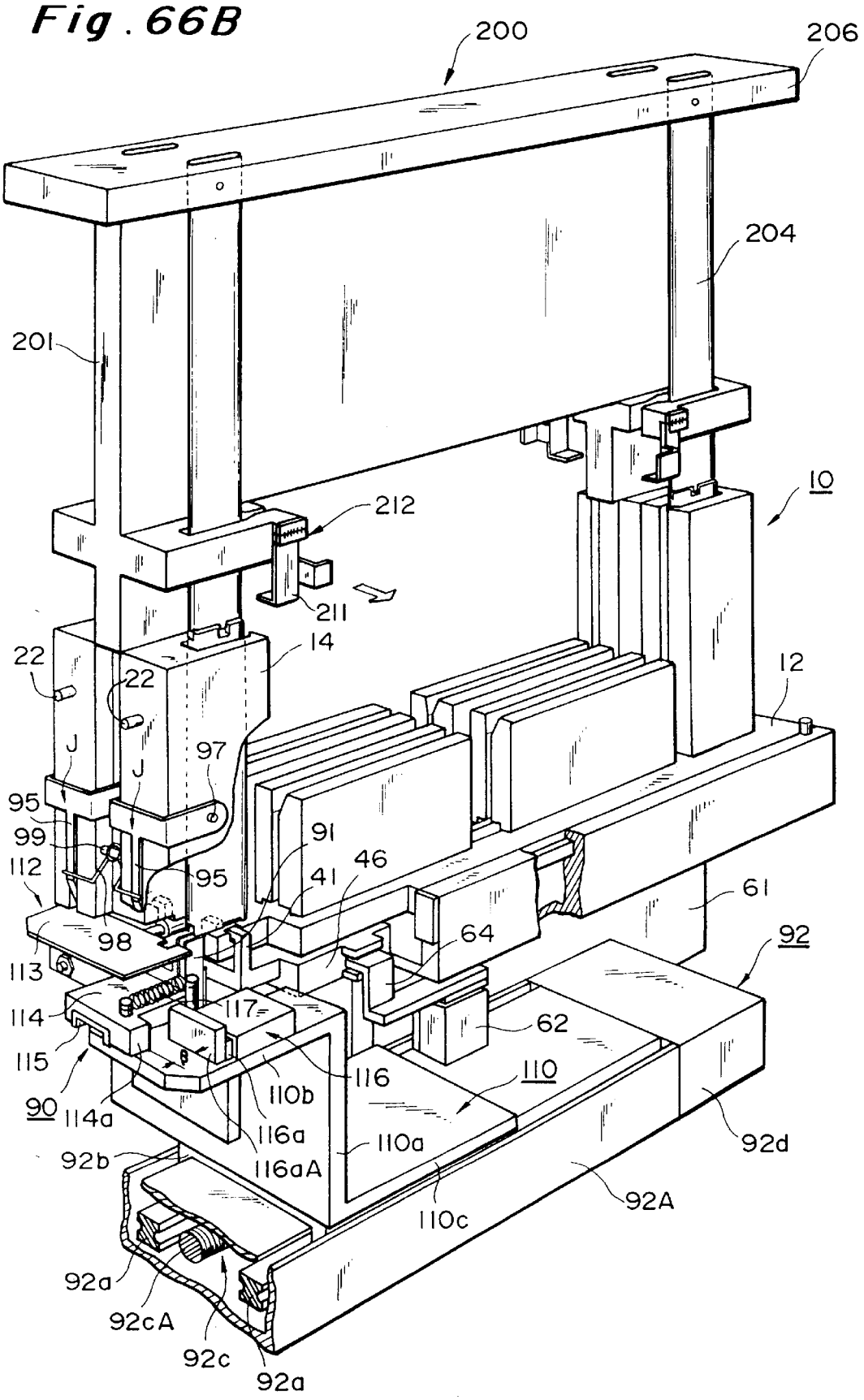
FIG. 66B is a perspective view of to show a combination of the wire heald stocker and the cartridge shown in FIG. 66A.

A cartridge, as shown in FIG. 66A, makes the setting of the wire heald into the wire heald stocker 10. The stocker 200 has a top plate 206 and colums 210 vertically extending from the top plate 206. The colums 201 have flange 202 extending from the colums. The flange 202 has a through hole 203 through which the floating rod 204 passes. A crusiate projection 209 is provide on the bottom of the rod 204 for matching a crusiate grooves provided on a top of the floating rod 16. The flange 202 has a engaging arm 211 which is swingably monted on the flange. The engaging arm 211 is fixed with a hinge 212 to the flange 202 and has a engaging claw 209. The colum 210 has a pin 208 which may be inserted into a hole formed on the top of the stocker so as to fix the cartridge 200 and the stocker 10. Holes 207 are formed in the top plate 206 and the floating rode 204 are inserted therein. Further, the floating rod 204 is slightly movable with a pin 205 to the top plate 206. Although some clearance between the floating rode 204 and the through hole 203 is provided, since the wire heald B surround the floating rod 204, and the outer of the ring portion in the wire heald passes a hole 203 and the wire heald naturally falls down, the rod 204 are held in the cartridge 200 nearly vertically. The engaging arm is used for supporting or releasing the wire heald B. FIG. 66B shows the combination of the wire heald stocker 10 and the cartridge 200. Further, in FIG. 66B, the clearance are provided between the floating rod 204 and the floating rod 16 and therefore, the floating rod 16 is movable in vertical direction by some amount smaller that the clearance between the floating rod 204 and the floating rod 16.

In the above embodiments, the floating rods are lifted by pusing up the rods. In the next embodiment, the floating rods is lifted up by driving means provided on a cartridge stocking the wire heald.

Figure 37B:
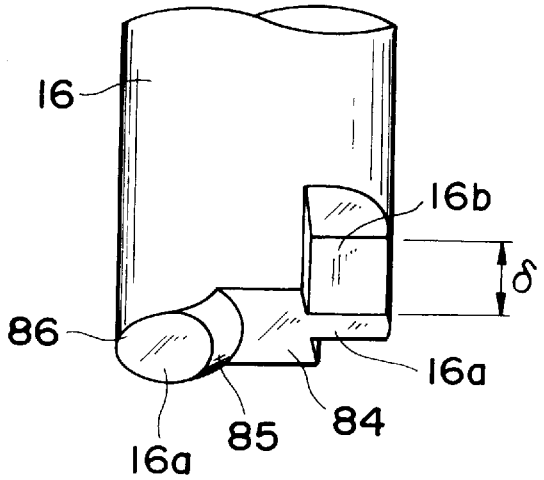
FIG. 37B is a perspective view to show the lower end portion of the rear floating rod in the another embodiments.
Figure 67A:
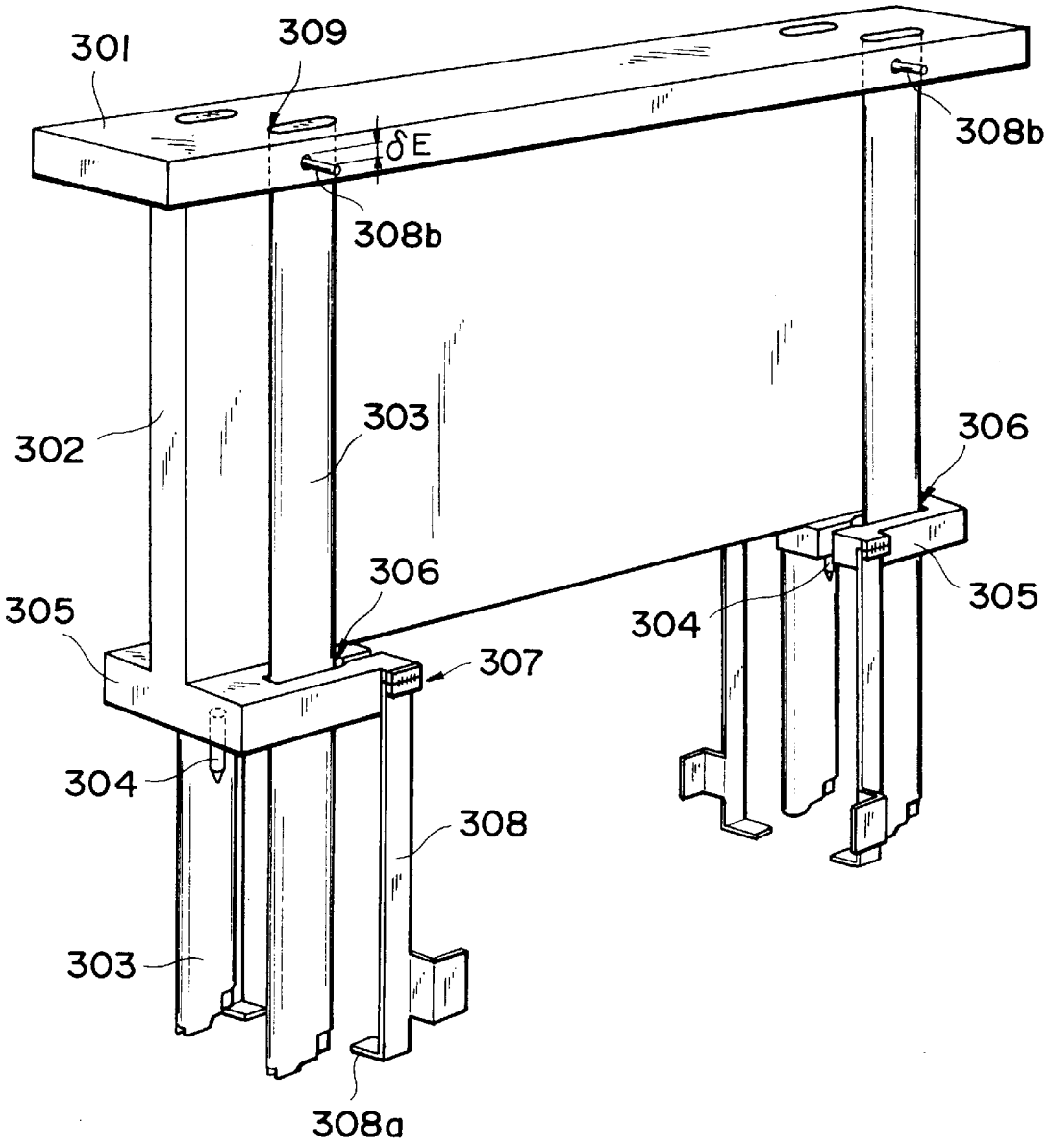
FIG. 67A is a perspective view to show an another cartridge for the wire heald stocker.

FIG. 67A shows an another type cartridge in which floating rod is integrally incorporated. The cartridge shown in FIG. 67A has a top plate 301 and colum 302 having a flange 305 and floating rods having bottom shapes as shown in FIGS. 37B (rear flating rod) and 42B (front floating rod) respectively. The cartride has some means (lifting pin 308*b* etc.) for lifting up floating rods 303. Further, the cartride has engaging arms 308 attached to the flange 305 with spring hinges so as to make the arms swingable for supporting or releasing the wire heald B by a driving means (not shown). The arm 308 has a claw 308*a* for holding the wire heald B. A pin 304 is provided on lower surface of the flange 305 for engaging with the wire heald stocker 10. The flange 305 has through hole 306 through which the floating rod 306 passes. The floating rods are supported by pins 308*b* and since holes formed in the top plate 301 is larger than the size of the pins 308*b* by δE, the floating rod can moved by δE in a vetical direction by any driving mean. Besides, in FIG. 67A, by setting δE=0, that is, as shown in FIG. 66A, the column 201 and the floating rod 204 are arranged, the cartridge may be moved up and down by making a hole formed on a top of the stocker and the pin 304 in contact with each other and making the lifting plate 311 in contact with the lower side of 20 the top plate 301.

Figure 67B:
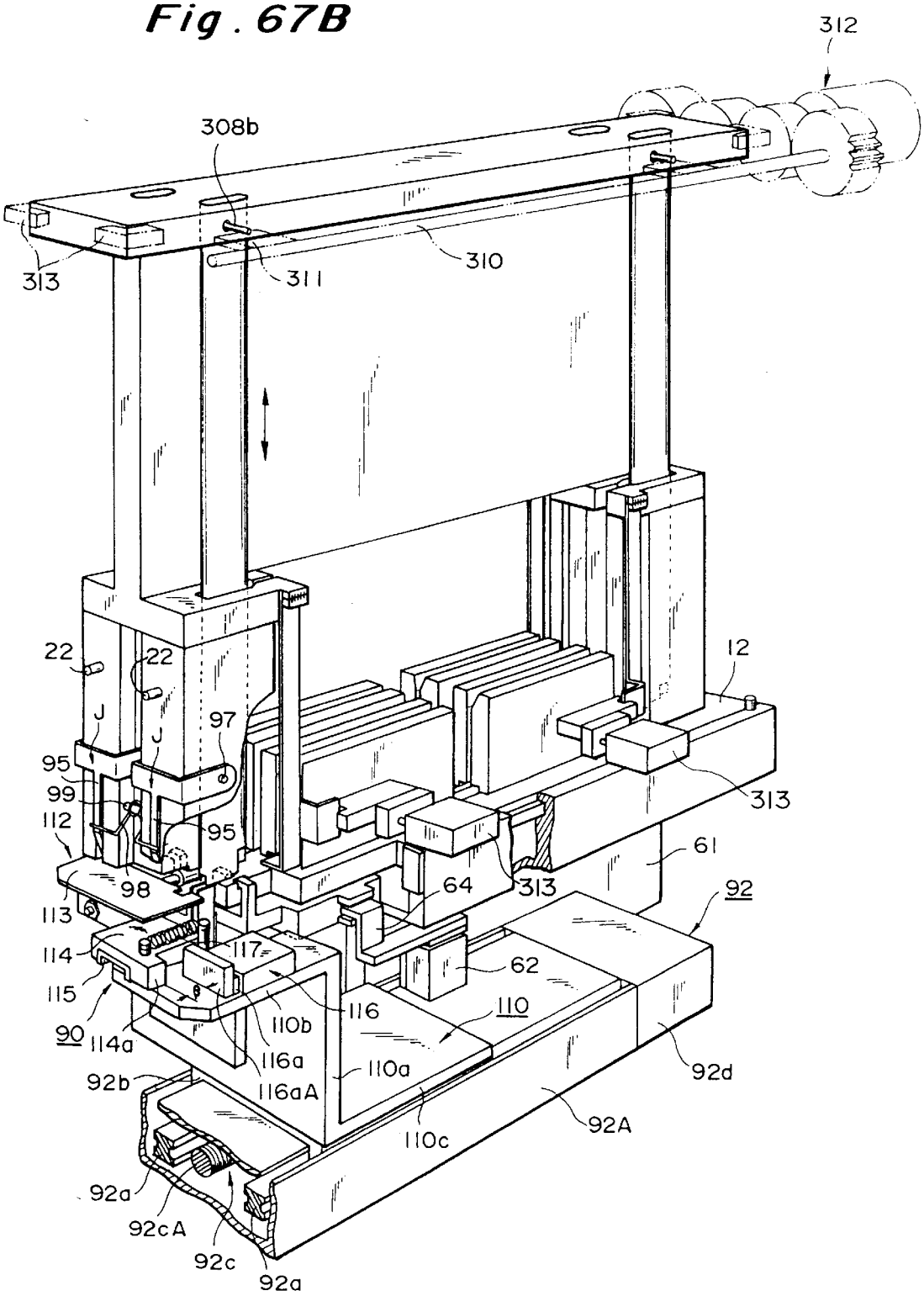
FIG. 67B is a perspective view to show a combination of the another cartridge shown in FIG. 67A and the wire heald stocker.

FIGS. 67B shows a combination of the above cartridge and the wire heald stocker. As shown in FIG. 67B, the lifting pin 308*b* can be moved by means of lifting plate 311 connected to a bar 310 at end of which a driving unit 312 is attached. In the arrangements, the floating rods 303 can be slightly moved in a vertical direction by means of the lifting pin 308*b*, the lifting plate 311, the bar 310 and the driving unit 312.

The wire heald drawing operation will be explained, referring FIGS. 32B, 34B, 34C, 35B, 37 B, 41B, 42B, 43B, 43C and 45B.

Figure 32B:
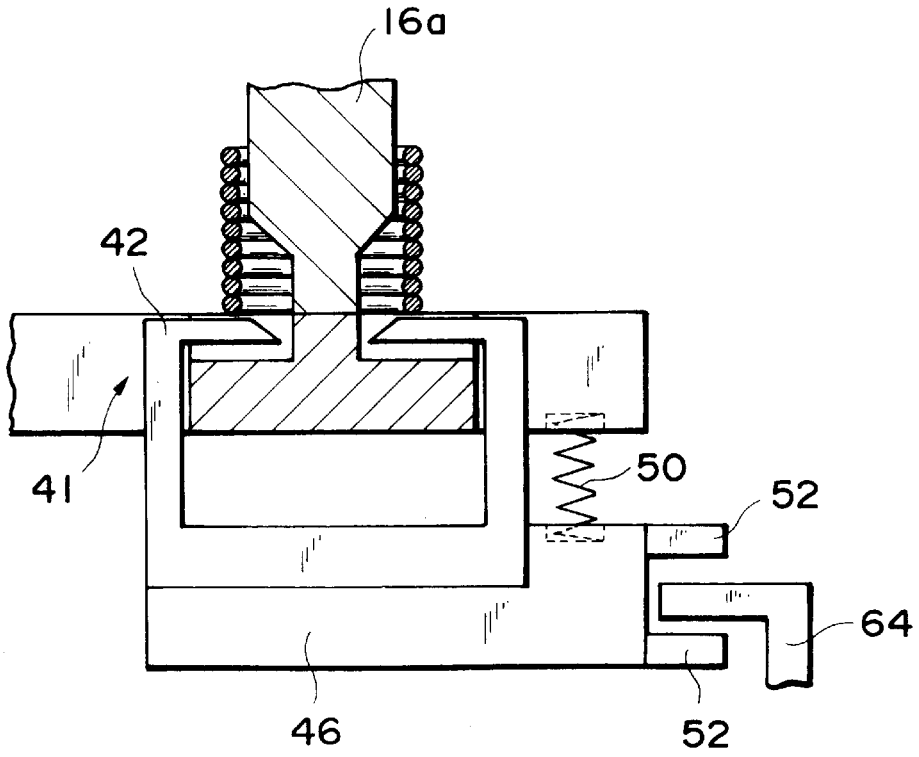
FIG. 32B is a longitudinal cross-sectional view of FIG. 41B.
Figure 34B:
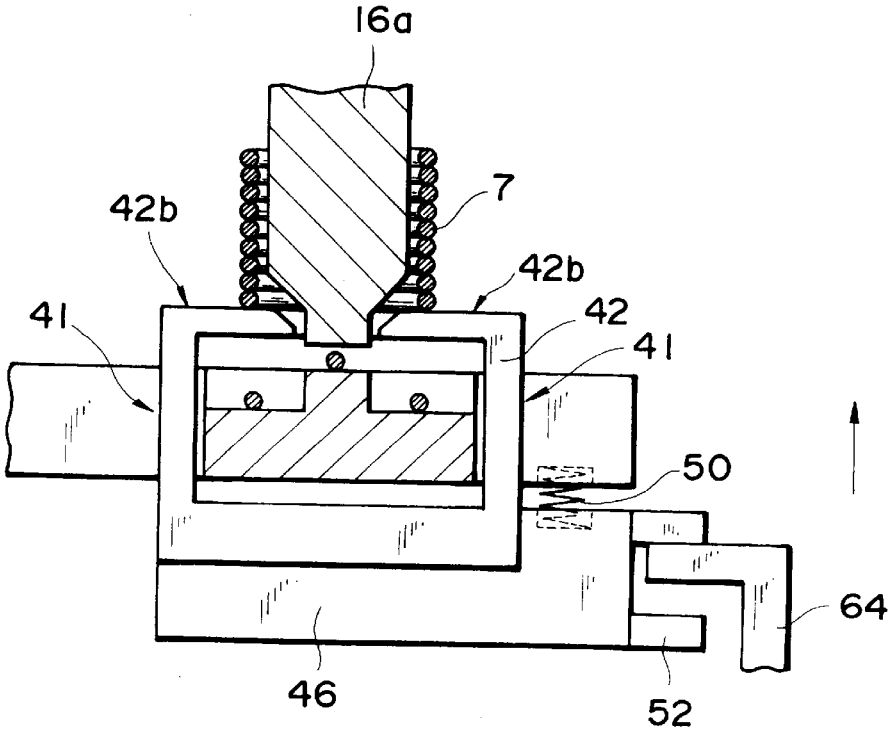
FIGS. 34B and 34C are a longitudinal cross-sectional views of FIGS. 43B and 43C respectively.
Figure 34C:
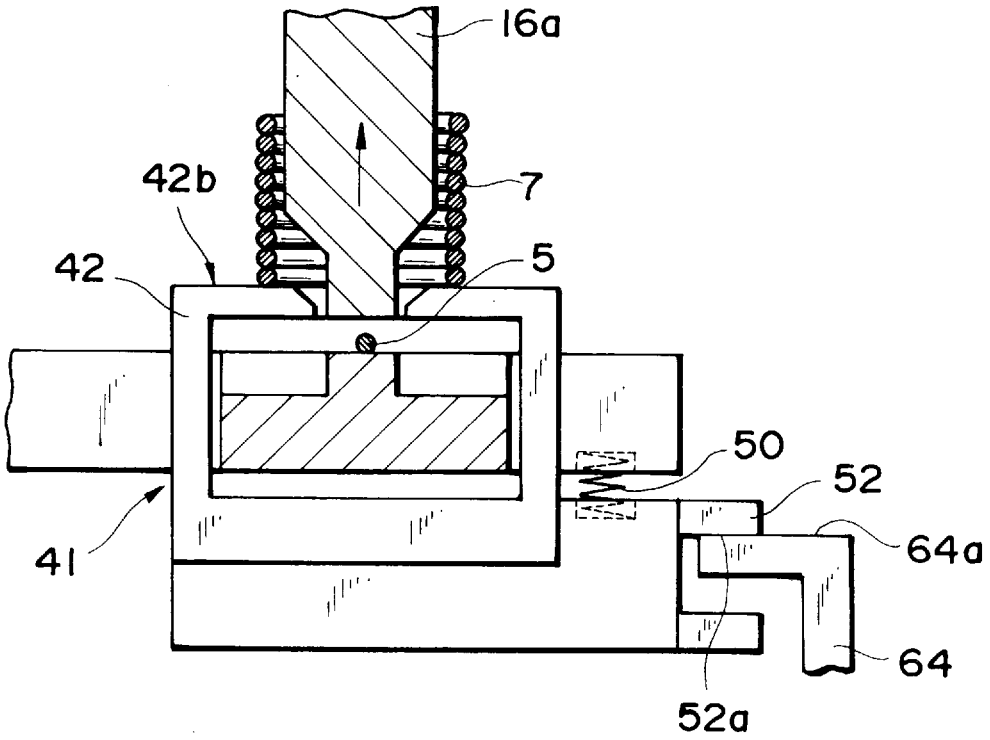
Figure 35B:
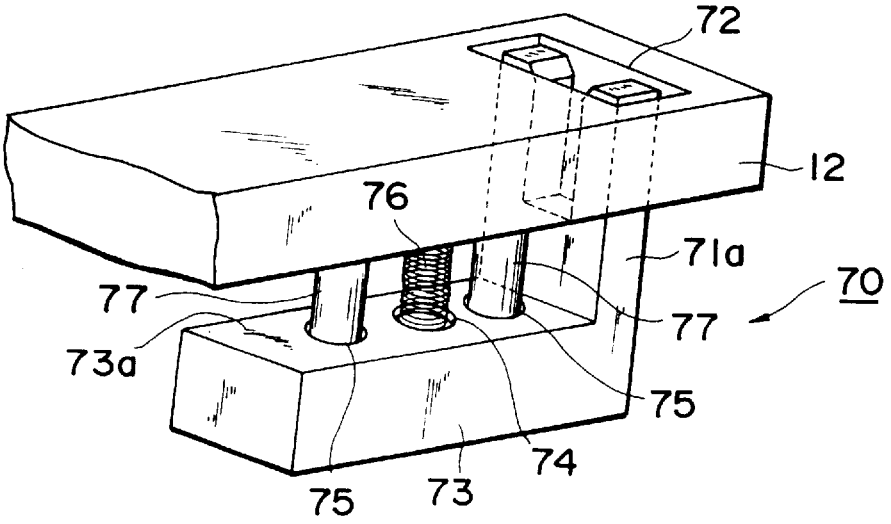
FIG. 35B is a perspective view to show the another type wire heald separating mechanism.
Figure 41B:
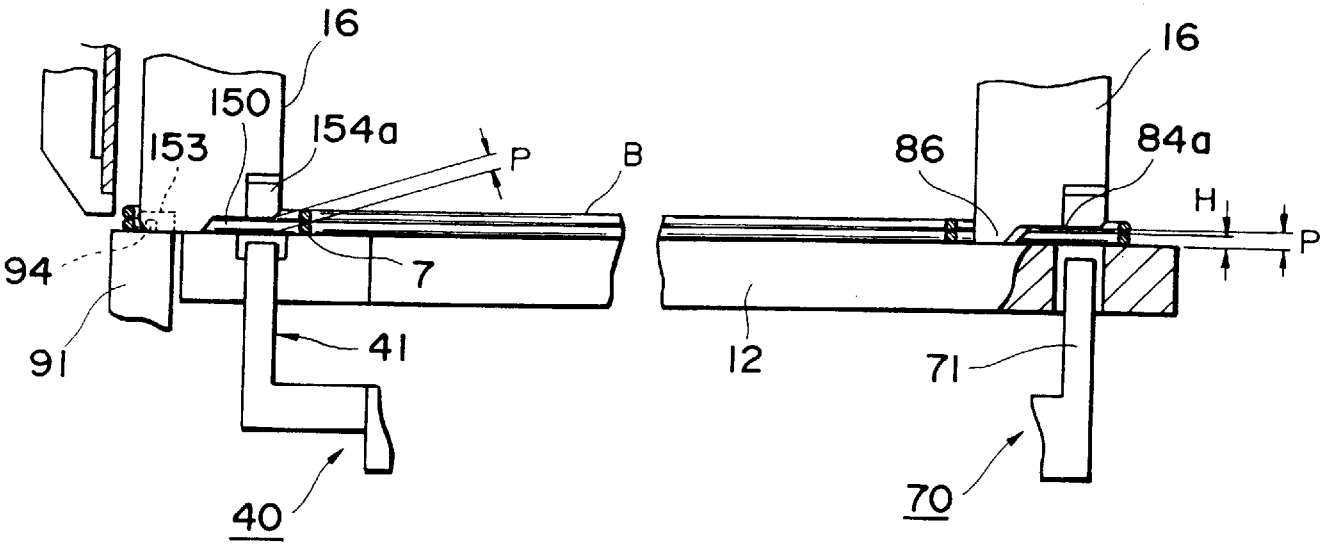
FIG. 41B is a side view to show anther embodiment of the front floating rod in the drawing operation.
Figure 42B:
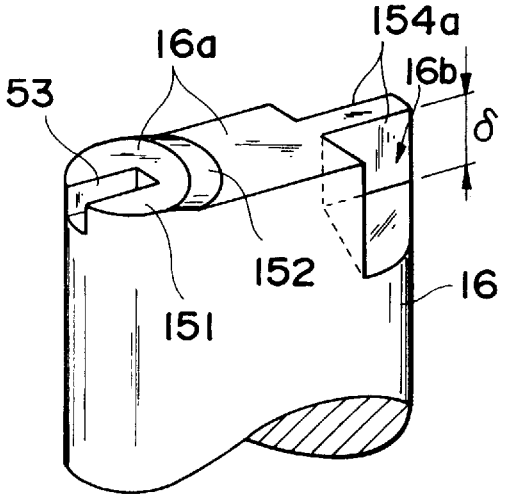
FIG. 42B is a perspective view to show the lower end face of the front floating rod in the another embodiment.
Figure 43B:
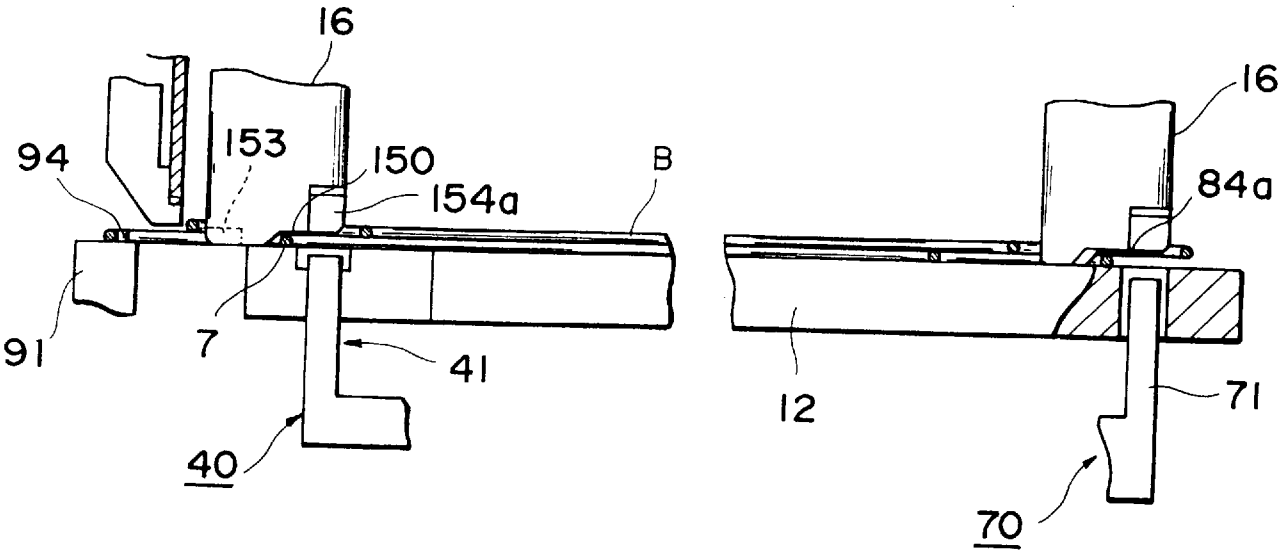
FIGS. 43B and 43C are side views to show a slightly drawn state of the lowermost wire heald in the another embodiment.
Figure 43C:
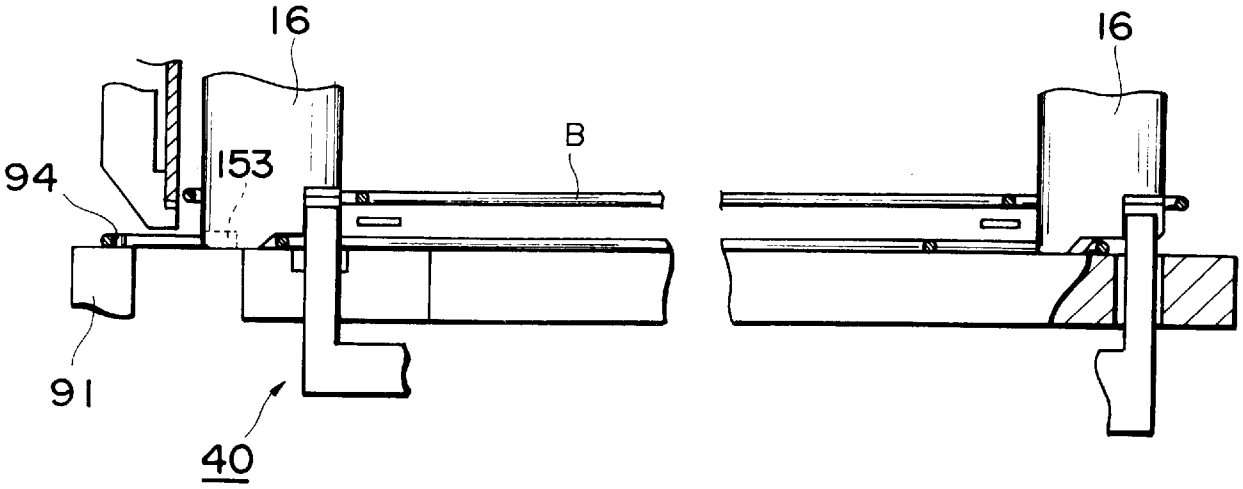
Figure 45B:
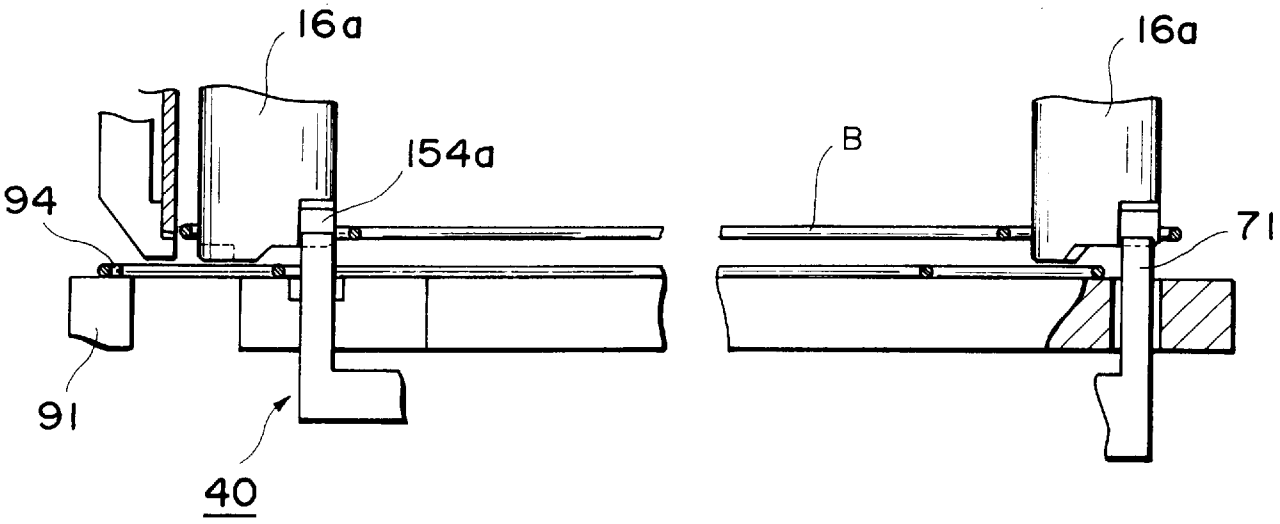
FIG. 45B is a side view to show a state in which after lifting the front the rear floating rods, the lowermost wire heald is drawn out.

Firstly, the operation of the above embodiment is similar to those shown in FIGS. 32A, 34A, 35A and 37A, 41A, 42A, 43A and 45A. FIGS. 32B and 41B show the state before the drawing operation does not start. Next in this drawing operation, as shown in FIG. 34B and 43B, the wire heald 7 is pushed up by claw portion 42 and thereafter, as shown in FIG. 34C and FIG. 45B, the floating rode 16*a* is lifted by the driving unit 312 etc. Such operation is realized by using the specific bottom figures as shown in FIGS. 37B and 42B. In the specific bottom configure of the floating rods has a recessed portions 16*b* having a depth δ. Further, FIGS. 32B corresponds to FIG. 41B, FIG. 34B corresponds to FIG. 43C and FIG. 34C corresponds to FIG. 45B. In the above embodiment, the wire heald separating mechanis as shown in FIG. 35B is used and the mechanism 70 has a specific shaped block push member 71*a*. The detail explanation will be omitted because the operation and the shape theteof are similar to the previous embodiments except for the above explaned portions.

Since the drawing/separating apparatus and drawing/separating method of wire heald according to the present invention are arranged as described above, they can achieve the following effects.

Namely, the drawing/separating apparatus of wire heald comprises the pair of front and rear floating rods extending vertically as inserted into respective guide holes of the pair of ring portions formed at the both ends of wire heald, the magnetic head located below the lower end face of the front floating rod and comprised of the iron core of the electromagnet, the drawing pin provided at the top portion of the magnetic head and arranged to contact the lower end face of the front floating rod to push the floating rod up and to be inserted into the front ring portion of the lowermost heald, the first driving means for moving the magnetic head horizontally as making the lower end face of the floating rod contact with the top surface of the drawing pin, and the second driving means for moving the magnetic head toward the lower end face of the floating rod and pushing the lower end face of the front floating rod up by the top surface of the drawing pin, whereby the lowermost wire heald can be drawn out surely one by one from a group of wire healdes.

In the drawing/separating method of wire heald, the pair of front and rear floating rods extending vertically are inserted into the guide holes of the pair of ring portions formed at the both ends of wire heald, the wire healdes are maintained in a vertical stack in that state, the lower end face of the front floating rod is lifted by the top surface of the drawing pin provided at the top portion of the magnetic head to insert the drawing pin into the front ring portion of the lowermost heald, and thereafter the magnetic head is moved horizontally as keeping the lower end face of the front floating rod in contact with the top surface of the drawing pin, thereby horizontally drawing the lowermost wire heald as hooked on the drawing pin, whereby the lowermost wire heald can be surely drawn out one by one from the group of wire healdes.

Namely, the drawing/separating apparatus of wire heald comprises the pair of front and rear floating rods extending vertically as inserted into the respective guide holes of the pair of ring portions formed at the both ends of wire heald, the notch portion formed in the front part in the lower end face of the front floating rod, the magnetic head disposed below the lower end face of the front floating rod and comprised of the iron core of the electromagnet, the drawing pin fixed to the tip of the magnetic head and arranged to be inserted into the notch portion of the front floating rod, the first driving means for moving the magnetic head horizontally, and the second driving means for moving the magnetic head toward the lower end face of floating rod and inserting the drawing pin into the notch portion of floating rod, whereby the lowermost wire heald can be drawn out surely one by one from the group of wire healdes.

In the drawing/separating method of wire heald, the pair of front and rear floating rods extending vertically are inserted into the respective guide holes of the pair of ring portions formed at the both ends of wire heald, the wire healdes are maintained in a vertical stack in that state, the drawing pin of the magnetic head is inserted into the notch portion formed in the front part in the lower end face of the front floating rod, and thereafter the magnetic head is moved horizontally to draw the lowermost wire heald as hooked on the drawing pin, whereby the lowermost wire heald can be drawn out surely one by one from the group of wire healdes. In addition, it can naturally cancel entanglement between mails of wire healdes upon drawing.

Further, the drawing/separating apparatus of wire heald comprises the magnetic head disposed opposite to the guide hole formed in one ring portion of the extremal wire heald and comprised of the iron core of the electromagnet, the drawing pin fixed to the tip of the magnetic head and arranged to be inserted into the guide hole of the ring portion, the first driving means extending in the drawing direction of wire heald and arranged to hold the magnetic head through the moving base, and the second driving means fixed to the moving base and arranged to move the magnetic head toward the ring portion and to insert the drawing pin into the guide hole of the ring portion, whereby the extremal wire heald can be drawn out surely from the group of wire healdes.

In the drawing method of wire heald, the drawing pin provided at the tip end portion of the magnetic head is inserted into the guide hole formed in one ring portion of the extremal wire heald, the ring portion of the extremal wire heald is magnetically attached to the tip end face of the magnetic head, and thereafter the magnetic head is moved in the extending direction of wire heald to draw the extremal wire heald as hooked on the drawing pin, whereby the extremal wire heald can be drawn out surely from the group of wire healdes.

From the invention thus described, it will be obvious that the invention may be varied in many ways. Such variations are not to be regarded as a departure from the spirit and scope of the invention, and all such modifications as would be obvious to one skilled in the art are intended for inclusion within the scope of the following claims.

The basic Japanese Application No. 024175/1996 filed on Feb. 9 1996, No. 113787/1996 filed on May 8 1996, No. 113799/1996 filed on May 8 1996, and No. 114894/1996 filed on May 9 1996 are hereby incorporated. by reference.

What is claimed is:

1. A method for drawing an arbitrary wire heald from a group of wire healds, comprising the steps of:

inserting a drawing pin located on a notch portion of a magnetic head into a guide hole formed on one side ring portion of said wire heald:

moving said magnetic head in a longitudinal direction of the wire heald after magnetically attracting said ring portion;

drawing the lowermost wire heald as hooked on said drawing pin;

in state wherein a pair of front and rear floating rods extending vertically are inserted in respective guide holes of paired ring portions formed at the both ends of said wire healds, pushing up a lower end face of a front floating rod with a notch face provided on the notch portion of the magnetic head; and moving the magnetic head horizontally with maintaining contact of said lower end face of the front floating rod with the notch portion of the drawing pin after inserting the drawing pin into the ring portion of the lowermost front floating rod.

2. A method for drawing an arbitrary wire heald from a group of wire healds, comprising the steps of:

inserting a drawing pin located on a notch portion of a magnetic head into a guide hole formed on one side ring portion of said wire heald;

moving said magnetic head in a longitudinal direction of the wire heald after magnetically attracting said ring portion;

in a state wherein a pair of front and rear floating rods extending vertically are inserted in respective guide holes of paired ring portions formed at the both ends of said wire healds, maintaining said wire healds in a vertical stack;

putting a drawing pin of a magnetic head into a notch portion formed in a front part in a lower end face of the front floating rod; and thereafter moving said magnetic head horizontally drawing the lowermost wire heald as hooked on said drawing pin, wherein upon drawing of the lowermost wire heald by said drawing pin, ring pulling portion horizontally cut in rear part in lower end face of at least one of the front and rear floating rod is interposed to pull said ring portion of the lowermost wire heald toward said lower end face of said floating rod.

3. A method for drawing an arbitrary wire heald from a group of wire healds, comprising the steps of:

inserting a drawing pin located on a notch portion of a magnetic head into a guide hole formed on one side ring portion of said wire heald;

moving said magnetic head in a longitudinal direction of the wire heald after magnetically attracting said ring portion;

drawing the lowermost wire heald as hooked on said drawing pin in a state wherein a pair of front and rear floating rods extending vertically are inserted in respective guide holes of paired ring portions formed at the both ends of said wire healds, maintaining said wire healds in a vertical stack;

putting a drawing pin of a magnetic head into a notch portion formed in a front part in a lower end face of the front floating rod; and thereafter moving said magnetic head horizontally, wherein upon drawing of the lowermost wire heald by said drawing pin, tapered ring pulling portions formed in rear parts in lower end face of at least one of the front and rear floating rod is interposed to pull said ring portions of the lowermost wire heald toward said lower end faces of the floating rods.

4. A method for drawing an arbitrary wire heald from a group of wire healds, comprising the steps of:

inserting a drawing pin located on a notch portion of a magnetic head into a guide hole formed on one side ring portion of said wire heald;

moving said magnetic head in a longitudinal direction of the wire heald after magnetically attracting said ring portion; and drawing the lowermost wire heald as hooked on said drawing pin in a state wherein a pair of front and rear floating rods extending vertically are inserted in respective guide holes of paired ring portions formed at the both ends of said wire healds, maintaining said wire healds in a vertical stack;

putting a drawing pin of a magnetic head into a notch portion formed in a front part in a lower end face of the front floating rod; and thereafter moving said magnetic head horizontally, wherein upon drawing of the lowermost wire heald by said drawing pin, a ring pulling portion horizontally cut in a rear part in said lower end face of the front floating rod is interposed to pull the front ring portion in the lowermost wire heald toward said lower end face of the front floating rod and, at the same time, a tapered ring pulling portion formed in a rear part in a lower end face of the rear floating rod to pull the rear ring portion in the lowermost wire heald toward said lower end face of the rear floating rod.

5. A method for drawing an arbitrary wire heard from a group of wire healds, comprising the steps of:

inserting a drawing pin located on a notch portion of a magnetic head into a guide hole formed on one side ring portion of said wire heard;

moving said magnetic head in a longitudinal direction of the wire heald after magnetically attracting said ring portion; and drawing the lowermost wire heald as hooked on said drawing pin in a state wherein a pair of front and rear floating rods extending vertically are inserted in respective guide holes of paired ring portions formed at the both ends of said wire healds, maintaining said wire healds in a vertical stack;

putting a drawing pin of a magnetic head into a notch portion formed in a front part in a lower end face of the front floating rod; and thereafter moving said magnetic head horizontally, wherein upon drawing of the lowermost wire heald by said drawing pin, a tapered ring pulling portion formed in a rear part in said lower end face of the front floating rod is interposed to pull the front ring portion in the lowermost wire heald toward said lower end face of the front floating rod and, at the same time, a ring pulling portion horizontally cut in a rear part in a lower end face of the rear floating rod is interposed to pull the rear ring portion in the lowermost wire heald toward said lower end face of rear floating rod.

6. A drawing method of wire heald according to claim 1, further comprising the steps of:

upon drawing of the lower most wire heald by said drawing pin, pushing up the lower end face of said front floating rod with a notch face of the protruding portion located on a rear portion of said drawing pin; and moving the magnetic head horizontally with keeping the contact of the lower end face of the front floating rod with the notch face of the drawing pin after inserting the drawing pin into the ring portion of the lowermost floating to draw the lowermost wire heald.

7. Apparatus for drawing an arbitrary wire heard from a group of wire healds of magnetic material juxtaposed, comprising:

a magnetic facing to a guide hole formed in one side of the ring portions of the nearest wire heald and comprising an electromagnetic core;

a drawing pin fixed on a notch portion of said magnetic head and to be inserted into the guide hole of the ring portion;

a first driving means, extending in a drawing direction of the wire heald, for holding the magnetic head through a movable base;

a second driving means, fixed to the movable base for moving the magnetic head to the ring portion, for inserting the drawing pin into the guide hole of the ring portion; and a notch portion formed in a front part in a lower end face of the front floating rod, wherein the drawing pin is to be inserted into said notch portion of the front floating rod thereby establishing the engagement of the said pin and the wire heald.

8. Apparatus for drawing an arbitrary wire heald from a group of wire healds of magnetic material juxtaposed, comprising:

a magnetic facing to a guide hole formed in one side of the ring portions of the nearest wire heald and comprising an electromagnetic core;

a drawing pin fixed on a notch portion of said magnetic head and to be inserted into the guide hole of the ring portion;

a first driving means, extending in a drawing direction of the wire heald, for holding the magnetic head through a movable base; and a second driving means, fixed to the movable base for moving the magnetic head to the ring portion, for inserting the drawing pin into the guide hole of the ring portion, wherein said drawing pin pushes up said floating rod with keeping the contact of the drawing pin with the lower end face of the front floating rod.

9. A drawing apparatus of wire heald according to claim 7, wherein a ring pulling portion horizontally cut is formed in a rear part in said lower end face of the front floating rod, for pulling said front ring portion of the lowermost wire heald therein.

10. A drawing apparatus of wire heald according to claim 7, wherein a tapered ring pulling portion is formed in a rear part in said lower end face of the front floating rod, for pulling said front ring portion of the lowermost wire heald therein.

11. A drawing apparatus of wire heald according to claim 7, wherein a ring pulling portion horizontally cut is formed in a rear part in a lower end face of the rear floating rod, for pulling said rear ring portion of the lowermost wire heald therein.

12. A drawing apparatus of wire heald according to claim 10, wherein a multiple draw preventing portion is located in front of said front floating rod and said multiple draw preventing portion comprises a rotatable switch piece arranged to collide with a second or higher wire heald from the bottom taken together upon drawing of the lowermost wire heald by said magnetic head, and a spring for holding said switch piece by predetermined urging force.

* * * * *

UNITED STATES PATENT AND TRADEMARK OFFICE

CERTIFICATE OF CORRECTION

PATENT NO. : 5,839,606

DATED : November 24, 1998

INVENTOR(S) : KUROYANAGI

It is certified that error appears in the above-identified patent and that said Letters Patent is hereby corrected as shown below:

ON THE TITLE PAGE

Please change:

"[30] Foreign Application Priority Data

February 9, 1996 [JP]..... 8-024176
May 8, 1996 [JP]..... 8-113787
May 8, 1996 [JP]..... 8-113799
May 9, 1996 [JP]..... 8-114894"

to

--[30] Foreign Application Priority Data

February 9, 1996 [JP]..... 8-024175
May 8, 1996 [JP]..... 8-113787
May 8, 1996 [JP]..... 8-113799
May 9, 1996 [JP]..... 8-114894--.

Signed and Sealed this

Eighth Day of February, 2000

*Attest:*

*Attesting Officer*

Q. TODD DICKINSON

*Commissioner of Patents and Trademarks*